US007727693B2

(12) United States Patent
Ishida et al.

(10) Patent No.: US 7,727,693 B2
(45) **Date of Patent: *Jun. 1, 2010**

(54) ELECTROPHOTOGRAPHIC PHOTORECEPTOR, ELECTROPHOTOGRAPHIC IMAGE FORMING METHOD, AND ELECTROPHOTOGRAPHIC APPARATUS

(75) Inventors: Kazuya Ishida, Kyoto (JP); Akihiro Kondoh, Nara (JP); Takatsugu Obata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 944 days.

This patent is subject to a terminal disclaimer.

(21) Appl. No.: 10/554,099

(22) PCT Filed: Apr. 16, 2004

(86) PCT No.: PCT/JP2004/005506

§ 371 (c)(1),
(2), (4) Date: Oct. 21, 2005

(87) PCT Pub. No.: WO2004/095144

PCT Pub. Date: Nov. 4, 2004

(65) Prior Publication Data

US 2006/0222979 A1 Oct. 5, 2006

(30) Foreign Application Priority Data

Apr. 24, 2003 (JP) ..... 2003-120135
May 28, 2003 (JP) ..... 2003-151334

(51) Int. Cl.
*G03G 5/06* (2006.01)

(52) U.S. Cl. ..... 430/72; 430/58.85; 430/59.4; 430/59.5; 430/73; 430/78; 430/123.4; 399/53; 399/159

(58) Field of Classification Search ..... 430/58.65, 430/58.85, 59.4, 59.5, 72, 73, 78, 123.4; 399/53, 159
See application file for complete search history.

(56) References Cited

U.S. PATENT DOCUMENTS 4,471,039 A 9/1984 Borsenberger et al.
4,522,483 A * 6/1985 Matsumoto et al. ..... 399/167
4,557,868 A 12/1985 Page et al.
4,725,519 A 2/1988 Suzuki et al.
4,898,799 A 2/1990 Fujimaki et al.
4,971,877 A 11/1990 Miyamoto et al.
4,981,767 A 1/1991 Tokura et al.
5,106,536 A 4/1992 Miyamoto et al.
5,132,197 A 7/1992 Iuchi et al.
5,238,765 A * 8/1993 Senoo et al. ..... 430/73
5,250,990 A * 10/1993 Fujimura et al. ..... 430/66
5,292,604 A 3/1994 Nukada et al.
5,554,472 A * 9/1996 Aizawa ..... 430/59.6
5,595,846 A 1/1997 Shigematsu et al.
6,150,063 A 11/2000 Sugimura et al.
6,178,303 B1 * 1/2001 Ishii et al. ..... 399/236
6,210,847 B1 4/2001 Miyauchi et al.
6,270,936 B1 * 8/2001 Tanaka et al. ..... 430/59.5
6,485,658 B1 11/2002 Horiuchi et al.
6,489,072 B2 * 12/2002 Sasaki et al. ..... 430/59.5
7,175,956 B2 * 2/2007 Obata et al. ..... 430/58.5
7,416,824 B2 * 8/2008 Kondoh et al. ..... 430/58.85
7,449,269 B2 * 11/2008 Sugimura ..... 430/58.85
7,457,565 B2 * 11/2008 Fujii et al. ..... 399/159
7,534,539 B2 * 5/2009 Obata et al. ..... 430/72
2004/0101770 A1 5/2004 Obata et al.

FOREIGN PATENT DOCUMENTS

JP 59-155851 A 9/1984
JP 61-28557 A 2/1986
JP 1-42659 A 6/1989
JP 1-142658 A 6/1989
JP 2-84661 A 3/1990
JP 2-170166 A 6/1990
JP 2-233769 A 9/1990
JP 2-272067 A 11/1990
JP 3-128973 A 5/1991
JP 4-78858 A 3/1992
JP 4-351673 A 12/1992
JP 4-372663 A 12/1992

(Continued)

OTHER PUBLICATIONS

USPTO English-language transation of JP 2003-12619A (pub. Jan. 2003).*

(Continued)

*Primary Examiner*—Janis L Dote
(74) *Attorney, Agent, or Firm*—Nixon & Vanderhye P.C.

(57) ABSTRACT

An object of the invention is to provide an electrophotographic photoreceptor showing high responsivity even under a low temperature and low humidity circumstance and capable of compatibilize the decrease of the size and the increase in the image forming speed of an electrophotographic apparatus. In a photosensitive layer of an electrophotographic photoreceptor, oxotitanium phthalocyanine having a crystal form showing a diffraction peak at a Bragg angle 2θ (error: 2θ±0.2°) of 27.2° in an X-ray diffraction spectrum is contained as a charge generating substance, and an enamine compound represented by the general formula for example, the structural formula (1-1) is contained as a charge transporting substance. Accordingly, the electrophotographic photoreceptor showing high responsivity even under a low temperature and low humidity circumstance is realized.

23 Claims, 18 Drawing Sheets

FOREIGN PATENT DOCUMENTS

| | | | | |
|---|---|---|---|---|
| JP | 5-55860 | B2 | | 8/1993 |
| JP | 6-308744 | A | | 11/1994 |
| JP | 7-91486 | B2 | | 10/1995 |
| JP | 8-67829 | A | | 3/1996 |
| JP | 08-185089 | | * | 7/1996 |
| JP | 9-73182 | A | | 3/1997 |
| JP | 2700859 | B2 | | 10/1997 |
| JP | 10-69107 | A | | 3/1998 |
| JP | 10-90926 | A | | 4/1998 |
| JP | 10-148953 | A | | 6/1998 |
| JP | 10-239875 | | * | 9/1998 |
| JP | 11-184110 | A | | 7/1999 |
| JP | 2000-129155 | A | | 5/2000 |
| JP | 2000-313819 | A | | 11/2000 |
| JP | 2000-338696 | A | | 12/2000 |
| JP | 2001-33992 | A | | 2/2001 |
| JP | 2001-117246 | A | | 4/2001 |
| JP | 2002-23396 | A | | 1/2002 |
| JP | 2002-365820 | A | | 12/2002 |
| JP | 2003-12619 | A | | 1/2003 |
| JP | 2003-107763 | A | | 4/2003 |
| JP | 2004-151666 | A | | 5/2004 |

OTHER PUBLICATIONS

Japanese Patent Office English language abstract and machine-assisted translation of JP 08-185089 (pub. Jul. 1996).*

USPTO English-language translation of JP 08-185089 (pub. Jul. 1996).*

Japanese Patent Office machine-assisted translation of JP 10-239875 (pub. Sep. 1998).*

Diamond, A. S., ed., Handbook of Imaging Materials, Marcel Dekker, Inc., NY (1991), pp. 413 and 415.*

International Search Report for PCT/JP2004/005506 dated Sep. 7, 2004.

English transaction of the International Preliminary Report on Patentability mailed Nov. 10, 2005 in corresponding PCT application No. PCT/JP2004/005506.

* cited by examiner

ELECTROPHOTOGRAPHIC PHOTORECEPTOR, ELECTROPHOTOGRAPHIC IMAGE FORMING METHOD, AND ELECTROPHOTOGRAPHIC APPARATUS

This application is the US national phase of international application PCT/JP2004/005506 filed 16 Apr. 2004 which designated the U.S. and claims benefit of JP 2003-120135 filed 24 Apr. 2003, and JP 2003-151334 filed 28 May 2003.

TECHNICAL FIELD

The present invention concerns an electrophotographic photoreceptor, an electrophotographic image forming method and an electrophotographic apparatus using the same and, more specifically, relates to an electrophotographic photoreceptor having a photosensitive layer containing a specified charge generating substance and a specified charge transporting substance, as well as an electrophotographic image forming method and an electrophotographic apparatus using the same.

BACKGROUND ART

Image forming apparatus forming images by using an electrophotographic image forming method (hereinafter also referred to simply as "electrophotographic apparatus") has been often used, for example, in copying machines, printers, or facsimile units. In the electrophotographic apparatus, images are formed by way of the following electrophotographic process. At first, the surface of an electrophotographic photoreceptor provided to the apparatus (hereinafter also referred to simply as "photoreceptor") is charged to a predetermined potential uniformly. Exposure is applied to the surface of the charged photoreceptor in accordance with image information to form electrostatic latent images. The formed electrostatic latent images are developed by a developer containing a toner and the like to form toner images as visible images. The formed toner images are transferred from the surface of the photoreceptor onto a body to be transferred and fixed to form images.

The electrophotographic photoreceptor includes a conductive substrate comprising a conductive material and a photosensitive layer disposed on the conductive substrate. As the material for constituting the photosensitive layer of the photoreceptor, inorganic photoconductive materials such as selenium, cadmium sulfide or zinc oxide have been known so far. While inorganic photoreceptors using such inorganic photoconductive materials have various advantageous that they can be charged to an appropriate potential in a dark place, release less charges in the dark place and can release charges rapidly by irradiation of light, they also have various drawbacks. For example, selenium type photoreceptors using selenium require difficult manufacturing conditions and need high manufacturing cost. Further, since they are sensitive to thermal or mechanical impacts, a care has to be taken during handling. A cadmium sulfide type photoreceptor using cadmium sulfide and a zinc oxide type photoreceptor using zinc oxide can not obtain a stable sensitivity under a high humidity circumstance and, in a case where a dye is added as a sensitizer, since the dye is degraded under charging by corona charging upon charging the surface of the photoreceptor or optically discolored by exposure, stable characteristics can not be provided for a long time.

As described above, since the inorganic photoreceptors have many drawbacks, organic photoreceptors using organic photoconductive materials have been proposed instead of the inorganic photoreceptors as the photoreceptor. For example, photoreceptors using various organic photoconductive polymers including polyvinyl carbazole are present. However, while the photoreceptors using the polymers are excellent in view of the film forming property and decrease of weight of the photosensitive layer compared with the inorganic photoreceptors using the inorganic photoconductive materials described above, they have a drawback of being poor in view of the sensitivity, the durability and stability to the change of the circumstance.

Various research and development have been conducted for overcoming such drawbacks, and a function separated photoreceptor has been proposed in which a charge generation function and a charge transport function as the photoconductive function due to the organic photoconductive polymer in the organic photoreceptor are shared on separate materials respectively. The function separated photoreceptor includes a layered type and a single layer type. In the layered type function separated photoreceptor, a layered type photosensitive layer formed by stacking a charge generating layer containing a charge generating substance responsible for the charge generation function and a charge transporting layer containing a charge transporting substance responsible for the charge transport function is provided. In the single layer type function separated photoreceptor, a photosensitive layer of a single layer type formed by dispersing a charge generating substance and a charge transporting substance in the identical layer is provided.

In the function separated photoreceptor described above, a selection range for the material constituting the photosensitive layer is wide and a photoreceptor of high performance can be provided by combining materials so as to optimize electrophotographic characteristic such as charging characteristic, sensitivity, residual potential characteristic, repetitive characteristic, and printing resistance. Further, since the photosensitive layer can be formed by coating, an inexpensive photoreceptor having extremely high productivity can be provided.

Further, in the function separated photoreceptor, a charge generating substance absorbs light with which the photoreceptor is irradiated to generate charges and the charges are injected to the charge transporting substance and transported to the surface of the photoreceptor to thereby eliminate the surface charges on the photoreceptor at a portion irradiated with light. As described above, since the light with which the photoreceptor is irradiated is absorbed in the charge generating substance, the light sensitive wavelength region of the photoreceptor can optionally be controlled by properly selecting the charge generating substance.

In recent years, for obtaining images of higher quality, storing inputted image information or optionally editing the same, digitalization of image information has been popularized rapidly. While electrophotographic apparatus forming images by using digitalized image information have been restricted so far to laser printers, LED (Light Emitting Diode) printers as output equipments for word processors and personal computers, as well as to some color laser copying machines, digitalization has also been proceeded in the field of usual copying machines in which images were formed predominantly by using analog image information.

In digitalized electrophotographic apparatus, exposure to the surface of the photoreceptor is conducted as described below. For example, in a case of forming images by directly using digital image information prepared by a computer, digital electric signals as image information outputted from the computer are converted into optical signals and the surface of the photoreceptor is irradiated with light corresponding to the optical signals to apply exposure in accordance with the image information to the surface of the photoreceptor. Further, in a case of forming images by using image information read from original document images as in the case of copying machines, image information for the document images are read as optical signals, converted into digital electric signals and then again converted into optical signals, and the surface of the photoreceptor is irradiated with light corresponding to the optical signals to thereby apply exposure to the surface of the photoreceptor in accordance with the image information.

In the digital electrophotographic apparatus, a laser light or LED light has been used mainly for the light as light corresponding to the optical signals which are digital image information with which light the surface of the photoreceptor is irradiated. Among them, a light used most frequently is a near infrared light at a wavelength of 780 nm or a light in a long wavelength region such as a red light at a wavelength of 660 nm. Accordingly, what is demanded at first for the photoreceptor used for the digital electrophotographic apparatus is that it has a sensitivity to the light in such long wavelength region.

As described above, the light sensitive wavelength region of the photoreceptor can be optionally selected by properly selecting the charge generating substance. As the charge generating substance showing sensitivity to a light in the long wavelength region such as the near infrared light or red light described above, versatile materials have been studied so far. Among them, since phthalocyanine compounds are synthesized relatively easily and most of them show the sensitivity to the long wavelength light, they have been studied generally and put to practical use.

For example, there have been proposed a photoreceptor using oxotitanium phthalocyanine (refer to Japanese Examined Patent Publication JP-B2 5-55860 (1993)), a photoreceptor using a β-type indium phthalocyanine (refer to Japanese Unexamined Patent Publication JP-A 59-155851 (1984)), a photoreceptor using X-type non-metal phthalocyanine (refer to Japanese Unexamined Patent Publication JP-A 2-233769 (1990)) and a photoreceptor using oxovanadium phthalocyanine (refer to Japanese Unexamined Patent Publication JP-A 61-28557 (1986)).

Recently, it has been found that oxotitanium phthalocyanine having specified crystal forms shows particularly high sensitivity to a long wavelength region and photoreceptors using them have been proposed. They are photoreceptor using, for example, oxotitanium phthalocyanine having a crystal form showing a maximum diffraction peak at the Bragg angle of 2θ (error: 2θ±0.2°) of 27.3° and showing a diffraction peak at 7.4°, 9.7° and 24.2° (refer to Japanese Examined Patent Publication JP-B2 7-91486 (1995)), oxotitanium phthalocyanine having a crystal form showing main diffraction peaks at the Bragg angle 2θ (error: 2θ±0.2°) of 9.5°, 9.7°, 11.7°, 15.0°, 23.5°, 24.1°, and 27.3° (refer to Japanese Examined Patent Publication JP-B2 2700859) or, oxotitanium phthalocyanine having a crystal form showing main diffraction peaks at the Bragg angle 2θ (error: 2θ±0.2°) of 9.0°, 14.2°, 23.9°, and 27.1° (refer to Japanese Unexamined Patent Publication JP-A 3-128973 (1991)) in the X-ray diffraction spectrum.

Further, it has been known that a photoreceptor using oxotitanium phthalocyanine having a crystal form showing, in view of X-ray diffraction spectrum, main diffraction peaks at the Bragg angle 2θ (error: 2θ±0.2°) of 7.3°, 9.4°, 9.6°, 11.6°, 13.3°, 17.9°, 24.1° and 27.2° in which a bundle of diffraction peaks formed by overlap of a diffraction peak at 9.4° and a diffraction peak at 9.6° shows the maximum intensity and a diffraction peak at 27.2° shows the intensity next to the highest has a particularly high sensitivity to a light in a long wavelength region light and has good stability of characteristics during repetitive use (refer to Japanese Unexamined Patent Publication JP-A 2000-129155).

Further, photoreceptors of using two or more kinds of phthalocyanine compounds have also been proposed. They are, for example, a photoreceptor using a phthalocyanine composition containing oxotitanium phthalocyanine and non-metal phthalocyanine and having a diffraction peak at Bragg angles 2θ (error: 2θ±0.2°) of 7.0°, 9.0°, 14.1°, 18.0°, 23.7°, and 27.3° in the X-ray diffraction spectrum to CuKα characteristic X-rays (wavelength: 1.541 Å) (refer to Japanese Unexamined Patent Publication JP-A 2000-313819), and a photoreceptor using mixed crystals of phthalocyanine comprising oxotitanium phthalocyanine and gallium halide phthalocyanine or indium halide phthalocyanine (refer to Japanese Unexamined Patent Publication JP-A 4-372663 (1992)).

On the other hand, for the electrophotographic apparatus, decrease of size and increase in the image forming speed have also been demanded. In the electrophotographic apparatus used for example in copying machines, printers and facsimile units, a photoreceptor having a photosensitive layer provided on the outer circumferential surface of a cylindrical or circular columnar conductive substrate has been used generally and it is necessary to decrease the diameter of the photoreceptor in order to reduce the size of the electrophotographic apparatus. However, in the photoreceptor of a small diameter, since the distance from the exposure position to the developing position is short, when an electrophotographic process is conducted at high speed in order to increase the image forming speed, the time from exposure to the development is shortened to result in the following problems. For example, in a case of using a photoreceptor of low responsivity, that is, a photoreceptor of low decaying speed for the surface potential after exposure, development is conducted in a state where the surface potential at a portion to be erased by the exposure has not yet been decayed sufficiently. Therefore, in a case of normal development, a phenomenon referred to as background contamination occurs in which a toner is deposited to a portion as a white background images and, in a case of reversal development, the image density is lowered. Accordingly, for compatibilizing decrease of the size and increase in the image forming speed of the electrophotographic apparatus, a photoreceptor of high responsivity is demanded.

Since phthalocyanine compounds used in the photoreceptors described above in JP-B2 7-91486, JP-B2 2700859, JP-A 3-128973 and JP-A 2000-129155, JP-B2 5-55860, and JP-A 59-155851, JP-A 61-28557, JP-A 2-233769, JP-A 2000-313819 and JP-A4-372663 have high charge generation ability and high charge injection efficiency, the photoreceptors described in the publications have responsivity to some extent. However, no sufficient responsivity has yet been obtained in the photoreceptors described above since the combination between the phthalocyanine compound as the charge generating substance and the charge transporting substance is not appropriate. Particularly, no sufficient responsivity can be obtained under a circumstance where temperature is low and the humidity is low (hereinafter such circumstance is referred to as "low temperature, low humidity circumstance"), and background contamination or lowering of image density occurs in a case of decreasing the diameter of the photoreceptors and using them in a high speed electrophotographic process. Accordingly, in a case of using the photoreceptors described above while decreasing the diameter, it is necessary to suppress the speed of the electrophotographic process, so that the image forming speed of the electrophotographic apparatus cannot be increased. That is, in a case of using the photoreceptors, it is impossible to compatibilize the decrease of the size and the increase in the image forming speed of the electrophotographic apparatus.

DISCLOSURE OF THE INVENTION

An object of the invention is to provide an electrophotographic photoreceptor showing high responsivity even under a low temperature and low humidity circumstance by the combination of a specified charge generating substance and a specified charge transporting substance and capable of compatibilize the decrease of the size and the increase in the image forming speed of an electrophotographic apparatus, as well as an electrophotographic image forming method and an electrophotographic apparatus using the same.

The invention provides an electrophotographic photoreceptor comprising:

a conductive substrate formed of a conductive material; and a photosensitive layer disposed on the conductive substrate and containing oxotitanium phthalocyanine having a crystal form showing a diffraction peak at a Bragg angle 2θ (2θ±0.2°) of 27.2° in an X-ray diffraction spectrum and an enamine compound represented by the following general formula (1).

(1)

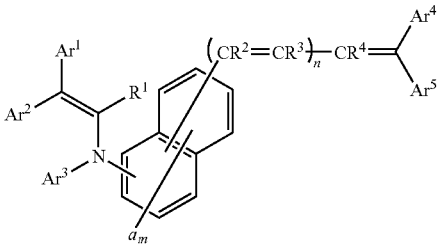

wherein $Ar^1$ and $Ar^2$ each represent an aryl group which may have a substituent or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent.

In accordance with the invention, the electrophotographic photoreceptor includes a conductive substrate and a photosensitive layer, and the photosensitive layer contains oxotitanium phthalocyanine having a specified crystal form showing a diffraction peak at the Bragg angle 2θ (error: 2θ±0.2°) of 27.2° in the X-ray diffraction spectrum as the charge generating substance, and the enamine compound represented by the general formula (1) as the charge transporting substance. This can provide an electrophotographic photoreceptor showing high responsivity even under a low temperature and low humidity circumstance. It is considered that the electrophotographic photoreceptor of the invention shows high responsivity even under the low temperature and low humidity circumstance because the combination between said oxotitanium phthalocyanine having the specified crystal form contained as the charge generating substance and the enamine compound represented by the general formula (1) contained as the charge transporting substance is preferred. That is, since said oxotitanium phthalocyanine having the specified crystal form is a charge generating substance having high charge generation performance and high charge injection efficiency, it generates a great amount of charges by absorption of light and efficiently injects the generated charges without accumulating them in the inside to the charge transporting substance. Further, since the enamine compound represented by the general formula (1) is a charge transporting substance having high charge transportability, charges generated at said oxotitanium phthalocyanine having the specified crystal form by light absorption are efficiently injected to the enamine compound represented by the general formula (1) and smoothly transported to the surface of the photosensitive layer. Accordingly, an electrophotographic photoreceptor showing high responsivity even under the low temperature and low humidity circumstance can be obtained by incorporation of said oxotitanium phthalocyanine having the specified crystal form and the enamine compound represented by the general formula (1) in combination to the photosensitive layer.

As described above, since the electrophotographic photoreceptor according to the invention shows high responsivity even under the low temperature and low humidity circumstance, it can provide images at high quality in various circumstances such as the low temperature and low humidity circumstance even in a case of decreasing the size and being used for a high speed electrophotographic process. That is, in a case of using the electrophotographic photoreceptor of the invention being decreased in the size, since it is not necessary to suppress the electrophotographic processing speed, the image forming speed of the electrophotographic apparatus can be increased. Accordingly, by the use of the electrophotographic photoreceptor according to the invention, decrease of the size and the increase in the image forming speed of the electrophotographic apparatus can be made compatible and it is possible to attain a highly reliable electrophotographic apparatus capable of compatibilizing the decrease of the size and the increase in the image forming speed of the electrophotographic apparatus, decreased in the size, having high image forming speed, and capable of providing images at high quality under various circumstances such as the low temperature and low humidity circumstance.

Further, the invention is characterized in that the enamine compound represented by the general formula (1) is an enamine compound represented by the following general formula (2).

(2)

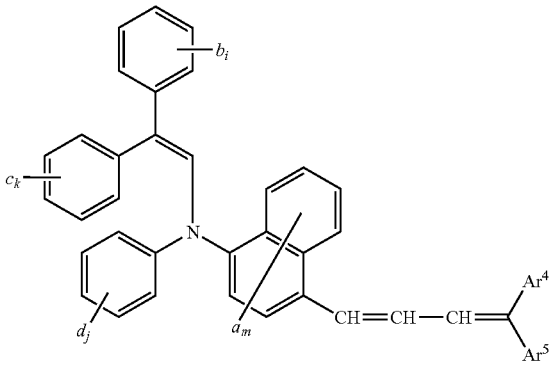

wherein "b", "c" and "d" each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

In accordance with the invention, since the photosensitive layer contains an enamine compound represented by the general formula (2) having a particularly high charge transportability among the enamine compounds represented by the general formula (1), an electrophotographic photoreceptor showing higher responsivity can be obtained. By using such an electrophotographic photoreceptor, the image forming speed of the electrophotographic apparatus can be increased further. Further, since the enamine compound represented by the general formula (2) can be synthesized relatively easily at a high yield and can be manufactured at a reduced cost among the enamine compounds represented by the general formula (1), the electrophotographic photoreceptor of the invention showing the high responsivity as described above can be manufactured at a reduced manufacturing cost.

Further, the invention is characterized in that said oxotitanium phthalocyanine is oxotitanium phthalocyanine having a crystal form showing main diffraction peaks at the Bragg angles 2θ (2θ±0.2°) of 7.3°, 9.4°, 9.6°, 11.6°, 13.3°, 17.9°, 24.1°, and 27.2° in which a bundle of diffraction peaks formed by overlap of a diffraction peak at 9.4° and a diffraction peak at 9.6° shows a maximum intensity among the diffraction peaks described above, and the diffraction peak at 27.2° shows an intensity next to the maximum intensity in the X-ray diffraction spectrum.

In accordance with the invention, the photosensitive layer contains oxotitanium phthalocyanine having the specified crystal form giving an X-ray diffraction spectrum shown in FIG. 2 described later. Since said oxotitanium phthalocyanine having the specified crystal form shows a particularly high sensitivity to a light in a long wavelength region such as a near infrared light or red light, it is possible to obtain an electrophotographic photoreceptor having a light sensitive wavelength region optimal to a digital electrophotographic apparatus using a light in the long wavelength region emitted from a semiconductor laser or a light emission diode for exposure. Further, since said oxotitanium phthalocyanine having the specified crystal form is stable in view of the crystal form and less transfers to other crystal forms, it is possible to obtain an electrophotographic photoreceptor with less lowering of the responsivity during repetitive use and excellent in the characteristic stability also in a case of repetitive use.

Further, the invention is characterized in that said oxotitanium phthalocyanine is oxotitanium phthalocyanine having a crystal form showing main diffraction peaks at the Bragg angles 2θ (2θ±0.2°) of 9.5°, 9.7°, 11.7°, 15.0°, 23.5°, 24.1°, and 27.3° in the X-ray diffraction spectrum.

In accordance with the invention, the photosensitive layer contains oxotitanium phthalocyanine having the specified crystal form giving an X-ray diffraction spectrum shown in FIG. 3 described later. Since said oxotitanium phthalocyanine having the specified crystal form shows a particularly high sensitivity to a light in a long wavelength region such as a near infrared light or red light, it is possible to obtain an electrophotographic photoreceptor having a light sensitive wavelength region optimal to a digital electrophotographic apparatus using a light in the long wavelength region emitted from a semiconductor laser or a light emission diode for exposure. Further, since said oxotitanium phthalocyanine having the specified crystal form is stable in view of the crystal form and less transfers to other crystal forms, it is possible to obtain an electrophotographic photoreceptor with less lowering of the responsivity during repetitive use and excellent in the characteristic stability also in a case of repetitive use.

Further, the invention is characterized in that said oxotitanium phthalocyanine is oxotitanium phthalocyanine having a crystal form showing main diffraction peaks at the Bragg angles 2θ (2θ±0.2°) of 9.0°, 14.2°, 23.9°, and 27.1° in the X-ray diffraction spectrum.

In accordance with the invention, the photosensitive layer contains oxotitanium phthalocyanine having the specified crystal form giving an X-ray diffraction spectrum shown in FIG. 4 to be described later. Since said oxotitanium phthalocyanine having the specified crystal form shows a particularly high sensitivity to a light in a long wavelength region such as a near infrared light or red light, it is possible to obtain an electrophotographic photoreceptor having a light sensitive wavelength region optimal to a digital electrophotographic apparatus using a light in the long wavelength region emitted from a semiconductor laser or a light emission diode for exposure. Further, since said oxotitanium phthalocyanine having the specified crystal form is stable in view of the crystal form and less transfers to other crystal forms, it is possible to obtain an electrophotographic photoreceptor with less lowering of the responsivity during repetitive use and excellent in the characteristic stability also in a case of repetitive use.

The invention provides an electrophotographic photoreceptor comprising:

a conductive substrate comprising a conductive material, and a photosensitive layer disposed on the conductive substrate and containing two or more kinds of metal phthalocyanine containing oxotitanium phthalocyanine and an enamine compound represented by the general formula (1).

In accordance with the invention, the electrophotographic photoreceptor includes a conductive substrate and a photosensitive layer, and the photosensitive layer contains two or more kinds of metal phthalocyanine containing oxotitanium phthalocyanine, that is, oxotitanium phthalocyanine and metal phthalocyanine other than said oxotitanium phthalocyanine as the charge generating substance and contains the enamine compound represented by the general formula (1) as the charge transporting substance. This can provide an electrophotographic photoreceptor showing high responsivity even under a low temperature and low humidity circumstance.

It is considered that the electrophotographic photoreceptor of the invention shows high responsivity even under the low temperature and low humidity circumstance because the combination of the two or more kinds of metal phthalocyanine containing oxotitanium phthalocyanine contained as the charge generating substance and the enamine compound represented by the general formula (1) contained as the charge transporting substance is preferred. That is, since said metal phthalocyanine containing said oxotitanium phthalocyanine is a charge generating substance having high charge generation performance and high charge injection efficiency, it generates a great amount of charges by absorption of light and efficiently injects the generated charges without accumulating them in the inside to the charge transporting substance. Further, since the enamine compound represented by the general formula (1) is a charge transporting substance having high charge transportability, charges generated in the two or more kinds of metal phthalocyanine containing oxotitanium phthalocyanine by light absorption are efficiently injected to the enamine compound represented by the general formula (1) and smoothly transported to the surface of the photosensitive layer. Accordingly, an electrophotographic photoreceptor showing high responsivity even under the low temperature and low humidity circumstance can be obtained by incorporation of the two or more kinds of metal phthalocyanine containing said oxotitanium phthalocyanine and the enamine compound represented by the general formula (1) in combination to the photosensitive layer.

Further, as described above, the photosensitive layer disposed to the electrophotographic photoreceptor of the invention contains said oxotitanium phthalocyanine and said metal phthalocyanine other than said oxotitanium phthalocyanine as the charge generating substance. Accordingly, since the light sensitive wavelength region of the electrophotographic photoreceptor can be changed easily by changing a ratio between said oxotitanium phthalocyanine and said metal phthalocyanine other than said oxotitanium phthalocyanine, an electrophotographic photoreceptor having a desired light sensitive wavelength region can be obtained easily.

Further, the invention is characterized in that said metal phthalocyanine is mixed crystals of oxotitanium phthalocyanine and metal phthalocyanine other than said oxotitanium phthalocyanine.

In accordance with the invention, the photosensitive layer contains mixed crystals of oxotitanium phthalocyanine and metal phthalocyanine other than said oxotitanium phthalocyanine. Since the stability of the crystal form can be improved by forming the two or more kinds of metal phthalocyanine containing said oxotitanium phthalocyanine as the mixed crystals, it is possible to obtain an electrophotographic photoreceptor capable of suppressing the lowering of the responsivity in a case of repetitive use and excellent in the characteristic stability in repetitive use. Further, since the dispersibility can also be improved by forming the two or more kinds of said metal phthalocyanine containing said oxotitanium phthalocyanine as mixed crystals, the aging stability of a coating solution can be improved upon forming the photosensitive layer by coating to improve the quality stability and the productivity of the electrophotographic photoreceptor.

Further, the invention is characterized in that the mixed crystals are mixed crystals of oxotitanium phthalocyanine and chlorogallium phthalocyanine.

In accordance with the invention, the photosensitive layer contains mixed crystals of oxotitanium phthalocyanine and chlorogallium phthalocyanine as the charge generating substance. Since the mixed crystals of oxotitanium phthalocyanine and chlorogallium phthalocyanine show particularly high sensitivity to a light in a long wavelength region such as a near infrared light or red light, it is possible to obtain an electrophotographic photoreceptor having a light sensitive wavelength region suitable to a digital electrophotographic apparatus of using a light in a long wavelength region emitted from a semiconductor laser or a light emission diode for exposure.

Further, the invention is characterized in that the mixed crystals are mixed crystal of oxotitanium phthalocyanine and chloroindium phthalocyanine.

In accordance with the invention, the photosensitive layer contains mixed crystals of oxotitanium phthalocyanine and chloroindium phthalocyanine as the charge generating substance. Since the mixed crystals of oxotitanium phthalocyanine and chloroindium phthalocyanine show particularly high sensitivity to a light in a long wavelength region such as a near infrared light or red light, it is possible to obtain an electrophotographic photoreceptor having a light sensitive wavelength region suitable to a digital electrophotographic apparatus of using a light in a long wavelength region emitted from a semiconductor laser or a light emission diode for exposure.

Further, the invention provides an electrophotographic photoreceptor comprising:

an conductive substrate formed of a conductive material, and a photosensitive layer disposed on the conductive substrate and containing non-metal phthalocyanine and the enamine compound represented by the general formula (1).

In accordance with the invention, the electrophotographic photoreceptor has a conductive substrate and a photosensitive layer in which the photosensitive layer contains non-metal phthalocyanine as a charge generating substance and the enamine compound represented by the general formula (1) as the charge transporting substance. This can provide an electrophotographic photoreceptor showing high responsivity even under a low temperature and low humidity circumstance.

It is considered that the electrophotographic photoreceptor of the invention shows high responsivity even under the low temperature and low humidity circumstance because the combination of said non-metal phthalocyanine contained as charge generating substance and the enamine compound represented by the general formula (1) contained as the charge transporting substance is preferred. That is, since said non-metal phthalocyanine is a charge generating substance having high charge generation performance and high charge injection efficiency, it generates a great amount of charges by absorption of light and efficiently injects the generated charges without accumulating them in the inside to the charge transporting substance. Further, since the enamine compound represented by the general formula (1) is a charge transporting substance having high charge transportability, charges generated in said non-metal phthalocyanine by light absorption are efficiently injected to the enamine compound represented by the general formula (1) and smoothly transported to the surface of the photosensitive layer. Accordingly, an electrophotographic photoreceptor showing high responsivity even under the low temperature and low humidity circumstance can be obtained by incorporation of said non-metal phthalocyanine and the enamine compound represented by the general formula (1) in combination to the photosensitive layer.

As described above, since the electrophotographic photoreceptor according to the invention shows high responsivity even under the low temperature and low humidity circumstance, it can provide images at high quality in various circumstances such as the low temperature and low humidity circumstance even in a case of decreasing the size and being used for a high speed electrophotographic process. That is, in a case of using the electrophotographic photoreceptor of the invention being decreased in the size, since it is not necessary to suppress the electrophotographic processing speed, the image forming speed of the electrophotographic apparatus can be increased. Accordingly, by the use of the electrophotographic photoreceptor according to the invention, decrease of the size and the increase in the image forming speed of the electrophotographic apparatus can be made compatible and it is possible to attain a highly reliable electrophotographic apparatus capable of compatibilizing the decrease of the size and the increase in the image forming speed of the electrophotographic apparatus, decreased in size, having high image forming speed, and capable of providing images at high quality under various circumstances such as the low temperature and low humidity circumstance.

Further, the invention is characterized in that said non-metal phthalocyanine is X-type non-metal phthalocyanine.

In accordance with the invention, the photosensitive layer contains said X-type non-metal phthalocyanine as the charge generating substance. Since said X-type non-metal phthalocyanine has a particularly high sensitivity to a light in a long wavelength region such as a near infrared light or red light, it is possible to obtain an electrophotographic photoreceptor having a light sensitive wavelength region suitable to a digital electrophotographic apparatus of using a light in a long wavelength region emitted from a semiconductor laser or a light emission diode for exposure.

Further, the invention is characterized in that the photosensitive layer further contains metal phthalocyanine.

In accordance with the invention, the photosensitive layer contains non-metal phthalocyanine and metal phthalocyanine as the charge generating substance. Accordingly, since the light sensitive wavelength region of the electrophotographic photoreceptor can be changed easily by changing a ratio between said non-metal phthalocyanine and said metal phthalocyanine, an electrophotographic photoreceptor having a desired light sensitive wavelength region can be obtained easily.

Further, the invention is characterized in that said non-metal phthalocyanine and said metal phthalocyanine constitute mixed crystals of non-metal phthalocyanine and metal phthalocyanine.

In accordance with the invention, the photosensitive layer contains mixed crystals of non-metal phthalocyanine and metal phthalocyanine. Since the stability of the crystal form can be improved by forming said non-metal phthalocyanine and said metal phthalocyanine as the mixed crystals, it is possible to obtain an electrophotographic photoreceptor capable of suppressing the lowering of the responsivity in a case of repetitive use and excellent in the characteristic stability in the repetitive use. Further, since the dispersibility can also be improved by forming said non-metal phthalocyanine and said metal phthalocyanine as mixed crystals, the aging stability of a coating solution can be improved upon forming the photosensitive layer by coating to improve the quality stability and productivity of the electrophotographic photoreceptor.

Further, the invention is characterized in that said metal phthalocyanine is oxotitanium phthalocyanine.

In accordance with the invention, the photosensitive layer contains said non-metal phthalocyanine and said oxotitanium phthalocyanine as the charge generating substance. Since said oxotitanium phthalocyanine has a particularly high sensitivity to a light in a long wavelength region such as a near infrared light or red light, it is possible to obtain an electrophotographic photoreceptor having a light sensitive wavelength region suitable to a digital electrophotographic apparatus of using a light in the long wavelength region emitted from a semiconductor laser or a light emission diode for exposure.

Further, the invention provides an electrophotographic image forming method comprising:

a step of charging the surface of an electrophotographic photoreceptor;

a step of applying exposure to the charged surface to form electrostatic latent images; and a step of developing the electrostatic latent images, wherein the electrophotographic photoreceptor of the invention is used as the electrophotographic photoreceptor.

In accordance with the invention, the electrophotographic images are formed by charging the surface of the electrophotographic photoreceptor of the invention and applying exposure to the surface of the charged electrophotographic photoreceptor to form electrostatic latent images and developing the formed electrostatic latent images. Since the electrophotographic photoreceptor of the invention shows a high responsivity even under the low temperature and low humidity circumstance as described above, images at high quality can be provided under various circumstances such as the low temperature and low humidity circumstance even in a case of shortening the time from the start of exposure to the surface of the electrophotographic photoreceptor till the completion of the development for the electrostatic latent images.

Further, the invention is characterized in that a time from the start of exposure to the surface of the electrophotographic photoreceptor till the completion of the development for the electrostatic latent images is 90 millisecond (msec) or less.

In accordance with the invention, since the time from the start of exposure to the surface of the electrophotographic photoreceptor till the completion of the development for the electrostatic latent images is as short as 90 millisecond (msec) or less, images can be formed at a high speed. In a case where the time from the start of the exposure to the surface of the electrophotographic photoreceptor till the completion of the development for the electrostatic latent images is short, while the responsivity of the electrophotographic photoreceptor is sometimes lowered under the low temperature and low humidity circumstance and the image quality is lowered, since the electrophotographic photoreceptor of the invention showing high responsivity even under the low temperature and low humidity circumstance is used in the electrophotographic image forming method according to the invention, as described above, images at high quality can be provided under various circumstances such as the low temperature and low humidity circumstance even in a case where the time from the start of exposure to the surface of the electrophotographic photoreceptor till the completion of the development for the electrostatic latent images is short.

The invention provides an electrophotographic apparatus comprising:

the electrophotographic photoreceptor according to the invention described above;

charging means for charging a surface of the electrophotographic photoreceptor;

exposure means for applying exposure to the charged surface; and developing means for developing electrostatic latent images formed by exposure.

In accordance with the invention, the electrophotographic apparatus comprises the electrophotographic photoreceptor of the invention, the charging means, the exposure means and the developing means. Since the electrophotographic photoreceptor of the invention shows high responsivity also in a low temperature and low humidity circumstance as described above, the electrophotographic apparatus of the invention can provide images at high quality under various circumstances such as a low temperature and low humidity circumstance also in a case where the time from the start of exposure to the surface of the electrophotographic photoreceptor by the exposure means till the completion of the development for the electrostatic latent images by the developing means is shortened, for example, in a case where the size of the electrophotographic photoreceptor is decreased and the electrophotographic process is conducted at a high speed. Accordingly, it is possible to attain an electrophotographic apparatus of high reliability which is decreased in the size, has a high image forming speed and can provide images at high quality under various circumstances such as a low temperature, low humidity circumstance.

Further, the invention provides an electrophotographic apparatus comprising:

the electrophotographic photoreceptor according to the invention described above which is supported rotatably to an apparatus main body;

photoreceptor driving means for rotationally driving the electrophotographic photoreceptor at a rotational circumferential speed of Vp;

charging means for charging an outer circumferential surface of the electrophotographic photoreceptor;

exposure means for applying exposure to the charged outer circumferential surface;

developing means for developing electrostatic latent images formed by exposure; and control means for controlling an operation of the photoreceptor driving means such that a valued (=L/Vp) obtained by dividing distance L along the outer circumferential surface of the electrophotographic photoreceptor from an exposure position by the exposure means to a developing position by the developing means by the rotational circumferential speed Vp is 90 millisecond (msec) or less.

In accordance with the invention, the electrophotographic apparatus includes the electrophotographic photoreceptor of the invention, the photoreceptor driving means, the charging means, the exposure means, the developing means and the control means. The photoreceptor driving means rotationally drives the electrophotographic photoreceptor at a rotational circumferential speed of Vp. The operation of the photoreceptor driving means is controlled by the control means such that the value d obtained by dividing distance L along the outer circumferential surface of the electrophotographic photoreceptor from the exposure position by the exposure means to the developing position by the developing means by the rotational circumferential speed Vp is 90 msec or less. The value d is substantially equal with the time from the start of the exposure to the outer circumferential surface of the electrophotographic photoreceptor by the exposure means till the time for the completion of the development for the electrostatic latent images by the developing means. Accordingly, the time from the start of the exposure to the outer circumferential surface of the electrophotographic photoreceptor by the exposure means till the completion of the development for the electrostatic latent images by the developing means is short. That is, since the electrophotographic process can be conducted at a high speed in the electrophotographic apparatus according to the invention, it is possible to attain an electrophotographic apparatus of high image forming speed.

In a case where the time from the start of exposure to the outer circumferential surface of the electrophotographic photoreceptor by the exposure means to the completion of the development for the electrostatic latent images by the developing means is short, for example, in a case where the electrophotographic process is conducted at a high speed by increasing the rotational circumferential speed Vp using a small-sized electrophotographic photoreceptor with a short distance L, the responsivity of the electrophotographic photoreceptor is sometimes lowered to deteriorate the image quality under the low temperature and low humidity circumstance.

However, since the electrophotographic apparatus according to the invention includes the electrophotographic photoreceptor of the invention showing high responsivity even under the low temperature and low humidity circumstance as described above, images at high quality can be provided at various circumstances such as a low temperature and low humidity circumstance even in a case where the time from the start of exposure to the outer circumferential surface of the electrophotographic photoreceptor by the exposure means till the completion of the development for the electrostatic latent images by the developing means is short. Accordingly, it is possible to attain an electrophotographic apparatus of high reliability showing a high image forming speed and capable of providing images at high quality under various circumstances such as a low temperature and low humidity circumstance by providing the electrophotographic photoreceptor of the invention as described above and controlling the operation of the photoreceptor driving means such that the value d is 90 msec or less.

Further, the invention is characterized in that the electrophotographic photoreceptor has a cylindrical or circular columnar shape, and a diameter of the electrophotographic photoreceptor is 24 mm or more and 40 mm or less.

In accordance with the invention, since the electrophotographic photoreceptor included in the electrophotographic apparatus has a cylindrical or circular columnar shape and is small in the size with a diameter being 24 mm or more and 40 mm or less, the size of the electrophotographic apparatus can be decreased. Accordingly, it is possible to obtain an electrophotographic apparatus of high reliability decreased in the size, showing a high image forming speed and capable of providing images at high quality under various circumstances such as a low temperature and low humidity circumstance.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1A:
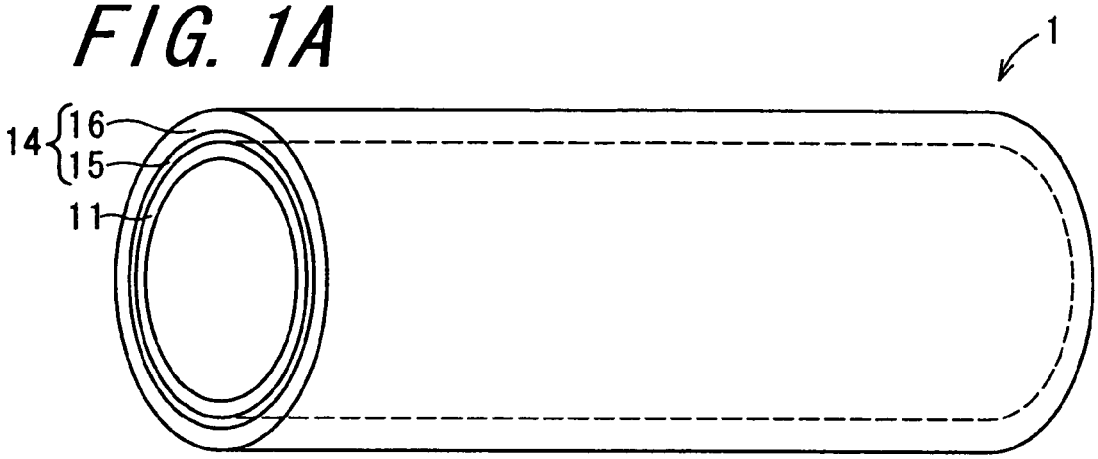
FIG. 1A is a perspective view schematically showing the constitution of an electrophotographic photoreceptor 1 according to a first embodiment of the invention.

Now referring to the drawings, preferred embodiments of the invention are described below.

Figure 1B:
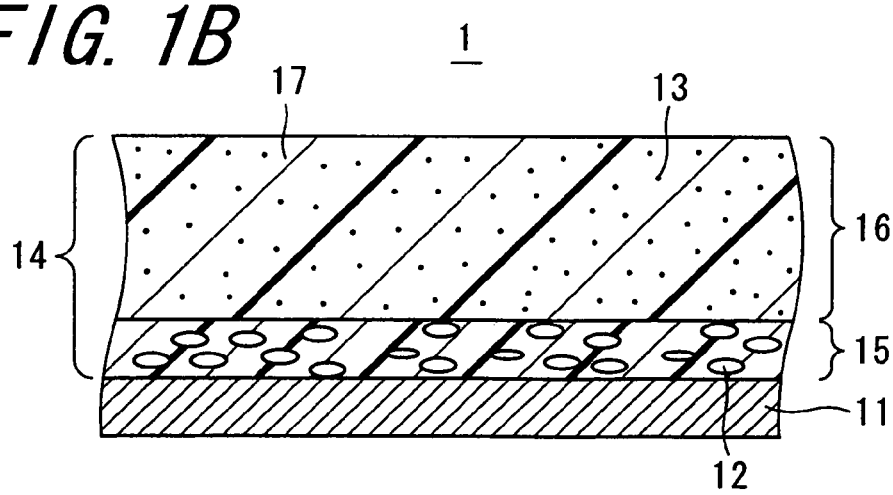
FIG. 1B is a fragmentary cross sectional view schematically showing the constitution of an electrophotographic photoreceptor 1.

FIG. 1A is a perspective view schematically showing the constitution of an electrophotographic photoreceptor 1 according to a first embodiment of the invention. FIG. 1B is a fragmentary cross sectional view schematically showing the constitution of the electrophotographic photoreceptor 1. The electrophotographic photoreceptor 1 (hereinafter also referred to simply as "photoreceptor") includes a cylindrical conductive substrate 11 formed of a conductive material, and a photosensitive layer 14 provided on an outer circumferential surface of the conductive substrate 11. The photosensitive layer 14 is a stacked photosensitive layer formed by stacking a charge generating layer 15 containing a charge generating substance 12 of generating charges by light absorption, and a charge transporting layer 16 containing a charge transporting substance 13 capable of receiving charges generated in the charge generating substance 12 and transporting them and a binder resin 17 for binding the charge transporting substance 13 in this order on the outer circumferential surface of the conductive substrate 11. That is, the photoreceptor 1 is a layered type photoreceptor.

The photosensitive layer 14 contains, as the charge generating substance 12, oxotitanium phthalocyanine having a crystal form showing a diffraction peak at the Bragg angle 2θ (error: 2θ±0.2°) of 27.2° in the X-ray diffraction spectrum and contains, two or more kinds of metal phthalocyanine containing oxotitanium phthalocyanine, or non-metal phthalocyanine, and as the charge transporting substance 13, an enamine compound represented by the following general formula (1).

(1)

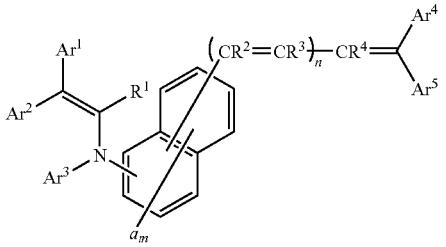

In the general formula (1), $Ar^1$ and $Ar^2$ each represent an aryl group which may have a substituent or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure.

Further, in the general formula (1), "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure.

In the general formula (1), $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$S may be the same or different.

However, in the general formula (1), when n is 0, $Ar^3$ is a heterocyclic group which may have a substituent.

As described above, since the photosensitive layer 14 contains oxotitanium phthalocyanine having a specified crystal form, two or more kinds of metal phthalocyanine containing oxotitanium phthalocyanine, or non-metal phthalocyanine as the charge generating substance 12 and contains the enamine compound represented by the general formula (1) as the charge transporting substance 13, an electrophotographic photoreceptor 1 showing high responsivity even under a low temperature and low humidity circumstance can be obtained.

It is considered that the electrophotographic photoreceptor 1 of this embodiment shows high responsivity even under the low temperature and low humidity circumstance because the combination of said oxotitanium phthalocyanine having the specified crystal form, two or more kinds of metal phthalocyanine containing oxotitanium phthalocyanine, or non-metal phthalocyanine contained as the charge generating substance 12 and the enamine compound represented by the general formula (1) contained as the charge transporting substance 13 is preferred. That is, since said oxotitanium phthalocyanine having the specified crystal form, two more kinds of metal phthalocyanine containing oxotitanium phthalocyanine, or non-metal phthalocyanine are charge generating substance having high charge generation performance and high charge injection efficiency, they generate a great amount of charges by light absorption and inject the generated charges efficiently to the charge transporting substance 13 without accumulating them in the inside. Further, since the enamine compound represented by the general formula (1) is a charge transporting substance having a high charge transportability, charges generated in said oxotitanium phthalocyanine having the specified crystal form, two or more kinds of metal phthalocyanine containing oxotitanium phthalocyanine, or non-metal phthalocyanine by light absorption are efficiently injected to the enamine compound represented by the general formula (1) and transported smoothly to the surface of the photosensitive layer 14. Accordingly, it is possible to obtain an electrophotographic photoreceptor 1 showing high responsivity even under the low temperature and low humidity circumstance by incorporating said oxotitanium phthalocyanine having the specified crystal form, two or more kinds of metal phthalocyanine containing oxotitanium phthalocyanine, or non-metal phthalocyanine, and the enamine compound represented by the general formula (1) in combination in the photosensitive layer 14.

As described above, since the electrophotographic photoreceptor 1 of this embodiment shows high responsivity even under the low temperature and low humidity circumstance, it can provide images at high quality under various circumstances such as the low temperature and low humidity circumstance even in a case where it is decreased in the size and used for a high speed electrophotographic process. That is, in a case of using the photoreceptor 1 while decreasing the size, since it is not necessary to restrict the speed of the electrophotographic process, the image forming speed of the electrophotographic apparatus can be increased. Accordingly, decrease of the size and the increase of the image forming speed of the electrophotographic apparatus can be made compatible by the use of the photoreceptor 1 and it is possible to attain an electrophotographic apparatus of high reliability decreased in the size, showing a high image forming speed, and capable of providing images at high quality under various circumstances such as the low temperature and low humidity circumstance.

In said metal phthalocyanine such as said oxotitanium phthalocyanine and said non-metal phthalocyanine used in this embodiment, hydrogen atoms on the benzene ring contained in the phthalocyanine group may also be substituted with a substituent, for example, a halogen group such as a chloro or fluoro group, nitro group, cyano group or sulfonic acid group. Further, said metal phthalocyanine may have a ligand for the center metal.

Figure 2:
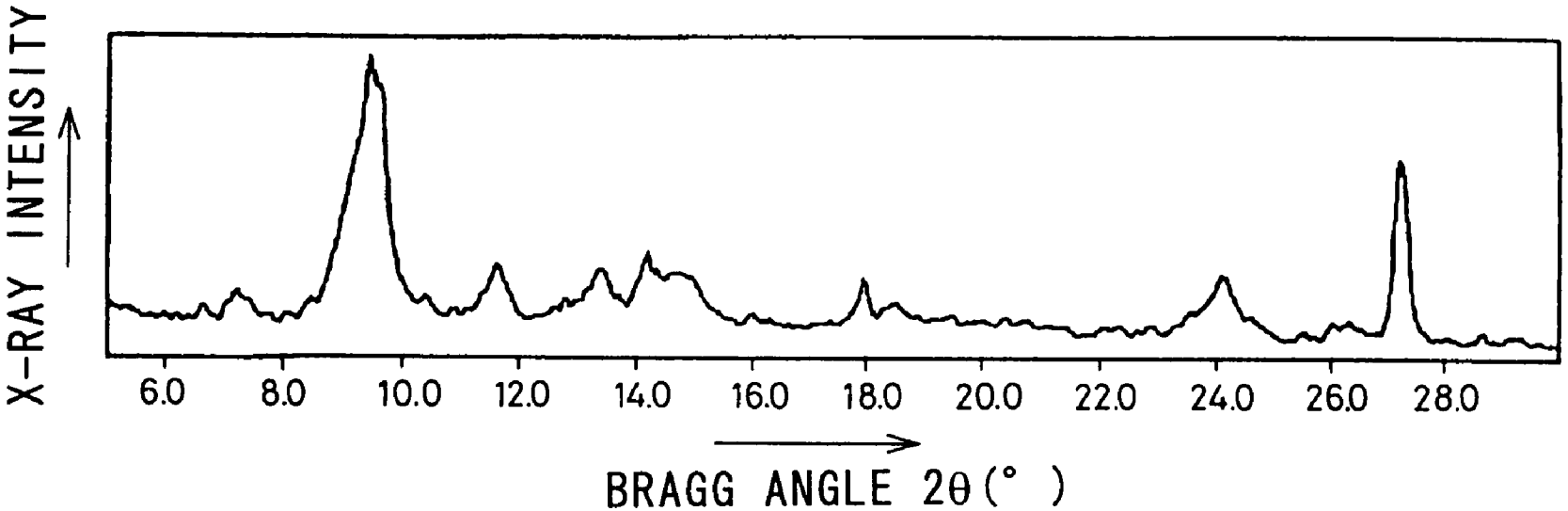
FIG. 2 is an X-ray diffraction spectrum for oxotitanium phthalocyanine according to the invention.
Figure 3:
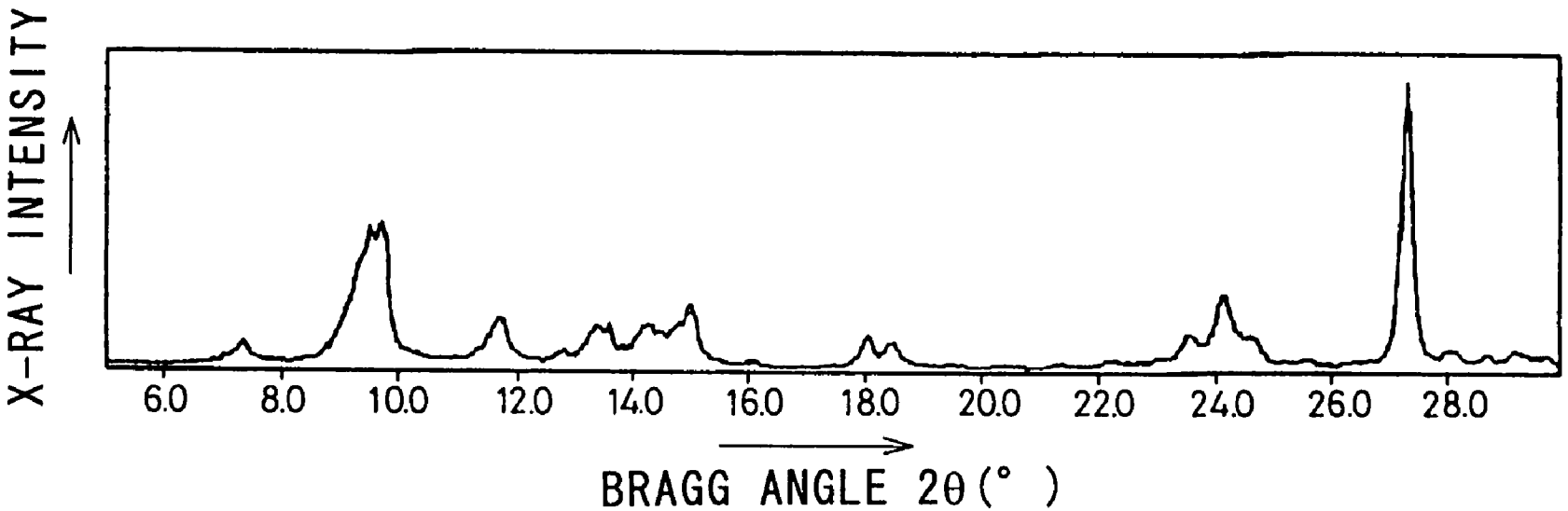
FIG. 3 is an X-ray diffraction spectrum for oxotitanium phthalocyanine according to the invention.
Figure 4:
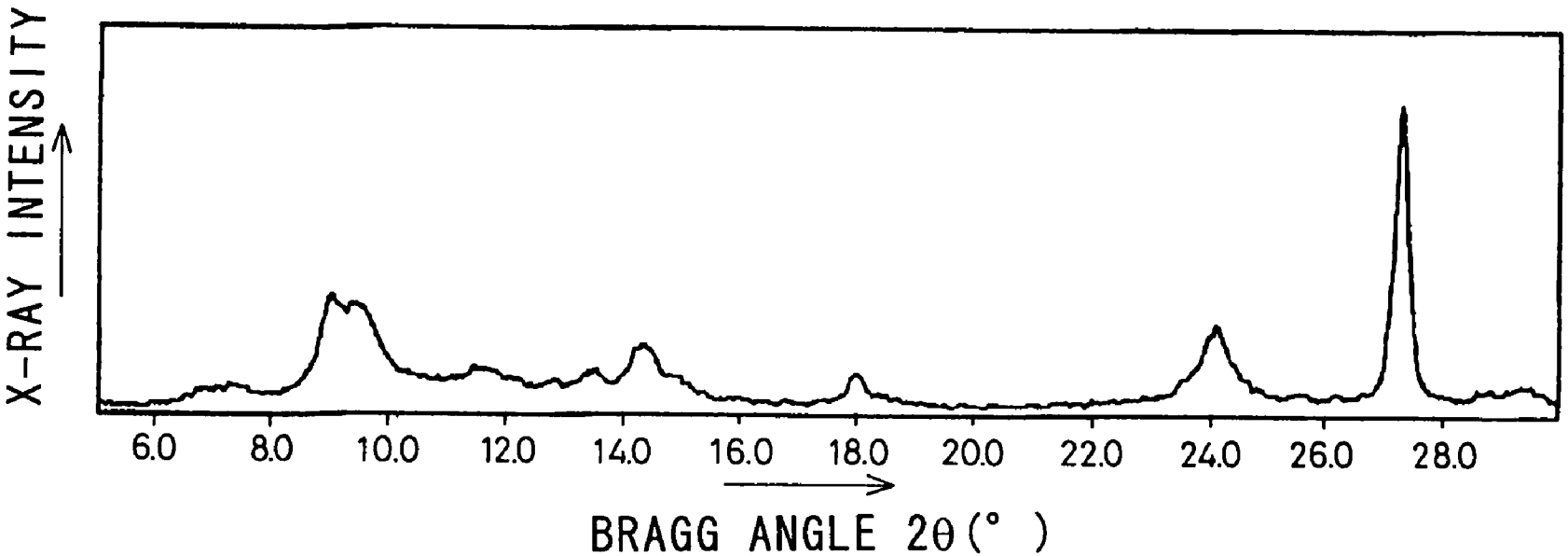
FIG. 4 is an X-ray diffraction spectrum for oxotitanium phthalocyanine according to the invention.

Specific examples of said oxotitanium phthalocyanine having the specified crystal form contained as the charge generating substance 12 in the charge generating layer 15 include, for example, with respect to the X-ray diffraction spectrum, (A-1): oxotitanium phthalocyanine having a crystal form showing main diffraction peaks at the Bragg angles 2θ (error: 2θ±0.2°) of 7.3°, 9.4°, 9.6°, 11.6°, 13.3°, 17.9°, 24.1°, and 27.2°, showing a maximum intensity at a diffraction peak bundle formed by overlap of a diffraction peak at 9.4° and a diffraction peak at 9.6° among the diffraction peaks, and showing the intensity next to the maximum intensity at a diffraction peak of 27.2° as shown in FIG. 2;

(A-2): oxotitanium phthalocyanine having a crystal form showing main diffraction peaks at the Bragg angles 2θ (error: 2θ±0.2°) of 9.5°, 9.7°, 11.7°, 15.0°, 23.5°, 24.1°, and 27.3° as shown in FIG. 3;

(A-3): oxotitanium phthalocyanine having a crystal form showing main diffraction peaks at the Bragg angles 2θ (error: 2θ±0.2°) of 9.0°, 14.2°, 23.9°, and 27.1° as shown in FIG. 4, as well as (A-4): oxotitanium phthalocyanine having crystal form showing the maximum diffraction peak at the Bragg angles 2θ (error: 2θ±0.2°) of 27.3°, and showing diffraction peaks at 7.4°, 9.7°, and 24.2°. In the present specification, the Bragg angle 2θ is an angle formed between the incident X-rays and diffracted X-rays which represents a so-called diffraction angle. Said oxotitanium phthalocyanines described above may be used each one or two or more of them may be used in admixture.

said oxotitanium phthalocyanine having the specified crystal form not only has high charge generation performance and high charge injection efficiency as described above but also shows high sensitivity to the light in the long wavelength region such as a near infrared light or red light. Among said oxotitanium phthalocyanines having the specified crystal form described above, since said oxotitanium phthalocyanine having the crystal form giving the X-ray diffraction spectrum shown in FIG. 2, FIG. 3 or FIG. 4 shows a particularly high sensitivity to a light in a long wavelength region such as a near infrared light or red light, by using said oxotitanium phthalocyanine as the charge generating substance 12, an electrophotographic photoreceptor 1 having a light sensitive wavelength region optimal to the digital electrophotographic apparatus of using the light in the long wavelength region emitted, for example, from a semiconductor laser or light emission diode for exposure can be obtained. Further, since said oxotitanium phthalocyanines described above are stable in the crystal form and less cause transition to other crystal forms, an electrophotographic photoreceptor 1 showing less lowering of the responsivity even in a case of repetitive use and excellent in the stability of the characteristics in repetitive use can be obtained.

Said oxotitanium phthalocyanine having the specified crystal form may also be used in admixture with other charge generating substance. Other charge generating substance used in admixture with said oxotitanium phthalocyanine having the specified crystal form includes, for example, oxotitanium phthalocyanines having crystal forms different from the specified crystal form, other phthalocyanine compounds, as well as bisazo compounds such as chloro diane blue, polynuclear quinone compounds such as dibromoanthanthron, perylene compounds, quinacridone compounds and azulenium salt compounds.

In a case of using two or more kinds of metal phthalocyanine containing oxotitanium phthalocyanine as the charge generating substance 12, said oxotitanium phthalocyanine is preferably crystalline. The crystalline oxotitanium phthalocyanine preferably has a specified crystal form and specific examples thereof include, for example, Y-type oxotitanium phthalocyanines and I-type oxotitanium phthalocyanines. Among said oxotitanium phthalocyanines having the specified crystal forms, particularly preferred are oxotitanium phthalocyanines of (A-1) to (A-4) described above.

Specific examples of metal phthalocyanines used together with oxotitanium phthalocyanine as the charge generating substance 12 include, for example, indium phthalocyanines, gallium phthalocyanines, oxovanadium phthalocyanines, copper phthalocyanines, aluminum phthalocyanines, germanium phthalocyanines, lithium phthalocyanines, sodium phthalocyanines, potassium phthalocyanines, zirconium phthalocyanines, hafnium phthalocyanines, magnesium phthalocyanines, tin phthalocyanines, zinc phthalocyanines, cobalt phthalocyanines, nickel phthalocyanines, barium phthalocyanines, beryllium phthalocyanines, cadmium phthalocyanines, cobalt phthalocyanines, iron phthalocyanines, silicon phthalocyanines, lead phthalocyanines, silver phthalocyanines, gold phthalocyanines, platinum phthalocyanines, ruthenium phthalocyanines, and palladium phthalocyanines.

One or more of metal phthalocyanines selected from said metal phthalocyanines described above are used together with oxotitanium phthalocyanine. Among said metal phthalocyanines, oxovanadium phthalocyanine, chloroaluminum phthalocyanine, chlorogallium phthalocyanine, chloroindium phthalocyanine, chlorogermanium phthalocyanine, hydroxyaluminum phthalocyanine, hydroxygallium phthalocyanine, hydroxyindium phthalocyanine, and dihydroxygermanium phthalocyanine can be used suitably.

As described above, in a case of using two or more kinds of metal phthalocyanine containing oxotitanium phthalocyanine, that is, oxotitanium phthalocyanine and metal phthalocyanine other than said oxotitanium phthalocyanine as the charge generating substance 12, the light sensitive wavelength region of the photoreceptor 1 can be changed easily by changing a ratio between said oxotitanium phthalocyanine and said metal phthalocyanine other than said oxotitanium phthalocyanine. Accordingly, a photoreceptor 1 having a desired light sensitive wavelength region can be obtained easily.

Said oxotitanium phthalocyanine and said metal phthalocyanine other than said oxotitanium phthalocyanine can be used in various forms and, for example, they can be used as:

(I) a mixture in which oxotitanium phthalocyanine and metal phthalocyanine other than said oxotitanium phthalocyanine are merely mixed physically like a mixture of non-metal phthalocyanine and oxotitanium phthalocyanine as described in Japanese Unexamined Patent Publication JP-A 9-73182 (1997), (II) a mixed crystal of oxotitanium phthalocyanine and metal phthalocyanine other than said oxotitanium phthalocyanine like a mixed crystal of a phthalocyanine compound of different central materials as disclosed in Japanese Unexamined Patent Publications JP-A 2-84661 (1990) and JP-A 2-170166 (1990), or (III) a mixed agglomerate of oxotitanium phthalocyanine and metal phthalocyanine other than said oxotitanium phthalocyanine like the mixed coagulate of X-type non-metal phthalocyanine and oxotitanium phthalocyanine as disclosed in Japanese Unexamined Patent Publication JP-A 10-90926 (1998).

In the specification, the mixed crystal means those in which two or more compounds are mixed at a molecular level and the mixed crystal of oxotitanium phthalocyanine and metal phthalocyanine other than said oxotitanium phthalocyanine described above includes both:

(II-a) mixed crystal such as mixed crystal of phthalocyanine comprising oxotitanium phthalocyanine and halogenogallium phthalocyanine or halogenoindium phthalocyanine as disclosed in JP-A 4-372663, and mixed crystal of phthalocyanine comprising oxotitanium phthalocyanine and hydroxy metal phthalocyanine as disclosed in Japanese Unexamined Patent Publication JP-A 4-351673 (1992), and (II-b) composition containing oxotitanium phthalocyanine and metal phthalocyanine other than said oxotitanium phthalocyanine, like phthalocyanine compositions as disclosed in Japanese Unexamined Patent Publications JP-A 2002-23396, JP-A 2002-244321, JP-A 2003-107763, JP-A 2000-313819, JP-A 2-272067 (1990), JP-A 1-142658 (1989), and JP-A 1-142659 (1989).

As described above, while said oxotitanium phthalocyanine and said metal phthalocyanine other than said oxotitanium phthalocyanine can be used in various forms, it is preferably used in the form of the mixed crystal. Since the stability of the crystal form can be improved by using said oxotitanium phthalocyanine and said metal phthalocyanine other than said oxotitanium phthalocyanine in the form of the mixed crystal, it is possible to obtain a photoreceptor 1 capable of suppressing the lowering of responsivity in a case of repetitive use and excellent in the characteristic stability in the repetitive use. Further, since the dispersibility can also be improved, when the photosensitive layer 14 is formed by coating, the aging stability of the coating solution can be improved and the quality stability and the productivity of the photoreceptor 1 can be improved.

Specific examples of the mixed crystal of oxotitanium phthalocyanine and metal phthalocyanine other than said oxotitanium phthalocyanine include, for example, mixed crystal of oxotitanium phthalocyanine and halogenogallium phthalocyanine, and mixed crystal of oxotitanium phthalocyanine and halogenoindium phthalocyanine.

Among the mixed crystals of oxotitanium phthalocyanine and halogenogallium phthalocyanine, preferred include, in view of the X-ray diffraction spectrum, for example, (B-1) those showing the most intense diffraction peak at the Bragg angle 2θ (error: 2θ±0.2°) of 27.2°, (B-2) those showing intense diffraction peaks at the Bragg angles 2θ (error: 2θ±0.2°) of 8.9° and 27.0°, (B-3) those showing intense diffraction peaks at the Bragg angles 2θ (error: 2θ±0.2°) of 9.3°, 10.6°, 13.3°, 15.1°, and 26.3°, (B-4) those showing intense diffraction peaks at the Bragg angles 2θ (error: 2θ±0.2°) of 7.4°, 11.1°, 17.9°, 20.1°, 26.6° and 29.2°, (B-5) those showing intense diffraction peaks at the Bragg angles 2θ (error: 2θ±0.2°) of 7.5°, 16.7°, 22.1°, 24.7°, 25.6°, and 28.6°, and (B-6) those showing intense diffraction peaks at the Bragg angles 2θ (error: 2θ±0.2°) of 7.6°, 16.7°, 22.5°, 24.2°, 25.3°, and 28.6°.

Further, among the mixed crystals of oxotitanium phthalocyanine and halogenoindium phthalocyanine, preferred include, in view of the X-ray diffraction spectrum, for example, (C-1) those showing intense diffraction peaks at the Bragg angles 2θ (error: 2θ±0.2°) of 7.6°, 16.4°, 22.4°, 25.5°, and 28.6°, (C-2) those showing intense diffraction peaks at the Bragg angles 2θ (error: 2θ±0.2°) of 7.6°, 10.6°, 15.2°, 26.3°, and 28.7°, (C-3) those showing intense diffraction peaks at the Bragg angles 2θ (error: 2θ±0.2°) of 7.5°, 11.1°, 18.1°, 20.3°, 26.7°, and 29.2°, (C-4) those showing intense diffraction peaks at the Bragg angles 2θ (error: 2θ±0.2°) of 9.4°, 15.2°, 26.4°, and 27.4°, (C-5) those showing intense diffraction peaks at the Bragg angles 2θ (error: 2θ±0.2°) of 7.4°, 16.6°, 25.3°, and 28.2°, and (C-6) those showing intense diffraction peaks at the Bragg angles 2θ (error: 2θ±0.2°) of 7.3°, 16.7°, 25.3°, and 27.8°.

Among the mixed crystals described above, mixed crystals of oxotitanium phthalocyanine and chlorogallium phthalocyanine or mixed crystals of oxotitanium phthalocyanine and chloroindium phthalocyanine are used suitably. Since the mixed crystals of oxotitanium phthalocyanine and chlorogallium phthalocyanine, and mixed crystals of oxotitanium phthalocyanine and chloroindium phthalocyanine show particularly high sensitivity to a light in a long wavelength region such as a near infrared light or red light, it is possible to obtain a photoreceptor 1 having a light sensitive wavelength region suitable to a digital electrophotographic apparatus of using the light in the long wavelength region emitted from a semiconductor laser or light emission diode for exposure by using the mixed crystals described above as the charge generating substance 12.

In a case of using non-metal phthalocyanine as the charge generating substance 12, said non-metal phthalocyanine is preferably crystalline and the crystalline non-metal phthalocyanine preferably has a specified crystal form and specific examples can include, for example, X-type, α-type, β-type, γ-type, τ-type, π-type, τ'-type, η-type or η'-type non-metal phthalocyanine. Said non-metal phthalocyanines may be used each alone or two or more of them may be used in admixture.

Among said non-metal phthalocyanines described above, X-type non-metal phthalocyanines are used suitably. Since the X-type non-metal phthalocyanines show a particularly high sensitivity to a light in a long wavelength region such as a near infrared light or red light, it is possible to obtain a photoreceptor 1 having a light sensitive wavelength region suitable to a digital electrophotographic apparatus of using the light in the long wavelength region emitted, for example, from a semiconductor laser or light emission diode for exposure by using said X-type non-metal phthalocyanines as the charge generating substance 12.

Among said X-type non-metal phthalocyanines, preferred are those, for example, showing, in view of the X-ray diffraction spectrum, main diffraction peaks at the Bragg angles 2θ (error: 2θ±0.2°) of 7.4°, 9.0°, 16.5°, 17.2°, 22.1°, 23.8°, 27.0°, and 28.4°.

Said non-metal phthalocyanine is preferably used together with said metal phthalocyanine as the charge generating substance 12. In a case of using said non-metal phthalocyanine and said metal phthalocyanine as the charge generating substance 12, the light sensitive wavelength region of the photoreceptor 1 can be changed easily by changing a ratio between said non-metal phthalocyanine and said metal phthalocyanine. Accordingly, a photoreceptor 1 having a desired light sensitive wavelength region can be obtained easily.

Said metal phthalocyanine used together with said non-metal phthalocyanine can include, for example, oxotitanium phthalocyanines and metal phthalocyanines other than said oxotitanium phthalocyanine described above. Among them, oxotitanium phthalocyanine are used suitably. Since said oxotitanium phthalocyanine shows a particularly high sensitivity to a light in a long wavelength region such as a near infrared light and red light, it is possible to obtain a photoreceptor 1 having a light sensitive wavelength region suitable to a digital electrophotographic apparatus of using a light in the long wavelength region emitted, for example, from a semiconductor laser or a light emission diode for exposure by using said non-metal phthalocyanine and said oxotitanium phthalocyanine as the charge generating substance 12.

In a case of using said non-metal phthalocyanine together with said metal phthalocyanine, said non-metal phthalocyanine and said metal phthalocyanine can be used in various forms, like in the case of two or more kinds of metal phthalocyanine containing said oxotitanium phthalocyanine, such as a mixture in which non-metal phthalocyanine and metal phthalocyanine are merely mixed physically, mixed crystals of non-metal phthalocyanine and metal phthalocyanine, or mixed agglomerate of non-metal phthalocyanine and metal phthalocyanine.

Further, the mixed crystal of non-metal phthalocyanine and metal phthalocyanine also includes a crystalline phthalocyanine composition containing non-metal phthalocyanine and oxotitanium phthalocyanine as disclosed in JP-A 2002-244321 and JP-A 2003-107763, a phthalocyanine composition containing non-metal phthalocyanine and oxotitanium phthalocyanine as disclosed in JP-A 2002-23396 and JP-A 2000-313819, an X-type non-metal phthalocyanine composition comprising X-type non-metal phthalocyanine and oxotitanium phthalocyanine as disclosed in JP-A 2-272067, and an α-type titanyl phthalotyanine composition containing non-metal phthalocyanine and α-type titanyl phthalocyanine as disclosed in JP-A 1-142658 and JP-A 1-142659.

As described above, while said non-metal phthalocyanine and said metal phthalocyanine can be used in various forms, they are preferably used in the form of mixed crystals. By using said non-metal phthalocyanine and said metal phthalocyanine in the form of mixed crystals, like in the case of using said oxotitanium phthalocyanine and said metal phthalocyanine other than said oxotitanium phthalocyanine in the form of mixed crystals, it is possible to obtain a photoreceptor 1 capable of suppressing the lowering of the responsivity in the case of repetitive use and excellent in the characteristic stability in the repetitive use. Further, in a case of forming the photosensitive layer 14 by coating, it is possible to improve the aging stability of the coating solution and improve the quality stability and productivity of the photoreceptor 1.

Among the mixed crystals of non-metal phthalocyanine and metal phthalocyanine, mixed crystals of non-metal phthalocyanine and oxotitanium phthalocyanine are used preferably. Among the mixed crystals of non-metal phthalocyanine and oxotitanium phthalocyanine, preferred are:

(D-1) mixed crystal of non-metal phthalocyanine and oxotitanium phthalocyanine showing, in view of the X-ray diffraction spectrum, diffraction peaks at the Bragg angles 2θ (error: 2θ±0.2°) of 7.0°, 9.0°, 14.1°, 18.0°, 23.7°, and 27.3°, as well as (D-2) mixed crystal of X-type non-metal phthalocyanine and oxotitanium phthalocyanine showing, in view of the X-ray diffraction spectrum, intense diffraction peaks at the Bragg angles 2θ (error: 2θ±0.2°) of 7.5°, 9.1°, 16.7°, and 17.3°.

Said metal phthalocyanine and said non-metal phthalocyanine described above can be prepared by the known-preparation methods such as a method as described in "phthalocyanine compounds" by Moser and Thomas. For example, said oxotitanium phthalocyanine can be prepared by heat melting phthalonitrile and titanium tetrachloride, or reacting them under heating in an appropriate solvent to synthesize dichlorotitanium phthalocyanine and then hydrolyzing the same. Further, it can also be prepared by reacting under heating isoindoline and titanium tetraalkoxide in an appropriate solvent.

Said metal phthalocyanine and said non-metal phthalocyanine which have the specified crystal form can be prepared by stirring said metal phthalocyanine or said non-metal phthalocyanine obtained as described above in an appropriate solvent or applying a milling treatment to them.

Said oxotitanium phthalocyanine having a crystal form giving an X-ray diffraction spectrum shown in FIG. 2 can be prepared, for example, by a preparation method described in JP-A 2000-129155. Further, said oxotitanium phthalocyanine having a crystal form giving an X-ray diffraction spectrum shown in FIG. 3 can be prepared, for example, by a preparation method described in JP-B2 2700859. Further, said oxotitanium phthalocyanine having a crystal form giving the X-ray diffraction spectrum shown in FIG. 4 can be prepared, for example, by a preparation method described in JP-A 3-128973. Further, said oxotitanium phthalocyanine having the crystal form showing maximum diffraction peaks at the Bragg angles 2θ (error: 2θ±0.2°) of 27.3°, and showing diffraction peaks at 7.4°, 9.7° and 24.2°, in view of the X-ray diffraction spectrum can be prepared, for example, by the preparation method as disclosed in JP-B2 7-91486. Among said non-metal phthalocyanines, said X-ray non-metal phthalocyanine showing main diffraction peaks at the Bragg angles 2θ (error: 2θ±0.2°) of 7.4°, 9.0°, 16.5°, 17.2°, 22.1°, 23.8°, 27.0°, and 28.4° in view of the X-ray diffraction spectrum can be prepared by the preparation method, for example, disclosed in JP-A 2-233769.

Mixed crystals of said oxotitanium phthalocyanine and metal phthalocyanine other than said oxotitanium phthalocyanine can be prepared, for example, by mixing oxotitanium phthalocyanine and metal phthalocyanine other than said oxotitanium phthalocyanine at an appropriate ratio and forming them into an amorphous state, or forming each of said oxotitanium phthalocyanine and said metal phthalocyanine other than said oxotitanium phthalocyanine into an amorphous state, then mixing them at an appropriate ratio, and then stirring them in an appropriate solvent or applying a milling treatment to them. As a method of forming the amorphous state, a mechanical milling method or an acid pasting method, etc. may be used. The mechanical milling method is a method of pulverizing till a distinct X-ray diffraction peak is no more shown by using a ball mill, automatic mortar or paint conditioner. In the acid pasting method, materials are dissolved in a strong acid such as sulfuric acid, and the resultant solution is poured into a poor solvent such as water to form granules. For example, mixed crystals of oxotitanium phthalocyanine and halogenogallium phthalocyanine or halogenoindium phthalocyanine can be prepared by a preparation method as disclosed, for example, in JP-A 4-372663.

Mixed crystals of said non-metal phthalocyanine and metal phthalocyanine can be prepared by the same method as that for the mixed crystals of oxotitanium phthalocyanine and metal phthalocyanine other than said oxotitanium phthalocyanine. For example, among the mixed crystals of oxotitanium phthalocyanine and non-metal phthalocyanine, those of (D-1) can be prepared by the preparation method as described in JP-A 2000-313819 and those of (D-2) can be prepared by the preparation method as described in JP-A 2-272067.

Further, mixed agglomerates of said oxotitanium phthalocyanine and said metal phthalocyanine other than said oxotitanium phthalocyanine are prepared by a usual wet process, for example, of dissolving oxotitanium phthalocyanine and metal phthalocyanine other than said oxotitanium phthalocyanine, for example, in sulfuric acid and purifying precipitated solids. Further, mixed agglomerates of said non-metal phthalocyanine and said metal phthalocyanine can be prepared in the same manner. For example, mixed agglomerates of X-type non-metal phthalocyanine and oxotitanium phthalocyanine can be prepared, for example, by a preparation method as disclosed in JP-A 10-90926.

Two or more kinds of metal phthalocyanine containing said oxotitanium phthalocyanine as well as said non-metal phthalocyanine described above may be used in admixture with other charge generating substance. Other charge generating substance used in admixture with the two or more kinds of metal phthalocyanine containing said oxotitanium phthalocyanine or said non-metal phthalocyanine can include, for example, bisazo compounds such as chloro diane blue, polynuclear quinone compounds such as dibromoanthanthron, perylene compounds, quinacridone compounds and azulenium salt compounds.

The method of forming the charge generating layer 15 includes a method of vacuum vapor depositing the charge generating substance 12 on the outer circumferential surface of the conductive substrate 11 or a method of mixing and dispersing a charge generating substance 12 in a binder resin solution obtained by dissolving or dispersing a binder resin in an appropriate solvent to prepare a coating solution for charge generating layer and forming a film by coating the outer circumferential surface of the conductive substrate 11 with the coating solution. Among them, the latter method is used preferably. The method is to be described below.

Specific examples of the binder resin used for the charge generating layer 15 can include, for example, those insulative resins such as melamine resin, epoxy resin, silicone resin, polyurethane resin, acryl resin, polycarbonate resin, polyallylate resin, phenoxy resin, and povinyl butyral resin, as well as copolymer resins containing two or more kinds of repetitive units constituting such resins, for example, vinyl chloride-vinyl acetate copolymer resin and acrylonitrile-styrene copolymer resin. The binder resin is not restricted only to them but those resins used generally can be used as the binder resin. The resin may be used each alone or two or more of them may be used in admixture.

The solvent for the coating solution for use in the charge generating layer includes, for example, halogenated hydrocarbons such as methylene chloride, ketones such as acetone, methyl ethyl ketone, and cyclohexane, esters such as ethyl acetate and butyl acetate, ethers such as tetrahydrofuran and dioxane, aromatic hydrocarbons such as benzene, toluene, and xylene, as well as aprotic polar solvents such as N,N-dimethylacetamide. The solvents may be used each alone or two or more of them may be used in admixture.

The blend ratio between the charge generating substance 12 and the binder resin is preferably within a range at a ratio of the charge generating substance 12 of from 10% by weight to 99% by weight. In a case where the ratio of the charge generating substance 12 is less than 10% by weight, the sensitivity is lowered. In a case where the ratio of the charge generating substance 12 exceeds 99% by weight, not only the film strength of the charge generating layer 15 is lowered but also the dispersibility of the charge generating substance 12 is lowered to increase coarse particles, whereby the surface charges at the portion other than the portion to be erased by exposure are decreased to increase image defects, particularly, fogging of images referred to as black spot in which a toner is deposited to white background to form minute black spots. Accordingly, it is defined as from 10% by weight to 99% by weight.

For the method of mixing and dispersing the charge generating substance 12 in the binding resin solution, a general method of using a paint shaker, ball mill, sand mill, attritor, vibration mill, colloid mill, or supersonic dispersing machine can be applied. As the coating method of the coating solution for use in the charge generating layer, a general method of dip coating, spray method, bead method or nozzle method can be adopted.

The thickness of the charge generating layer 15 is, preferably, 0.05 μm or more and 5.0 μm or less and, more preferably, 0.1 μm or more and 1.0 μm or less. In a case where the thickness of the charge generating layer 15 is less than 0.05 μm, the light absorption efficiency is lowered to lower the sensitivity. In a case where the thickness of the charge generating layer 15 exceeds 5 μm, the charge transfer in the charge generating layer constitutes a rate determining step in the process of erasing charges on the surface of the photoreceptor to lower the sensitivity. Accordingly, it is defined as 0.05 μm or more and 5.0 μm or less.

The charge transporting layer 16 formed on the outer circumferential surface of the charge generating layer 15 contains, as described above, an enamine compound represented by the general formula (1) as the charge transporting substance 13.

In the general formula (1), specific examples for the aryl group shown by $Ar^1$, $Ar^2$, $Ar^3$, $Ar^4$, $Ar^5$, a, $R^2$, $R^3$ or $R^4$ include, for example, phenyl, naphthyl, pyrenyl, and anthryl. As the substituent that can be present on the aryl group can include, for example, alkyl groups such as methyl, ethyl, propyl, and trifluoromethyl, alkenyl groups such as 2-propenyl and styryl, alkoxy groups such as methoxy, ethoxy, and propoxy, amino groups such as methylamino and dimethylamino, hanogeno groups such as fluoro, chloro and bromo group, aryl group such as phenyl and naphthyl, aryloxy groups such as phenoxy, and arylthio groups such as thiophenoxy. Specific examples of the aryl group having such substituent can include, for example, tolyl, methoxyphenyl, biphenylyl, terphenyl, phenoxyphenyl, p-(phenylthio)phenyl, or p-styrylphenyl.

In the general formula (1), specific example of the heterocyclic group shown by $Ar^1$, $Ar^2$, $Ar^3$, $Ar^4$, $Ar^5$, $R^2$, $R^3$, or $R^4$ can include, for example, furyl, thienyl, thiazolyl, benzofuryl, benzothiophenyl, benzothiazolyl, and benzooxazolyl. As the substituent that can be present on the heterocyclic group can include the same substituents as the substituent that can be present on the aryl group shown, for example, by $Ar^1$, and specific examples of the heterocyclic group having the substituent can include, for example, N-methylindolyl and N-ethylcarbazolyl.

In the general formula (1), specific examples of aralkyl group shown by $Ar^3$, $Ar^4$, $Ar^5$, $R^2$, $R^3$ or $R^4$ can include, for example, benzyl and 1-naphthylmethyl. The substituents that can be present on the aralkyl group can include, for example, same substituents as the substituents that can be present on the aryl group shown, for example, by $Ar^1$ described above and specific examples of the aralkyl group having the substituent can include, for example, p-methoxybenzyl.

In the general formula (1), the alkyl groups shown by $Ar^3$, $Ar^4$, $Ar^5$, a, $R^1$, $R^2$, $R^3$ or $R^4$ are preferably those having 1 to 6 carbon atoms and specific examples can include, for example, linear alkyl groups such as methyl, ethyl, n-propyl, isopropyl and t-butyl, as well as cycloalkyl groups such as cyclohexyl and cyclopentyl. The substituents that can be present on the alkyl groups can include those substituents identical with the substituents that can be present on the aryl group shown, for example, by $Ar^1$ and specific examples of the alkyl group having the substituent can include, for example, halogenated alkyl groups such as trifluoromethyl and fluoromethyl, alkoxy alkyl group such as 1-methoxyethyl, and alkyl group substituted with a heterocyclic group such as 2-thienylmethyl.

In the general formula (1), the alkoxy group shown by "a" is preferably those of 1 to 4 carbon atoms and, specific examples can include, for example, methoxy, ethoxy, n-propoxy, and isopropoxy. The substituents that can be present on the alkoxy group can include substituents identical with the substituents that can be present on the aryl group shown, for example, by $Ar^1$.

In the general formula (1), the dialkyl amino group shown by "a" is preferably an amino group substituted with an alkyl group of 1 to 4 carbon atoms and specific examples can include, for example, dimethylamino, diethylamino, and diisopropylamino. As the substituents present on the dialkylamino group can include substituents identical with the substituents that can be present on the aryl group shown, for example, by $Ar^1$.

In the general formula (1), specific examples of the halogen atom shown by "a" or $R^1$ can include, for example, a fluorine atom and a chlorine atom.

In the general formula (1), specific examples of atoms bonding $Ar^4$ and $Ar^5$ can include, for example, an oxygen atom, sulfur atom, and nitrogen atom. The nitrogen atom can bond $Ar^4$ and $Ar^5$ as a bivalent group such as an imino group or an N-alkylimino group. Specific examples of the atom group bonding $Ar^4$ and $Ar^5$ can include, for example, bivalent groups, for example, alkylene groups such as methylene, ethylene, and methylmethylene, alkenylene groups such as vinylene and propenylene, alkylene groups containing hetero atoms such as oxymethylene (chemical formula: —O—$CH_2$—), as well as alkenylene groups containing hetero atoms such as thiovinylene (chemical formula: —S—CH═CH—).

For the charge transporting substance 13, among enamine compounds represented by the general formula (1), an enamine compound represented by the following general formula (2) is preferably used.

(2)

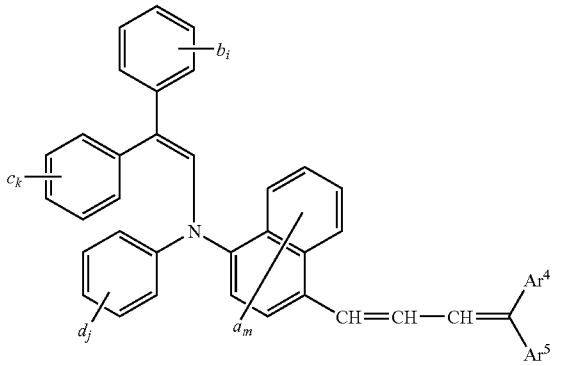

In the general formula (2), "b", "c" and "d" each represent an alkyl group which may have a substituent, an alkoxy group which may have a substituent a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure.

Specific examples for b, c, and d can include, other thanhydrogenatom, alkylgroupssuchasmethyl, ethyl, n-propyl, isopropyl, trifuoromethyl, fluoromethyl, and 1-methoxyethyl, alkoxy group such as methoxy, ethoxy, n-propoxy, and isopropoxy, dialkylamino groups such as dimethylamino, diethylamino and diisoporpylamino, aryl groups such as phenyl, tolyl, methoxyphenyl, and naphthyl, as well as halogen atoms such as fluorine atom and chlorine atom.

In formula (2), $Ar^4$, $Ar^5$, "a" and "m" represent the same as those defined in formula (1).

Since the enamine compound represented by the general formula (2) has particularly high charge transportability among the compounds represented by the general formula (1), an electrophotographic photoreceptor 1 showing higher responsivity can be obtained by using the enamine compound represented by the general formula (2) for the charge transporting substance 13. The image forming speed of the electrophotographic apparatus can be further increased by using the electrophotographic photoreceptor 1 described above. Further, since the enamine compound represented by the general formula (2), among the enamine compounds represented by the general formula (1) can be synthesized relatively easily and can be manufactured at a high yield and at a reduced cost, the electrophotographic photoreceptor 1 showing high responsivity as described above can be prepared at a reduced manufacturing cost.

Among the enamine compounds represented by the general formula (1), particularly excellent compounds in view of the characteristics, cost and the productivity can include those in which $Ar^1$ and $Ar^2$ are phenyl groups. Among them, those are particularly preferable in which $Ar^1$ and $Ar^2$ are phenyl groups, $Ar^3$ is a phenyl group, a tolyl group, a p-methoxyphenyl group, a biphenylyl group, a naphthyl group or a thienyl group, at least one of $Ar^4$ and $Ar^5$ is a phenyl group, a p-tolyl group, a p-methoxyphenyl group, a naphthyl group, a thienyl group or a thiazolyl group, $R^1$, $R^2$, $R^3$ and $R^4$ are each hydrogen atom, and n is 1.

Specific examples of the enamine compound represented by the general formula (1), while exemplified compounds shown in the following Table 1 to Table 32 can be mentioned, the enamine compounds shown by the general formula (1) are not restricted to them. In Table 1 to Table 32, each of the exemplified compounds is expressed by the group corresponding to each group in the general formula (1). For example, Exemplified compound No. 1 shown in Table 1 is an enamine compound represented by the following structural formula (1-1). However, Table 1 to Table 32, in a case of exemplifying those in which $Ar^4$ and $Ar^5$ are bonded to each other to form a cyclic structure, carbon-carbon double bond to which $Ar^4$ and $Ar^5$ are bonded and carbon atoms of the carbon-carbon double bond, as well as the cyclic structure formed with $Ar^4$ and $Ar^5$ are shown together from the column for $Ar^4$ to the column for $Ar^5$.

(1-1)

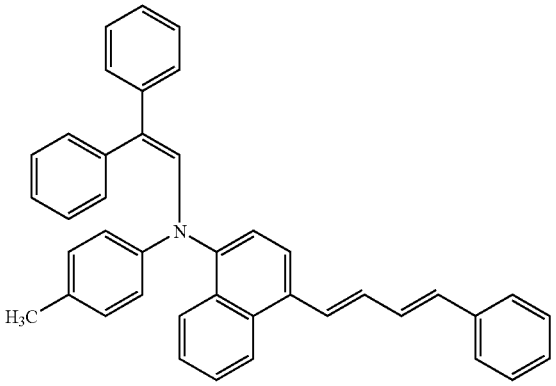

TABLE 1

| Compound No. | $Ar^1$ | $Ar^2$ | $R^1$ | $Ar^3$ | 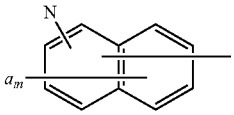 |
|---|---|---|---|---|---|
| 1 | 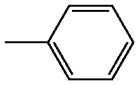 | 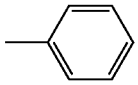 | H | 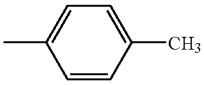 | 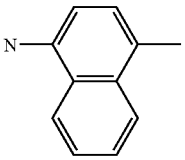 |
| 2 | 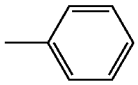 | 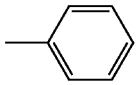 | H | 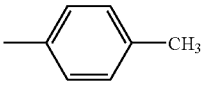 | 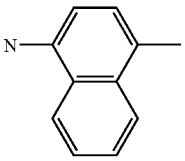 |
| 3 | 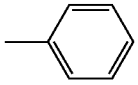 | 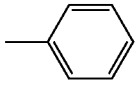 | H | 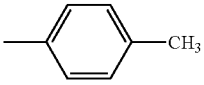 | 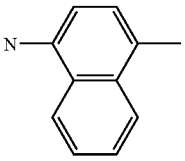 |

TABLE 1-continued
| | | | | |
|---|---|---|---|---|
| 4 | 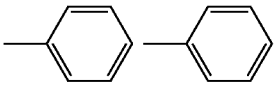 | H | 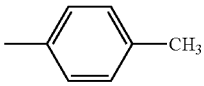 | 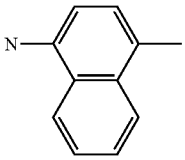 |
| 5 | 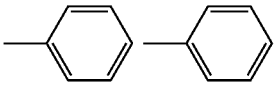 | H | 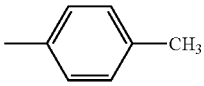 | 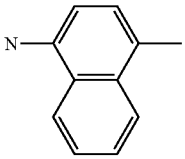 |
| 6 | 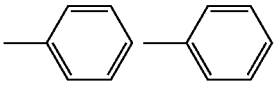 | H | 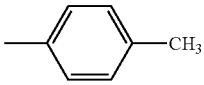 | 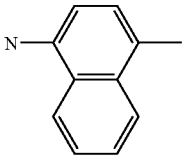 |
| 7 | 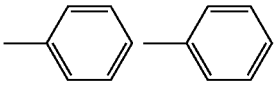 | H | 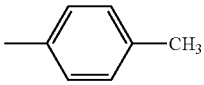 | 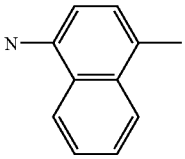 |
| Compound No. | n | $-(CR^2=CR^3)_n-$ | $R^4$ | $Ar^4$ | $Ar^5$ |
|---|---|---|---|---|---|
| 1 | 1 | CH=CH | H | H | 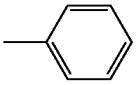 |
| 2 | 1 | CH=CH | H | H | 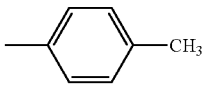 |
| 3 | 1 | CH=CH | H | $-CH_3$ | 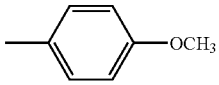 |
| 4 | 1 | CH=CH | H | H | 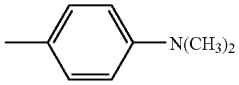 |
| 5 | 1 | CH=CH | H | H | 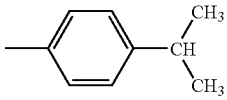 |
| 6 | 1 | CH=CH | H | H | 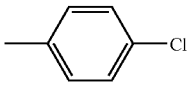 |
| 7 | 1 | CH=CH | H | $-CH_3$ | 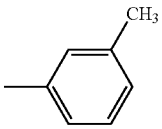 |

TABLE 2
| Compound No. | $Ar^1$ | $Ar^2$ | $R^1$ | $Ar^3$ | 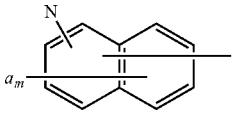 |
|---|---|---|---|---|---|
| 8 | 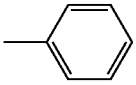 | 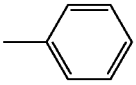 | H | 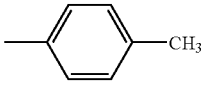 | 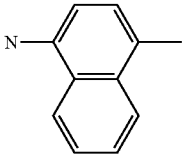 |
| 9 | 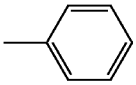 | 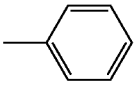 | H | 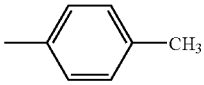 | 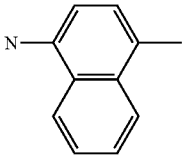 |
| 10 | 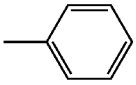 | 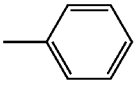 | H | 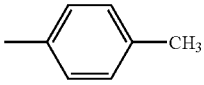 | 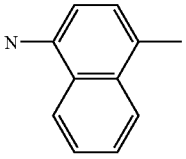 |
| 11 | 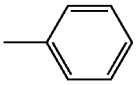 | 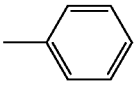 | H | 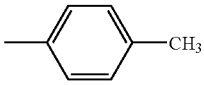 | 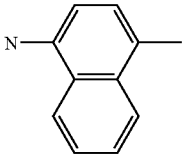 |
| 12 | 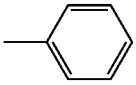 | 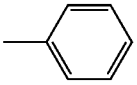 | H | 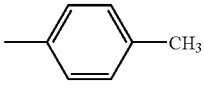 | 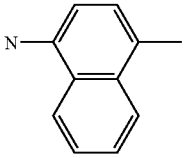 |
| 13 | 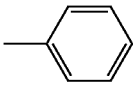 | 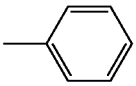 | H | 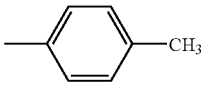 | 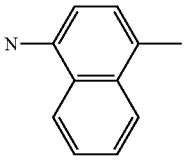 |
| 14 | 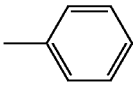 | 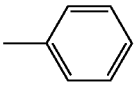 | H | 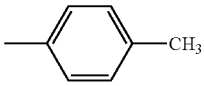 | 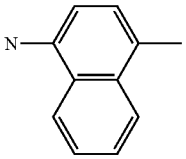 |
| Compound No. | n | $-(CR^2=CR^3)_n-$ | $R^4$ | $Ar^4$ | $Ar^5$ |
|---|---|---|---|---|---|
| 8 | 1 | CH=CH | H | H | 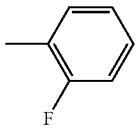 |

TABLE 2-continued
| | | | | | |
|---|---|---|---|---|---|
| 9 | 1 | CH═CH | H | —$CH_3$ | 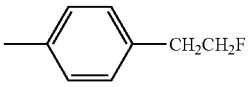 |
| 10 | 1 | CH═CH | H | —$CH_3$ | 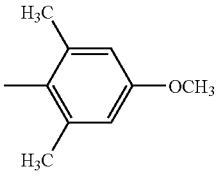 |
| 11 | 1 | CH═CH | H | H | 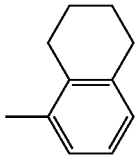 |
| 12 | 1 | CH═CH | H | H | 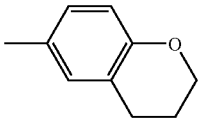 |
| 13 | 1 | CH═CH | H | H | 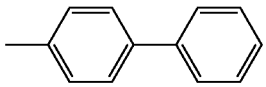 |
| 14 | 1 | CH═CH | H | H | 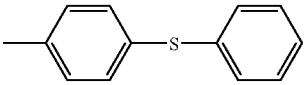 |
TABLE 3
| Compound No. | $Ar^1$ | $Ar^2$ | $R^1$ | $Ar^3$ | 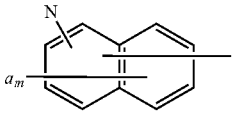 | n |
|---|---|---|---|---|---|---|
| 15 | 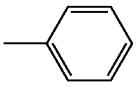 | 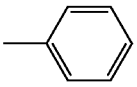 | H | 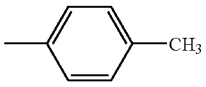 | 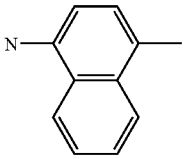 | 1 |
| 16 | 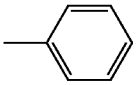 | 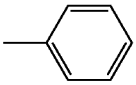 | H | 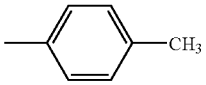 | 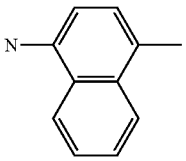 | 1 |
| 17 | 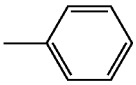 | 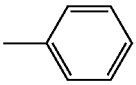 | H | 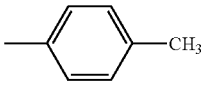 | 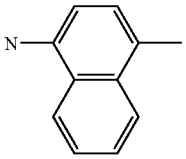 | 1 |

TABLE 3-continued
| | | | | | |
|---|---|---|---|---|---|
| 18 | 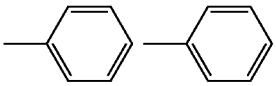 | H | 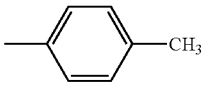 | 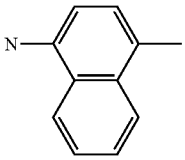 | 1 |
| 19 | 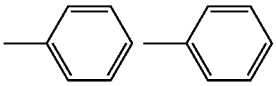 | H | 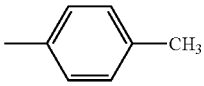 | 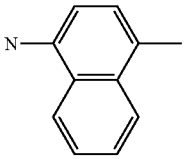 | 1 |
| 20 | 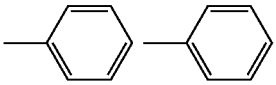 | H | 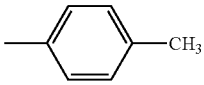 | 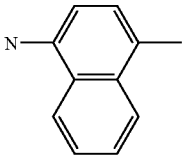 | 1 |
| 21 | 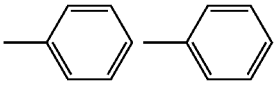 | H | 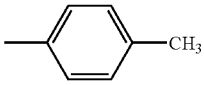 | 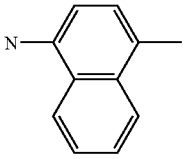 | 1 |
| Compound No. | $-(CR^2=CR^3)_n-$ | $R^4$ | $Ar^4$ | $Ar^5$ |
|---|---|---|---|---|
| 15 | CH=CH | H | H | 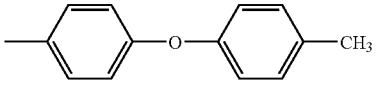 |
| 16 | CH=CH | H | $-CH_3$ | 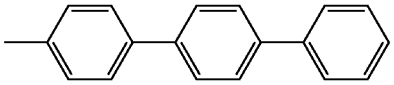 |
| 17 | CH=CH | H | H | 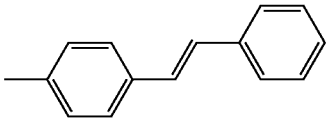 |
| 18 | CH=CH | H | $-CH_3$ | 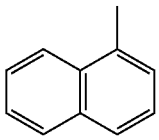 |
| 19 | CH=CH | H | H | 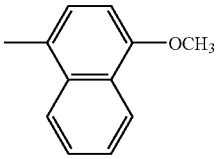 |
| 20 | CH=CH | H | H | 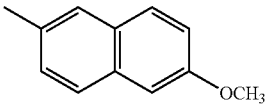 |

TABLE 3-continued
| | | | | |
|---|---|---|---|---|
| 21 | CH═CH | H | H | 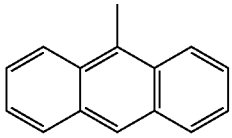 |
TABLE 4
| Compound No. | $Ar^1$ | $Ar^2$ | $R^1$ | $Ar^3$ | 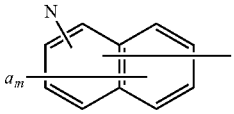 |
|---|---|---|---|---|---|
| 22 | 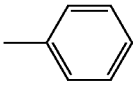 | 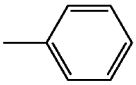 | H | 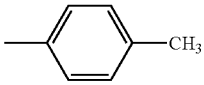 | 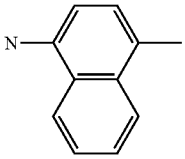 |
| 23 | 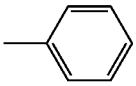 | 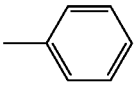 | H | 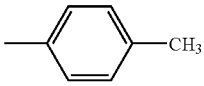 | 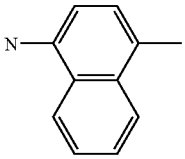 |
| 24 | 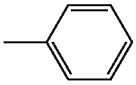 | 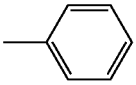 | H | 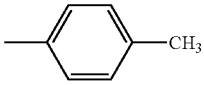 | 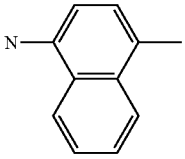 |
| 25 | 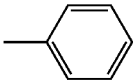 | 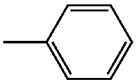 | H | 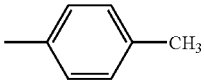 | 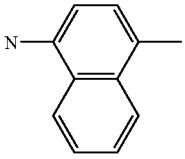 |
| 26 | 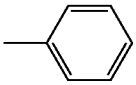 | 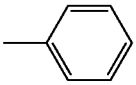 | H | 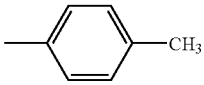 | 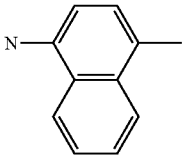 |
| 27 | 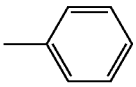 | 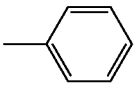 | H | 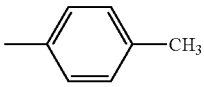 | 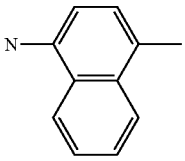 |

TABLE 4-continued
| | | | | | |
|---|---|---|---|---|---|
| 28 | 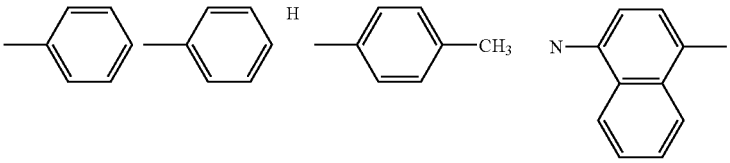 | | H | | |
| Compound No. | n | $-(CR^2=CR^3)_n-$ | $R^4$ | $Ar^4$ | $Ar^5$ |
|---|---|---|---|---|---|
| 22 | 1 | CH=CH | H | H | 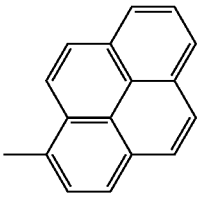 |
| 23 | 1 | CH=CH | H | $-CH_3$ | 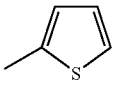 |
| 24 | 1 | CH=CH | H | $-CH_3$ | 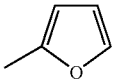 |
| 25 | 1 | CH=CH | H | H | 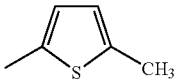 |
| 26 | 1 | CH=CH | H | H | 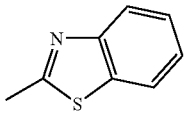 |
| 27 | 1 | CH=CH | H | H | 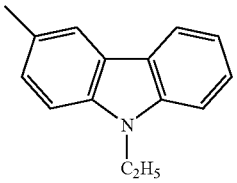 |
| 28 | 1 | CH=CH | H | 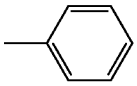 | 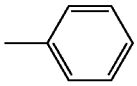 |
TABLE 5
| Compound No. | $Ar^1$ | $Ar^2$ | $R^1$ | $Ar^3$ | 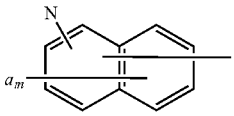 | n |
|---|---|---|---|---|---|---|
| 29 | 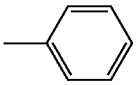 | 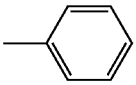 | H | 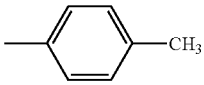 | 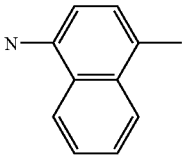 | 1 |

TABLE 5-continued

| | | | | | |
|---|---|---|---|---|---|
| 30 | | H | $CH_3$ | N | 1 |
| 31 | | H | $CH_3$ | N | 1 |
| 32 | | H | $CH_3$ | N | 1 |
| 33 | | H | $CH_3$ | N | 1 |
| 34 | | H | $CH_3$ | N | 1 |
| 35 | | H | $CH_3$ | N | 1 |

| Compound No. | $-(CR^2=CR^3)_n-$ | $R^4$ | $Ar^4$ | $Ar^5$ |
|---|---|---|---|---|
| 29 | CH═CH | H | $CH_3$ | $CH_3$ |
| 30 | CH═CH | H | $OCH_3$ | $OCH_3$ |
| 31 | CH═CH | H | $N(CH_3)_2$ | $N(CH_3)_2$ |
| 32 | CH═CH | H | | |

TABLE 5-continued
| | | | | |
|---|---|---|---|---|
| 33 | CH═CH | H | 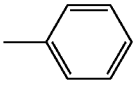 | 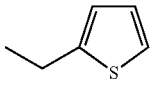 |
| 34 | CH═CH | H | 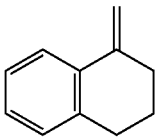 | |
| 35 | CH═CH | H | 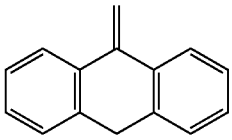 | |
TABLE 6
| Compound No. | $Ar^1$ | $Ar^2$ | $R^1$ | $Ar^3$ | 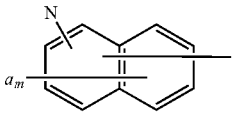 |
|---|---|---|---|---|---|
| 36 | 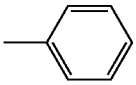 | 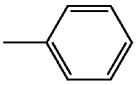 | H | 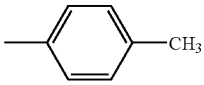 | 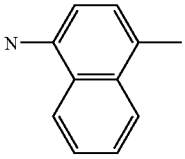 |
| 37 | 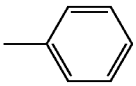 | 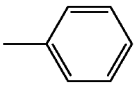 | H | 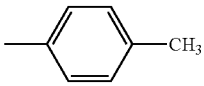 | 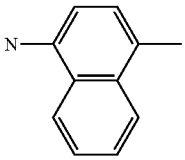 |
| 38 | 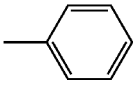 | 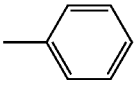 | H | 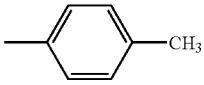 | 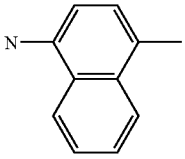 |
| 39 | 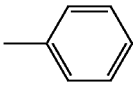 | 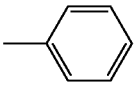 | H | 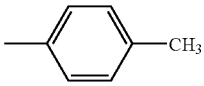 | 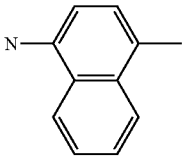 |
| 40 | 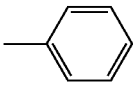 | 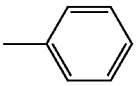 | H | 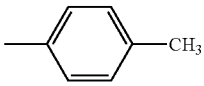 | 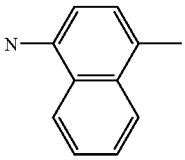 |

TABLE 6-continued
| | | | | |
|---|---|---|---|---|
| 41 | 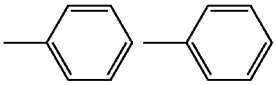 | H | 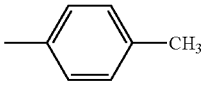 | 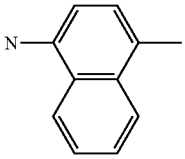 |
| 42 | 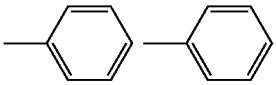 | H | 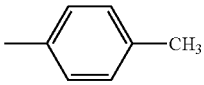 | 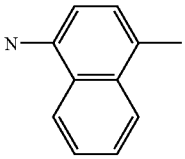 |
| Compound No. | n | $-(CR^2=CR^3)_n-$ | $R^4$ | $Ar^4$ | $Ar^5$ |
|---|---|---|---|---|---|
| 36 | 1 | CH=CH | H | 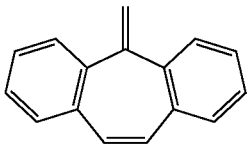 | |
| 37 | 1 | CH=CH | H | 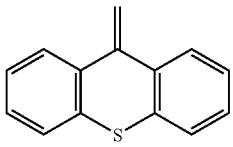 | |
| 38 | 1 | CH=CH | H | 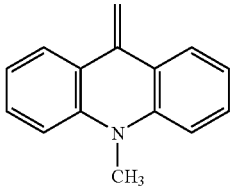 | |
| 39 | 1 | CH=CH | $-CH_3$ | H | 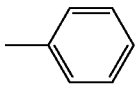 |
| 40 | 1 | CH=CH | 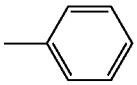 | H | 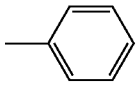 |
| 41 | 1 | 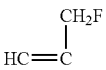 | H | H | 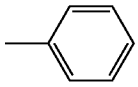 |
| 42 | 1 | 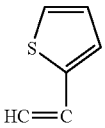 | H | H | 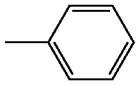 |

TABLE 7
| Compound No. | $Ar^1$ | $Ar^2$ | $R^1$ | $Ar^3$ | 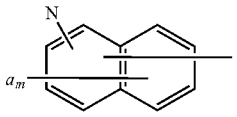 | n |
|---|---|---|---|---|---|---|
| 43 | 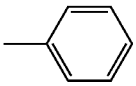 | 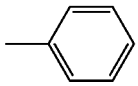 | H | 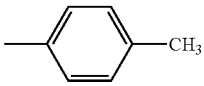 | 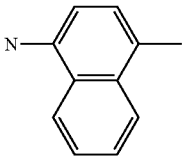 | 1 |
| 44 | 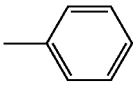 | 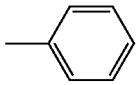 | H | 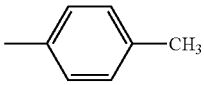 | 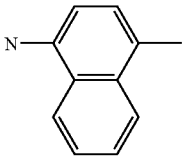 | 1 |
| 45 | 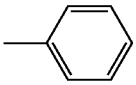 | 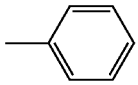 | H | 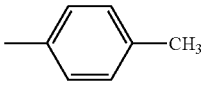 | 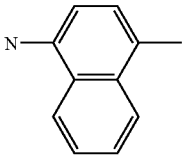 | 1 |
| 46 | 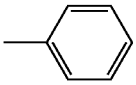 | 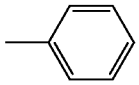 | H | 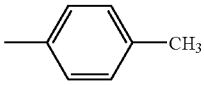 | 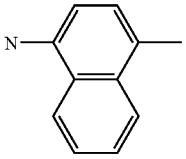 | 2 |
| 47 | 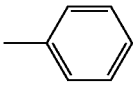 | 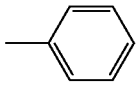 | H | 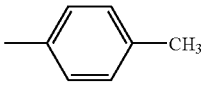 | 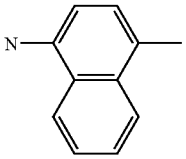 | 2 |
| 48 | 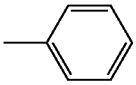 | 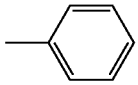 | H | 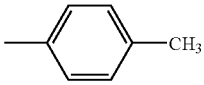 | 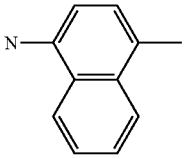 | 2 |
| 49 | 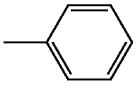 | 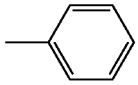 | H | 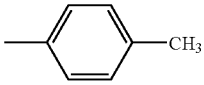 | 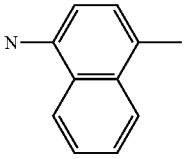 | 2 |
| Compound No. | $-(CR^2{=}CR^3)_n-$ | $R^4$ | $Ar^4$ | $Ar^5$ |
|---|---|---|---|---|
| 43 | 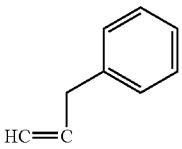 | H | H | 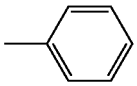 |

TABLE 7-continued

| | | | | |
|---|---|---|---|---|
| 44 | $CH_3$ C═CH | H | H | |
| 45 | $CH_3$ HC═C | | H | |
| 46 | CH═CH—CH═CH | H | H | |
| 47 | CH═CH—CH═CH | H | H | $OCH_3$ |
| 48 | CH═CH—CH═CH | H | —$CH_3$ | $OCH_3$ |
| 49 | CH═CH—CH═CH | H | —$CH_3$ | O |

TABLE 8

| Compound No. | $Ar^1$ | $Ar^2$ | $R^1$ | $Ar^3$ | N $a_m$ | n |
|---|---|---|---|---|---|---|
| 50 | | | H | $CH_3$ | N | 2 |
| 51 | | | H | $CH_3$ | N | 2 |
| 52 | | | H | $CH_3$ | N | 2 |
| 53 | | | H | $CH_3$ | N | 2 |

TABLE 8-continued
| | | | | | |
|---|---|---|---|---|---|
| 54 | 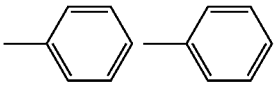 | H | 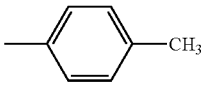 | 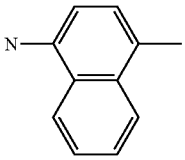 | 3 |
| 55 | 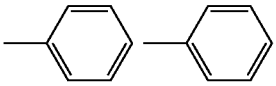 | H | 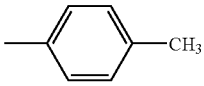 | 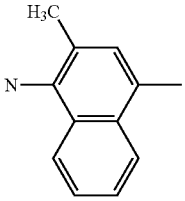 | 1 |
| 56 | 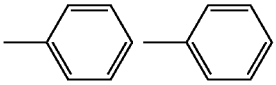 | H | 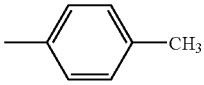 | 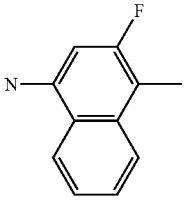 | 1 |
| Compound No. | $-(CR^2{=}CR^3)_n-$ | $R^4$ | $Ar^4$ | $Ar^4$ |
|---|---|---|---|---|
| 50 | CH═CH—CH═CH | H | —$CH_3$ | 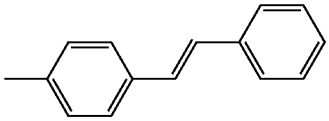 |
| 51 | CH═CH—CH═CH | H | —$CH_3$ | 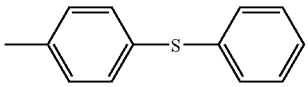 |
| 52 | 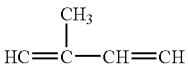 | H | H | 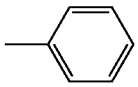 |
| 53 | 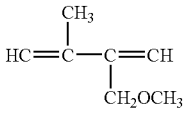 | H | H | 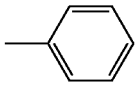 |
| 54 | $-(HC{=}CH)_3-$ | H | H | 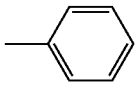 |
| 55 | CH═CH | H | H | 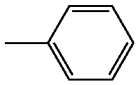 |
| 56 | CH═CH | H | H | 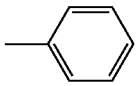 |

TABLE 9

| Compound No. | $Ar^1$ | $Ar^2$ | $R^1$ | $Ar^3$ | N, $a_m$ |
|---|---|---|---|---|---|
| 57 | | | H | $CH_3$ | N, $OCH_3$ |
| 58 | | | H | $CH_3$ | N |
| 59 | | | H | $CH_3$ | N |
| 60 | | | H | $CH_3$ | N |
| 61 | | | H | $OCH_3$ | N |
| 62 | | | H | $OCH_3$ | N |
| 63 | | | H | $OCH_3$ | N |

| Compound No. | n | $-(CR^2{=}CR^3)_n-$ | $R^4$ | $Ar^4$ | $Ar^5$ |
|---|---|---|---|---|---|
| 57 | 1 | CH═CH | H | H | |
| 58 | 1 | CH═CH | H | H | |

TABLE 9-continued

| | | | | | |
|---|---|---|---|---|---|
| 59 | 1 | CH═CH | H | H | |
| 60 | 1 | CH═CH | H | H | |
| 61 | 1 | CH═CH | H | H | |
| 62 | 1 | CH═CH | H | H | $CH_3$ |
| 63 | 1 | CH═CH | H | $—CH_3$ | $OCH_3$ |

TABLE 10

| Compound No. | $Ar^1$ | $Ar^2$ | $R^1$ | $Ar^3$ | N, $a_m$ |
|---|---|---|---|---|---|
| 64 | | | H | $OCH_3$ | N |
| 65 | | | H | $OCH_3$ | N |
| 66 | | | H | $OCH_3$ | N |
| 67 | | | H | $OCH_3$ | N |
| 68 | | | H | $OCH_3$ | N |

TABLE 10-continued

| | | | | |
|---|---|---|---|---|
| 69 | | H | $OCH_3$ | N |
| 70 | | H | $OCH_3$ | N |

| Compound No. | n | $-(CR^2=CR^3)_n-$ | $R^4$ | $Ar^4$ | $Ar^5$ |
|---|---|---|---|---|---|
| 64 | 1 | CH=CH | H | H | $N(CH_3)_2$ |
| 65 | 1 | CH=CH | H | H | $CH_3$, CH, $CH_3$ |
| 66 | 1 | CH=CH | H | $-CH_3$ | $CH_3$, $CH_3$ |
| 67 | 1 | CH=CH | H | H | $CH_3$ |
| 68 | 1 | CH=CH | H | H | F |
| 69 | 1 | CH=CH | H | H | $CH_2CH_2F$ |
| 70 | 1 | CH=CH | H | H | $H_3C$, $OCH_3$, $H_3C$ |

TABLE 11
| Compound No. | $Ar^1$ | $Ar^2$ | $R^1$ | $Ar^3$ | 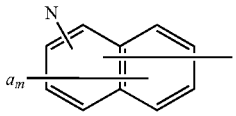 | n |
|---|---|---|---|---|---|---|
| 71 | 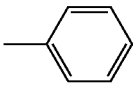 | 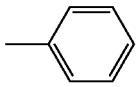 | H | 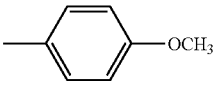 | 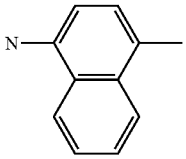 | 1 |
| 72 | 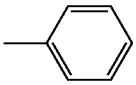 | 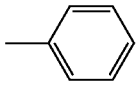 | H | 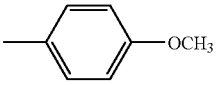 | 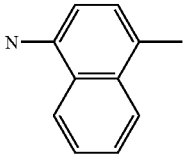 | 1 |
| 73 | 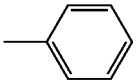 | 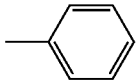 | H | 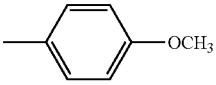 | 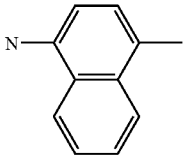 | 1 |
| 74 | 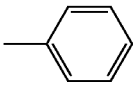 | 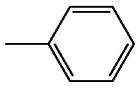 | H | 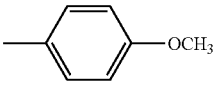 | 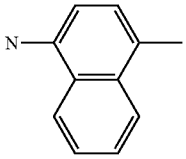 | 1 |
| 75 | 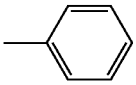 | 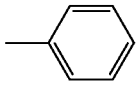 | H | 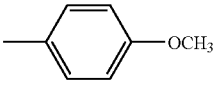 | 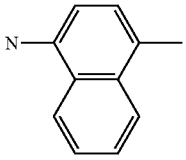 | 1 |
| 76 | 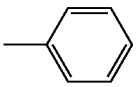 | 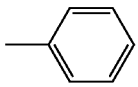 | H | 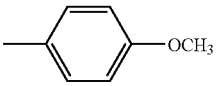 | 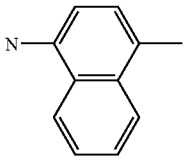 | 1 |
| 77 | 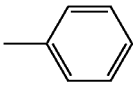 | 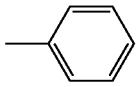 | H | 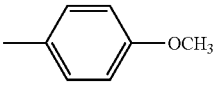 | 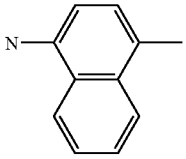 | 1 |
| Compound No. | $-(CR^2=CR^3)_n-$ | $R^4$ | $Ar^4$ | $Ar^5$ |
|---|---|---|---|---|
| 71 | CH═CH | H | H | 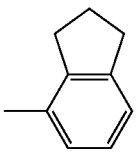 |

TABLE 11-continued
| | | | | |
|---|---|---|---|---|
| 72 | CH═CH | H | H | 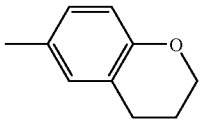 |
| 73 | CH═CH | H | H | 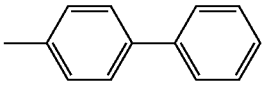 |
| 74 | CH═CH | H | H | 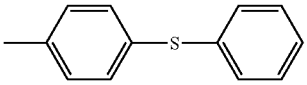 |
| 75 | CH═CH | H | H | 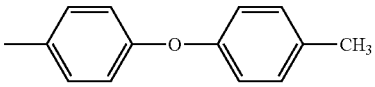 |
| 76 | CH═CH | H | H | 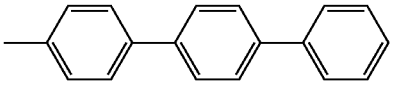 |
| 77 | CH═CH | H | H | 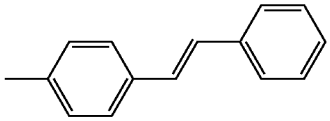 |
TABLE 12
| Compound No. | $Ar^1$ | $Ar^2$ | $R^1$ | $Ar^3$ | 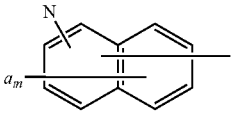 |
|---|---|---|---|---|---|
| 78 | 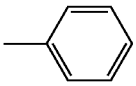 | 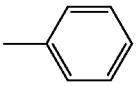 | H | 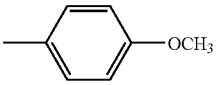 | 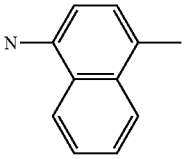 |
| 79 | 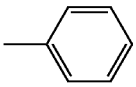 | 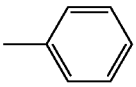 | H | 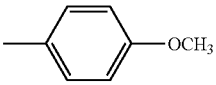 | 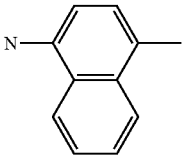 |
| 80 | 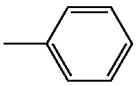 | 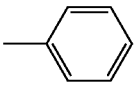 | H | 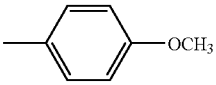 | 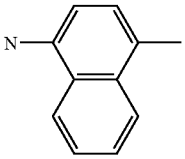 |
| 81 | 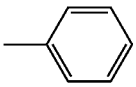 | 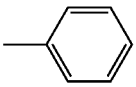 | H | 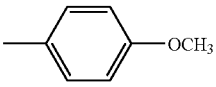 | 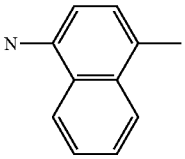 |

TABLE 12-continued

| | | | | |
|---|---|---|---|---|
| 82 | | H | $OCH_3$ | N |
| 83 | | H | $OCH_3$ | N |
| 84 | | H | $OCH_3$ | N |

| Compound No. | n | $-(CR^2=CR^3)_n-$ | $R^4$ | $Ar^4$ | $Ar^5$ |
|---|---|---|---|---|---|
| 78 | 1 | CH=CH | H | H | |
| 79 | 1 | CH=CH | H | H | $CH_3$ |
| 80 | 1 | CH=CH | H | H | $OCH_3$ |
| 81 | 1 | CH=CH | H | H | |
| 82 | 1 | CH=CH | H | H | |
| 83 | 1 | CH=CH | H | H | S |
| 84 | 1 | CH=CH | H | H | O |

TABLE 13
| Compound No. | $Ar^1$ | $Ar^2$ | $R^1$ | $Ar^3$ | 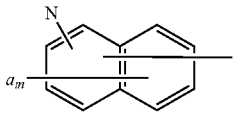 |
|---|---|---|---|---|---|
| 85 | 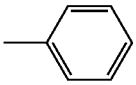 | 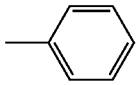 | H | 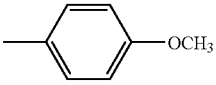 | 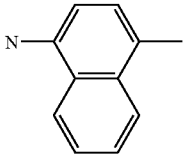 |
| 86 | 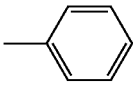 | 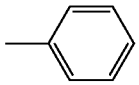 | H | 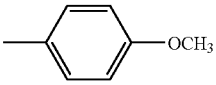 | 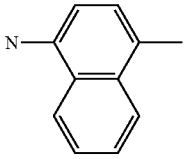 |
| 87 | 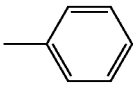 | 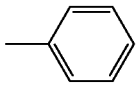 | H | 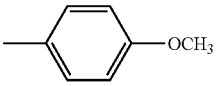 | 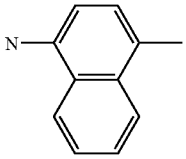 |
| 88 | 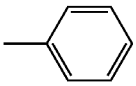 | 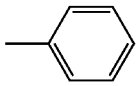 | H | 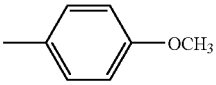 | 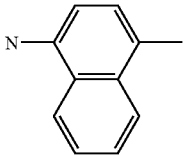 |
| 89 | 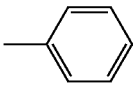 | 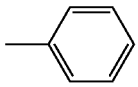 | H | 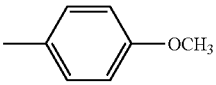 | 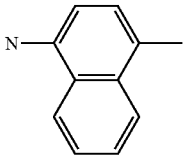 |
| 90 | 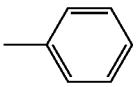 | 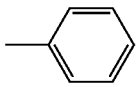 | H | 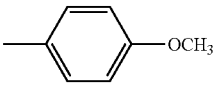 | 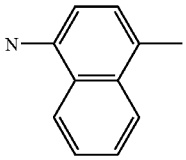 |
| 91 | 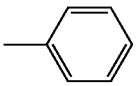 | 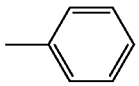 | H | 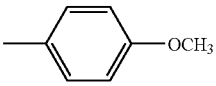 | 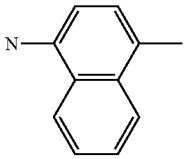 |
| Compound No. | n | $-(CR^2=CR^3)_n-$ | $R^4$ | $Ar^4$ | $Ar^5$ |
|---|---|---|---|---|---|
| 85 | 1 | CH═CH | H | $-CH_3$ | 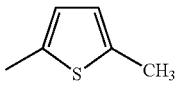 |
| 86 | 1 | CH═CH | H | $-CH_3$ | 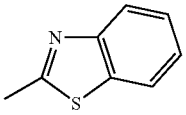 |

TABLE 13-continued
| | | | | | |
|---|---|---|---|---|---|
| 87 | 1 | CH═CH | H | —$CH_3$ | 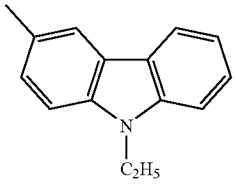 |
| 88 | 1 | CH═CH | H | 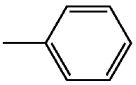 | 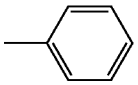 |
| 89 | 1 | CH═CH | H | 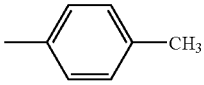 | 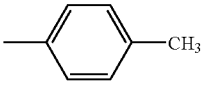 |
| 90 | 1 | CH═CH | H | 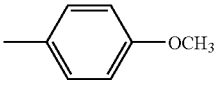 | 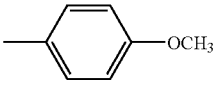 |
| 91 | 1 | CH═CH | H | 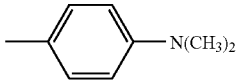 | 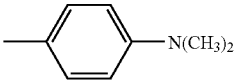 |
TABLE 14
| Compound No. | $Ar^1$ | $Ar^2$ | $R^1$ | $Ar^3$ | 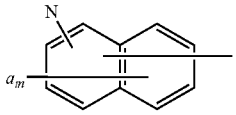 |
|---|---|---|---|---|---|
| 92 | 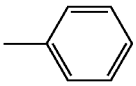 | 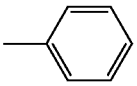 | H | 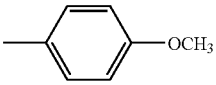 | 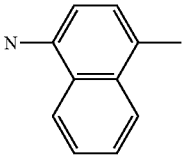 |
| 93 | 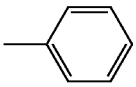 | 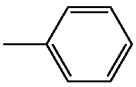 | H | 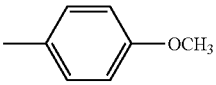 | 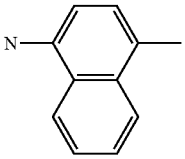 |
| 94 | 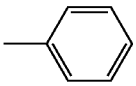 | 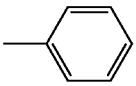 | H | 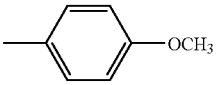 | 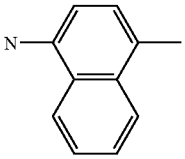 |
| 95 | 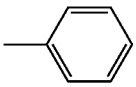 | 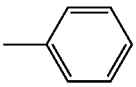 | H | 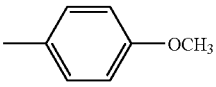 | 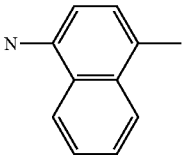 |

TABLE 14-continued

| | | | | |
|---|---|---|---|---|
| 96 | | H | $OCH_3$ | N |
| 97 | | H | $OCH_3$ | N |
| 98 | | H | $OCH_3$ | N |

| Compound No. | n | | $R^4$ | $Ar^4$ | $Ar^5$ |
|---|---|---|---|---|---|
| 92 | 1 | CH═CH | H | | |
| 93 | 1 | CH═CH | H | | S |
| 94 | 1 | CH═CH | H | | |
| 95 | 1 | CH═CH | H | | |
| 96 | 1 | CH═CH | H | | |
| 97 | 1 | CH═CH | H | | O |

TABLE 14-continued
| | | | | |
|---|---|---|---|---|
| 98 | 1 | CH═CH | H | 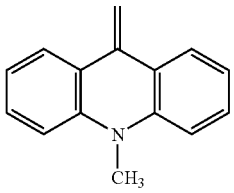 |
TABLE 15
| Compound No. | $Ar^1$ | $Ar^2$ | $R^1$ | $Ar^3$ | 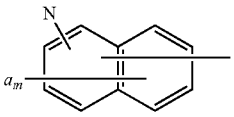 |
|---|---|---|---|---|---|
| 99 | 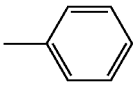 | 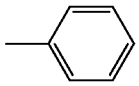 | H | 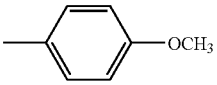 | 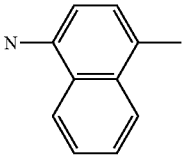 |
| 100 | 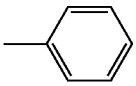 | 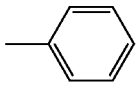 | H | 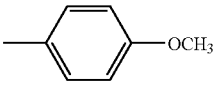 | 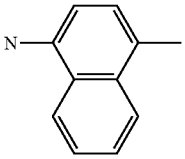 |
| 101 | 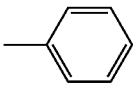 | 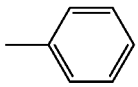 | H | 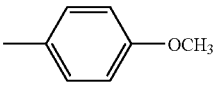 | 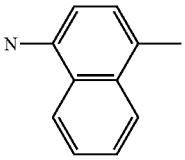 |
| 102 | 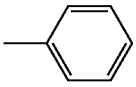 | 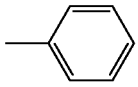 | H | 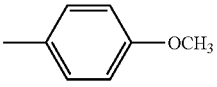 | 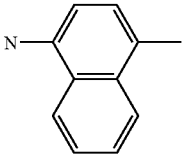 |
| 103 | 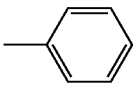 | 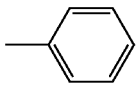 | H | 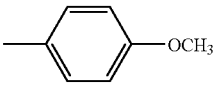 | 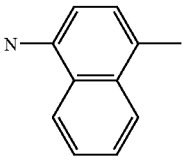 |
| 104 | 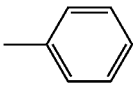 | 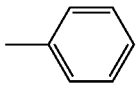 | H | 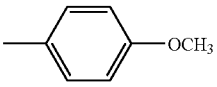 | 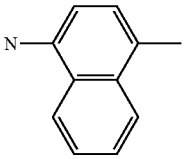 |

TABLE 15-continued

| | | | | | |
|---|---|---|---|---|---|
| 105 | | H | | $OCH_3$ | N |

| Compound No. | n | $-(CR^2=CR^3)_n-$ | $R^4$ | $Ar^4$ | $Ar^5$ |
|---|---|---|---|---|---|
| 99 | 1 | CH=CH | $-CH_3$ | H | |
| 100 | 1 | CH=CH | | H | |
| 101 | 1 | $HC=C(CH_2F)$ | H | H | |
| 102 | 1 | S, $HC=C$ | H | H | |
| 103 | 1 | $HC=C$ | H | H | |
| 104 | 1 | $C(CH_3)=CH$ | H | H | |
| 105 | 1 | $HC=C(CH_3)$ | | H | |

TABLE 16

| Compound No. | $Ar^1$ | $Ar^2$ | $R^1$ | $Ar^3$ | N, $a_m$ |
|---|---|---|---|---|---|
| 106 | | | H | $OCH_3$ | N |
| 107 | | | H | $OCH_3$ | N |

TABLE 16-continued
| | | | | |
|---|---|---|---|---|
| 108 | 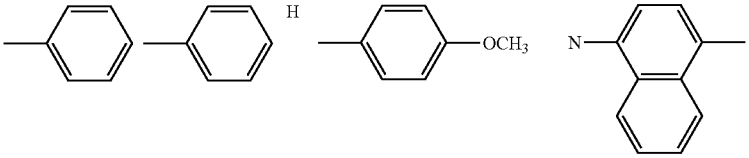 | | | |
| 109 | 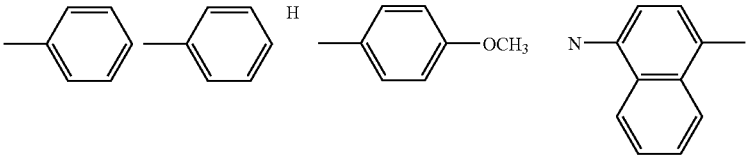 | | | |
| 110 | 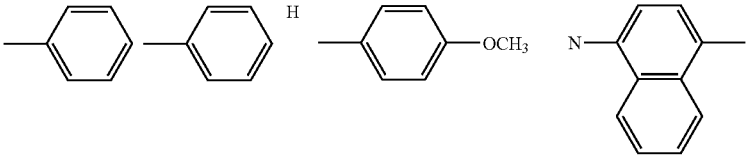 | | | |
| 111 | 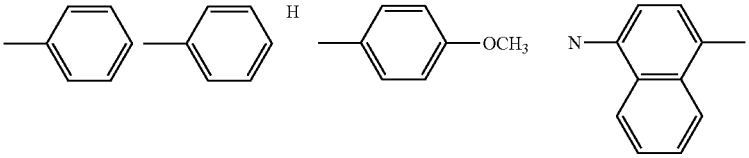 | | | |
| 112 | 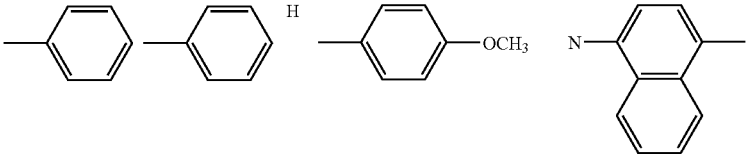 | | | |
| Compound No. | n | $-(CR^2=CR^3)_n-$ | $R^4$ | $Ar^4$ | $Ar^5$ |
|---|---|---|---|---|---|
| 106 | 2 | CH═CH—CH═CH | H | H | 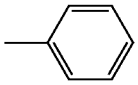 |
| 107 | 2 | CH═CH—CH═CH | H | H | 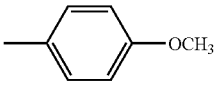 |
| 108 | 2 | CH═CH—CH═CH | H | —$CH_3$ | 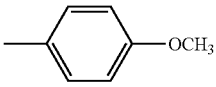 |
| 109 | 2 | CH═CH—CH═CH | H | —$CH_3$ | 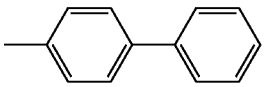 |
| 110 | 2 | CH═CH—CH═CH | H | —$CH_3$ | 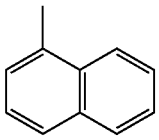 |
| 111 | 2 | CH═CH—CH═CH | H | —$CH_3$ | 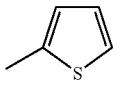 |

TABLE 16-continued
| | | | | | |
|---|---|---|---|---|---|
| 112 | 2 | CH═CH—CH═CH | H | H | 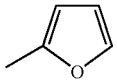 |
TABLE 17
| Compound No. | $Ar^1$ | $Ar^2$ | $R^1$ | $Ar^3$ | 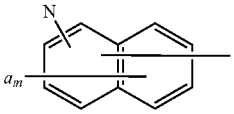 |
|---|---|---|---|---|---|
| 113 | 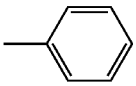 | 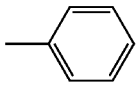 | H | 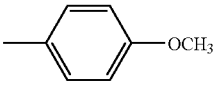 | 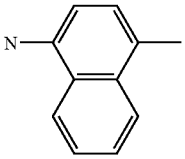 |
| 114 | 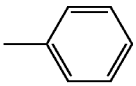 | 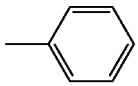 | H | 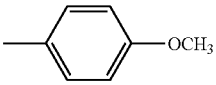 | 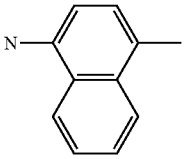 |
| 115 | 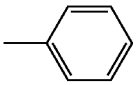 | 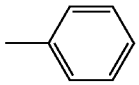 | H | 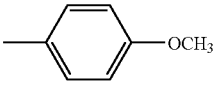 | 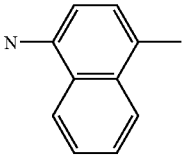 |
| 116 | 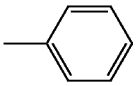 | 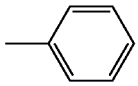 | H | 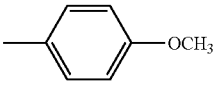 | 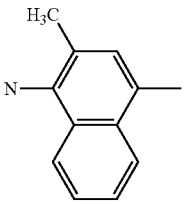 |
| 117 | 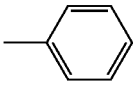 | 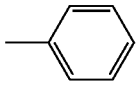 | H | 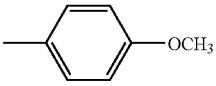 | 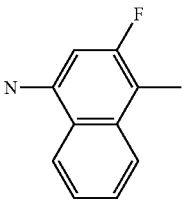 |
| 118 | 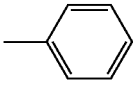 | 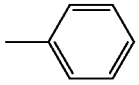 | H | 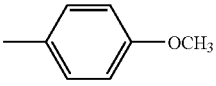 | 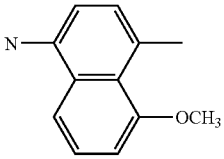 |

TABLE 17-continued
| | | | | | |
|---|---|---|---|---|---|
| 119 | 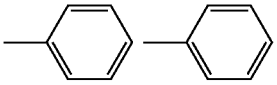 | H | 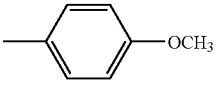 | 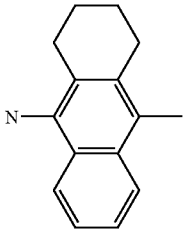 | |
| Compound No. | n | $-(CR^2{=}CR^3)_n-$ | $R^4$ | $Ar^4$ | $Ar^5$ |
|---|---|---|---|---|---|
| 113 | 2 | 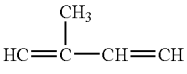 | H | H | 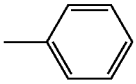 |
| 114 | 2 | 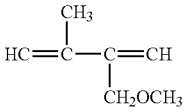 | H | H | 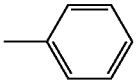 |
| 115 | 3 | $-(HC{=}CH)_3-$ | H | H | 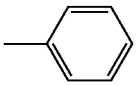 |
| 116 | 1 | CH═CH | H | H | 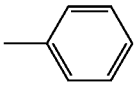 |
| 117 | 1 | CH═CH | H | H | 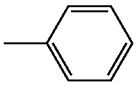 |
| 118 | 1 | CH═CH | H | H | 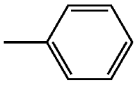 |
| 119 | 1 | CH═CH | H | H | 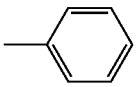 |
TABLE 18
| Compound No. | $Ar^1$ | $Ar^2$ | $R^1$ | $Ar^3$ | 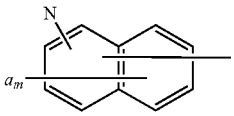 |
|---|---|---|---|---|---|
| 120 | 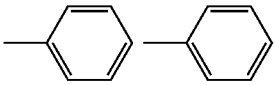 |  | H | 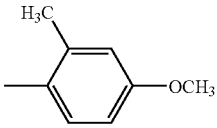 | 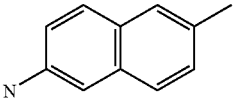 |
| 121 | 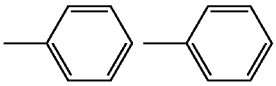 |  | H | 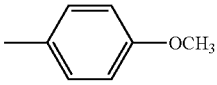 | 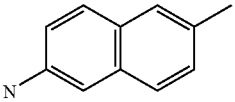 |

TABLE 18-continued
| | | | | |
|---|---|---|---|---|
| 122 | 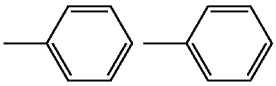 | H | 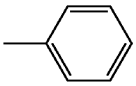 | 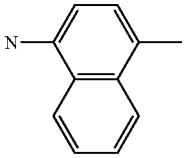 |
| 123 | 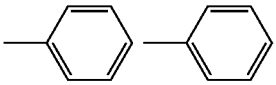 | H | 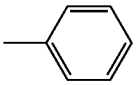 | 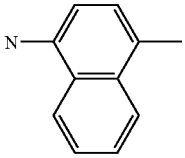 |
| 124 | 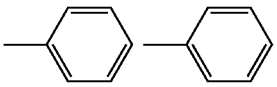 | H | 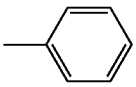 | 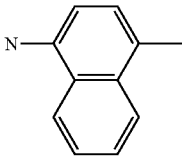 |
| 125 | 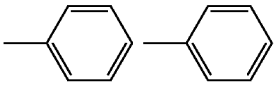 | H | 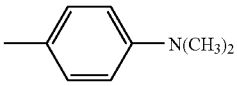 | 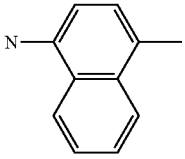 |
| 126 | 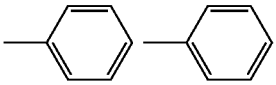 | H | 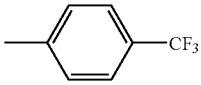 | 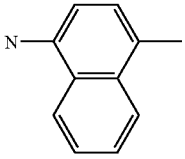 |
| Compound No. | n | $-(CR^2=CR^3)_n-$ | $R^4$ | $Ar^4$ | $Ar^5$ |
|---|---|---|---|---|---|
| 120 | 1 | CH=CH | H | H | 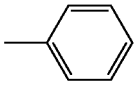 |
| 121 | 1 | CH=CH | H | H | 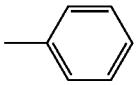 |
| 122 | 1 | CH=CH | H | H | 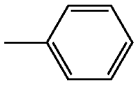 |
| 123 | 1 | CH=CH | H | $-CH_3$ | 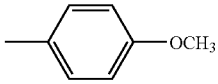 |
| 124 | 1 | CH=CH | H | 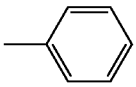 | 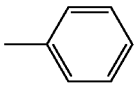 |

TABLE 18-continued
| | | | | | |
|---|---|---|---|---|---|
| 125 | 1 | CH═CH | H | H | 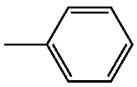 |
| 126 | 1 | CH═CH | H | H | 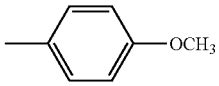 |
TABLE 19
| Compound No. | $Ar^1$ | $Ar^2$ | $R^1$ | $Ar^3$ | 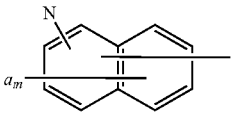 |
|---|---|---|---|---|---|
| 127 | 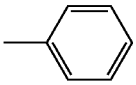 | 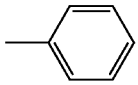 | H | 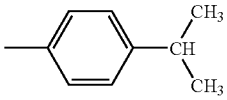 | 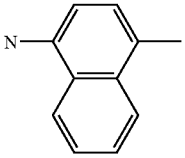 |
| 128 | 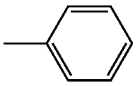 | 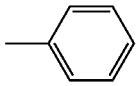 | H | 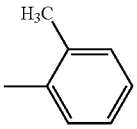 | 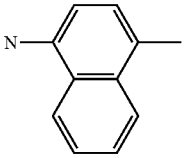 |
| 129 | 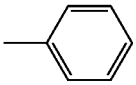 | 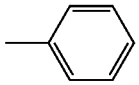 | H | 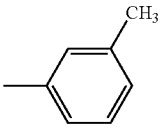 | 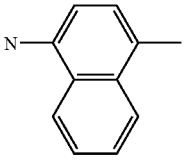 |
| 130 | 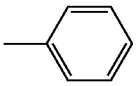 | 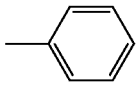 | H | 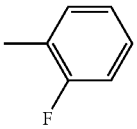 | 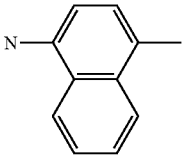 |
| 131 | 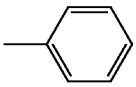 | 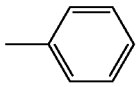 | H | 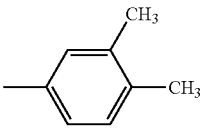 | 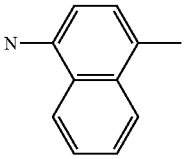 |
| 132 | 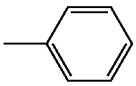 | 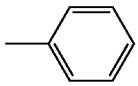 | H | 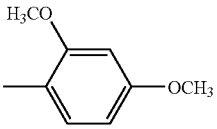 | 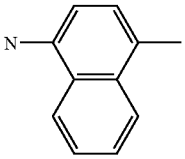 |
| 133 | 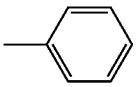 | 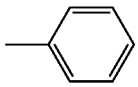 | H | 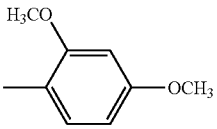 | 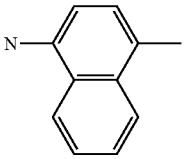 |

TABLE 19-continued
| Compound No. | n | $-(CR^2=CR^3)_n-$ | $R^4$ | $Ar^4$ | $Ar^5$ |
|---|---|---|---|---|---|
| 127 | 1 | CH=CH | H | 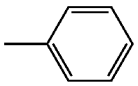 | 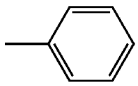 |
| 128 | 1 | CH=CH | H | H | 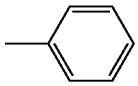 |
| 129 | 1 | CH=CH | H | H | 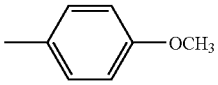 |
| 130 | 1 | CH=CH | H | 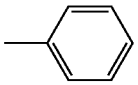 | 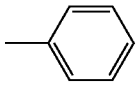 |
| 131 | 1 | CH=CH | H | H | 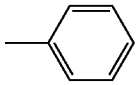 |
| 132 | 1 | CH=CH | H | $-CH_3$ | 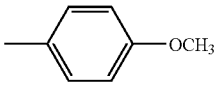 |
| 133 | 1 | CH=CH | H | 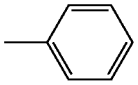 | 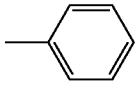 |
TABLE 20
| Compound No. | $Ar^1$ | $Ar^2$ | $R^1$ | $Ar^3$ | 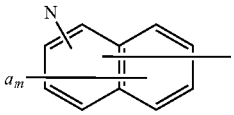 |
|---|---|---|---|---|---|
| 134 | 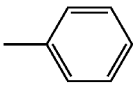 | 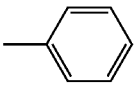 | H | 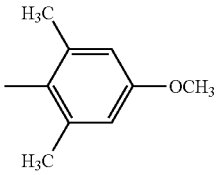 | 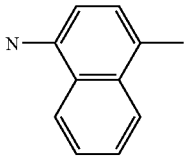 |
| 135 | 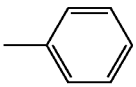 | 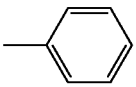 | H | 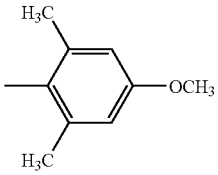 | 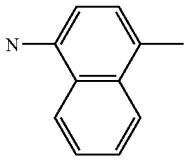 |
| 136 | 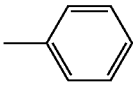 | 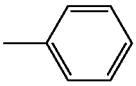 | H | 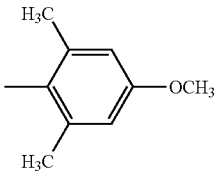 | 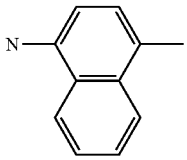 |

TABLE 20-continued
| | | | | |
|---|---|---|---|---|
| 137 | 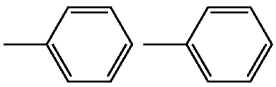 | H | 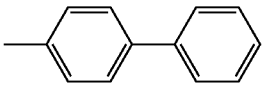 | 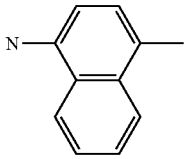 |
| 138 | 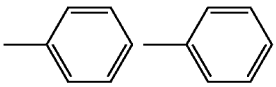 | H | 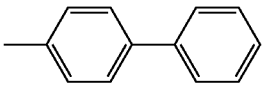 | 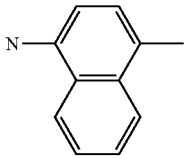 |
| 139 | 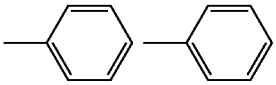 | H | 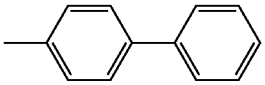 | 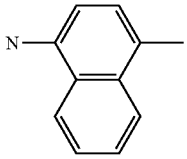 |
| 140 | 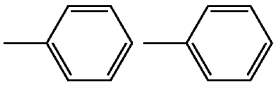 | H | 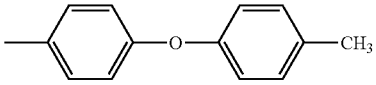 | 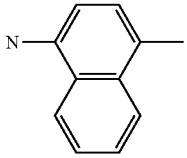 |
| Compound No. | n | $-(CR^2=CR^3)_n-$ | $R^4$ | $Ar^4$ | $Ar^5$ |
|---|---|---|---|---|---|
| 134 | 1 | CH=CH | H | H | 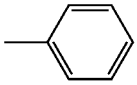 |
| 135 | 1 | CH=CH | H | H | 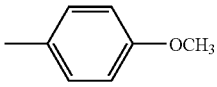 |
| 136 | 1 | CH=CH | H | 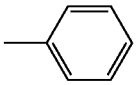 | 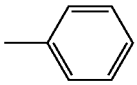 |
| 137 | 1 | CH=CH | H | H | 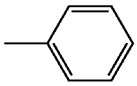 |
| 138 | 1 | CH=CH | H | $-CH_3$ | 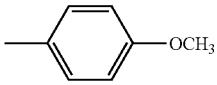 |
| 139 | 1 | CH=CH | H | 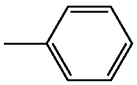 | 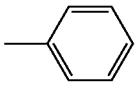 |
| 140 | 1 | CH=CH | H | H | 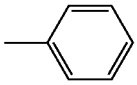 |

TABLE 21
| Compound No. | $Ar^1$ | $Ar^2$ | $R^1$ | $Ar^3$ | $a_m$ |
|---|---|---|---|---|---|
| 141 | 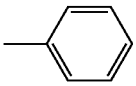 | 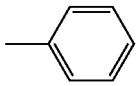 | H | 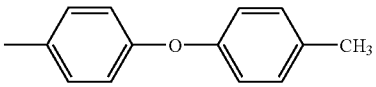 | 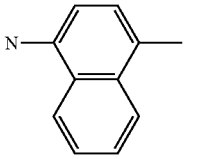 |
| 142 | 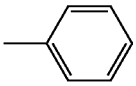 | 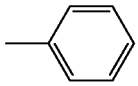 | H | 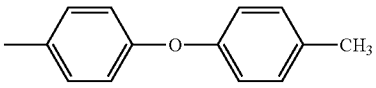 | 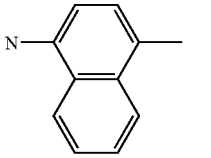 |
| 143 | 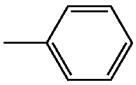 | 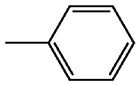 | H | 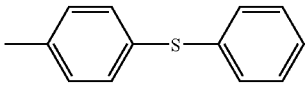 | 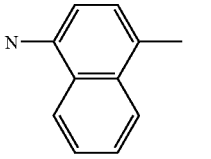 |
| 144 | 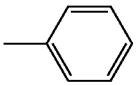 | 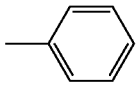 | H | 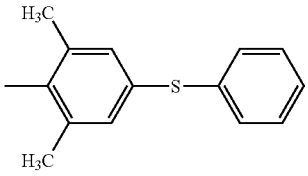 | 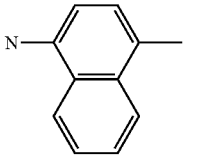 |
| 145 | 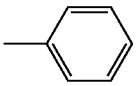 | 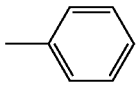 | H | 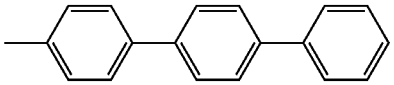 | 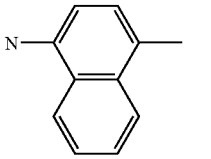 |
| 146 | 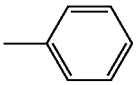 | 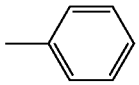 | H | 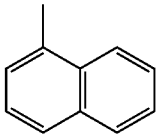 | 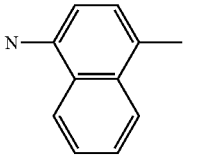 |
| 147 | 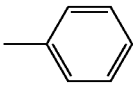 | 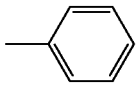 | H | 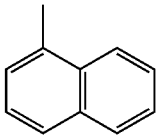 | 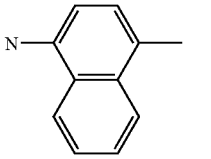 |
| Compound No. | n | $-(CR^2{=}CR^3)_n-$ | $R^4$ | $Ar^4$ | $Ar^5$ |
|---|---|---|---|---|---|
| 141 | 1 | CH═CH | H | H | 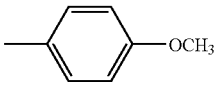 |
| 142 | 1 | CH═CH | H | $-CH_3$ | 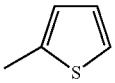 |

TABLE 21-continued

| | | | | | |
|---|---|---|---|---|---|
| 143 | 1 | CH═CH | H | H | |
| 144 | 1 | CH═CH | H | —$CH_3$ | $OCH_3$ |
| 145 | 1 | CH═CH | H | —$CH_3$ | O |
| 146 | 1 | CH═CH | H | H | |
| 147 | 1 | CH═CH | H | —$CH_3$ | $OCH_3$ |

TABLE 22

| Compound No. | $Ar^1$ | $Ar^2$ | $R^1$ | $Ar^3$ | N, $a_m$ |
|---|---|---|---|---|---|
| 148 | | | H | | N |
| 149 | | | H | | N |
| 150 | | | H | | N |
| 151 | | | H | | N |
| 152 | | | H | | N |

TABLE 22-continued

| | | | | | |
|---|---|---|---|---|---|
| 153 | | | H | | |
| 154 | | | H | | |

| Compound No. | n | $-(CR^2{=}CR^3)_n-$ | $R^4$ | $Ar^4$ | $Ar^5$ |
|---|---|---|---|---|---|
| 148 | 1 | CH═CH | H | H | |
| 149 | 1 | CH═CH | H | —$CH_3$ | |
| 150 | 1 | CH═CH | H | H | |
| 151 | 1 | CH═CH | H | —$CH_3$ | |
| 152 | 1 | CH═CH | H | —$CH_3$ | |
| 153 | 1 | CH═CH | H | —$CH_3$ | |
| 154 | 1 | CH═CH | H | H | |

TABLE 23

| Compound No. | $Ar^1$ | $Ar^2$ | $R^1$ | $Ar^3$ | | n |
|---|---|---|---|---|---|---|
| 155 | | | H | | | 1 |

TABLE 23-continued
| | | | | | |
|---|---|---|---|---|---|
| 156 | 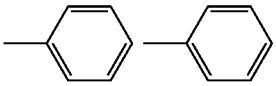 | H | 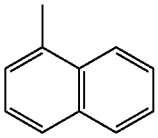 | 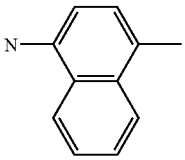 | 1 |
| 157 | 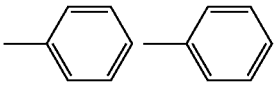 | H | 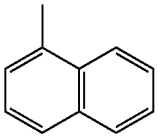 | 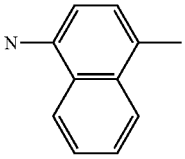 | 1 |
| 158 | 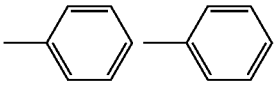 | H | 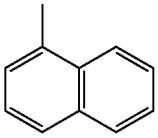 | 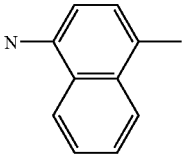 | 1 |
| 159 | 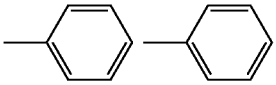 | H | 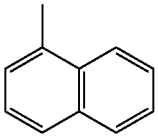 | 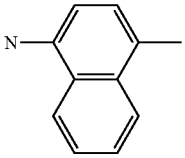 | 1 |
| 160 | 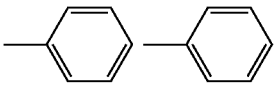 | H | 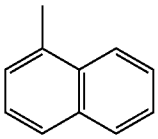 | 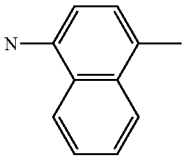 | 1 |
| 161 | 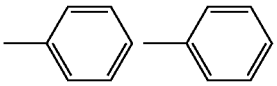 | H | 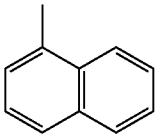 | 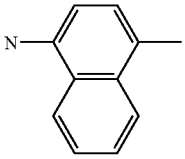 | 1 |
| Compound No. | $-(CR^2=CR^3)_n-$ | $R^4$ | $Ar^4$ | $Ar^5$ |
|---|---|---|---|---|
| 155 | CH=CH | H | $-CH_3$ | 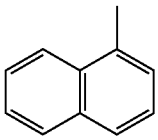 |
| 156 | CH=CH | H | $-CH_3$ | 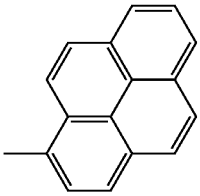 |
| 157 | CH=CH | H | $-CH_3$ | 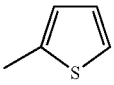 |

TABLE 23-continued
| | | | | |
|---|---|---|---|---|
| 158 | CH═CH | H | H | 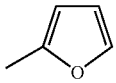 |
| 159 | CH═CH | H | 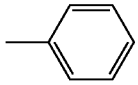 | 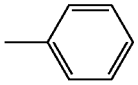 |
| 160 | CH═CH | H | 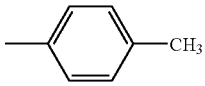 | 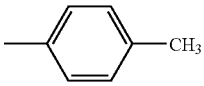 |
| 161 | CH═CH | H | 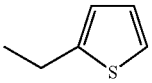 | 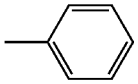 |
TABLE 24
| Compound No. | $Ar^1$ | $Ar^2$ | $R^1$ | $Ar^3$ | 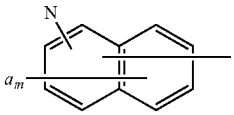 |
|---|---|---|---|---|---|
| 162 | 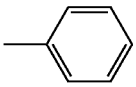 | 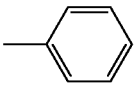 | H | 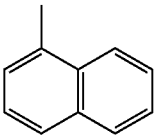 | 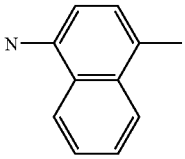 |
| 163 | 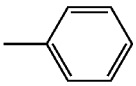 | 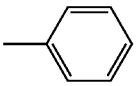 | H | 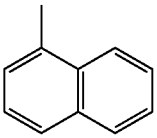 | 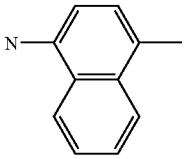 |
| 164 | 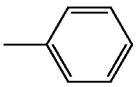 | 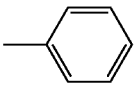 | H | 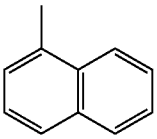 | 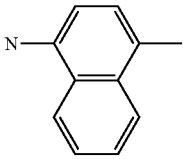 |
| 165 | 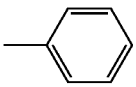 | 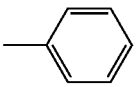 | H | 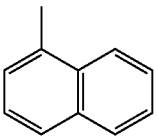 | 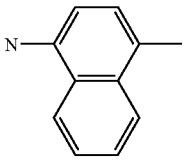 |
| 166 | 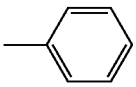 | 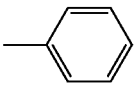 | H | 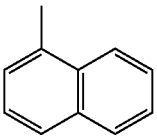 | 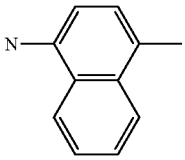 |
| 167 | 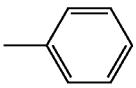 | 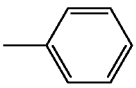 | H | 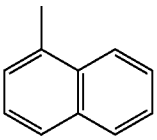 | 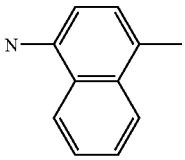 |

TABLE 24-continued
| | | | | | | |
|---|---|---|---|---|---|---|
| 168 | 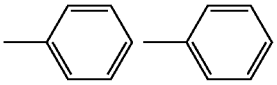 | | | H | 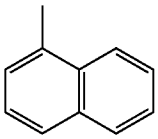 | 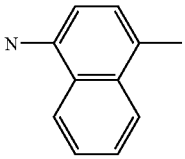 |
| Compound No. | n | $-(CR^2=CR^3)_n-$ | $R^4$ | $Ar^4$ | $Ar^5$ |
|---|---|---|---|---|---|
| 162 | 1 | CH═CH | H | | 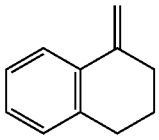 |
| 163 | 1 | CH═CH | H | | 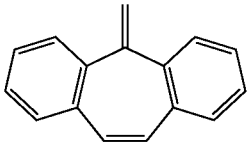 |
| 164 | 1 | CH═CH | H | | 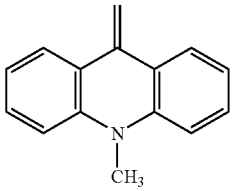 |
| 165 | 2 | CH═CH—CH═CH | H | H | 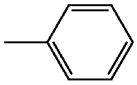 |
| 166 | 2 | CH═CH—CH═CH | H | $-CH_3$ | 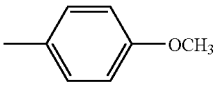 |
| 167 | 2 | CH═CH—CH═CH | H | $-CH_3$ | 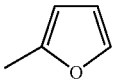 |
| 168 | 3 | $-(HC=CH)_3-$ | H | H | 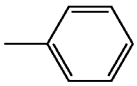 |
TABLE 25
| Compound No. | $Ar^1$ | $Ar^2$ | $R^1$ | $Ar^3$ | 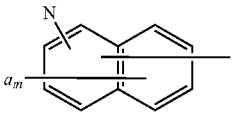 |
|---|---|---|---|---|---|
| 169 | 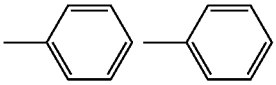 | | H | 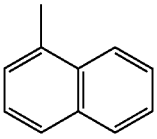 | 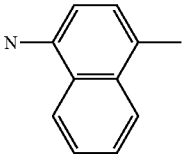 |

TABLE 25-continued
| | | | | |
|---|---|---|---|---|
| 170 | 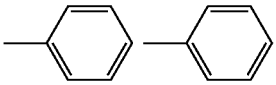 | H | 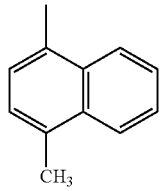 | 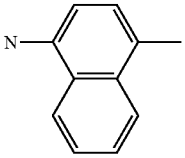 |
| 171 | 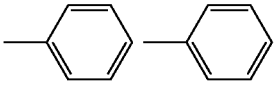 | H | 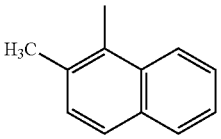 | 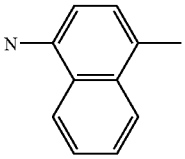 |
| 172 | 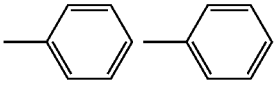 | H | 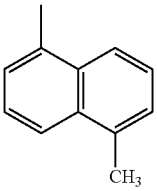 | 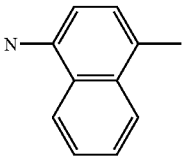 |
| 173 | 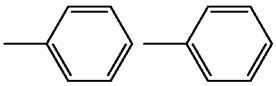 | H | 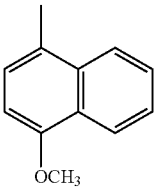 | 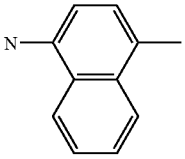 |
| 174 | 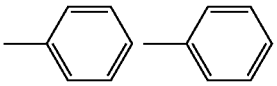 | H | 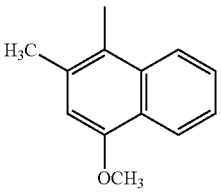 | 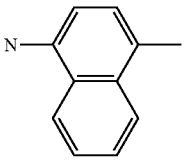 |
| 175 | 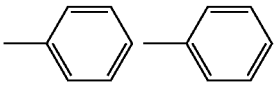 | H | 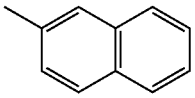 | 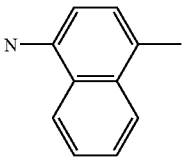 |
| Compound No. | n | $-(CR^2{=}CR^3)_n-$ | $R^4$ | $Ar^4$ | $Ar^5$ |
|---|---|---|---|---|---|
| 169 | 1 | CH═CH | H | H | 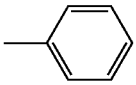 |
| 170 | 1 | CH═CH | H | H | 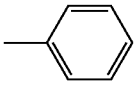 |
| 171 | 1 | CH═CH | H | H | 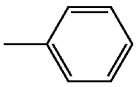 |
| 172 | 1 | CH═CH | H | H | 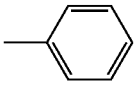 |

TABLE 25-continued
| | | | | | |
|---|---|---|---|---|---|
| 173 | 1 | CH═CH | H | H | 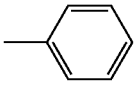 |
| 174 | 1 | CH═CH | H | H | 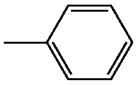 |
| 175 | 1 | CH═CH | H | H | 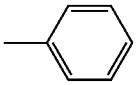 |
TABLE 26
| Compound No. | $Ar^1$ | $Ar^2$ | $R^1$ | $Ar^3$ | 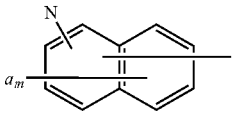 |
|---|---|---|---|---|---|
| 176 | 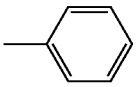 | 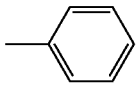 | H | 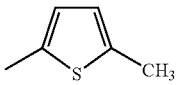 | 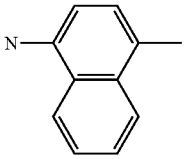 |
| 177 | 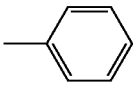 | 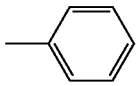 | H | 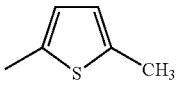 | 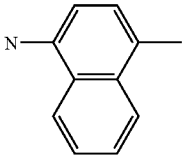 |
| 178 | 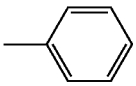 | 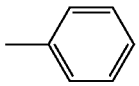 | H | 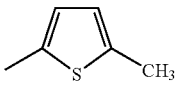 | 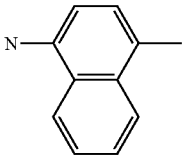 |
| 179 | 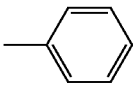 | 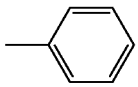 | H | 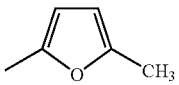 | 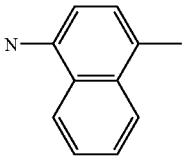 |
| 180 | 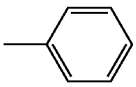 | 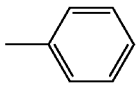 | H | 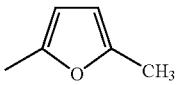 | 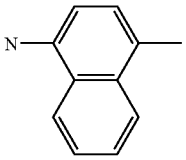 |
| 181 | 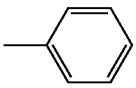 | 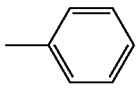 | H | 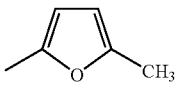 | 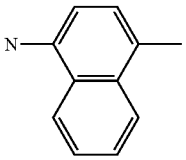 |

TABLE 26-continued
| | | | | | |
|---|---|---|---|---|---|
| 182 | 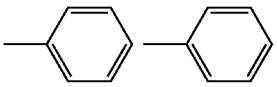 | H | 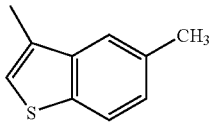 | | 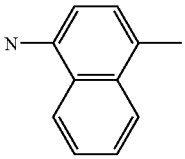 |
| Compound No. | n | $-(CR^2=CR^3)_n-$ | $R^4$ | $Ar^4$ | $Ar^5$ |
|---|---|---|---|---|---|
| 176 | 1 | CH=CH | H | H | 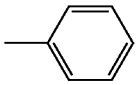 |
| 177 | 1 | CH=CH | H | H | 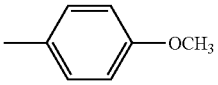 |
| 178 | 1 | CH=CH | H | 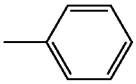 | 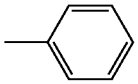 |
| 179 | 1 | CH=CH | H | H | 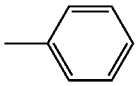 |
| 180 | 1 | CH=CH | H | $-CH_3$ | 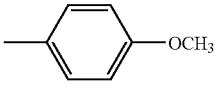 |
| 181 | 1 | CH=CH | H | 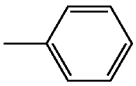 | 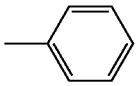 |
| 182 | 1 | CH=CH | H | H | 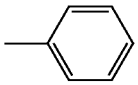 |
TABLE 27
| Compound No. | $Ar^1$ | $Ar^2$ | $R^1$ | $Ar^3$ | 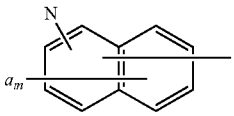 |
|---|---|---|---|---|---|
| 183 | 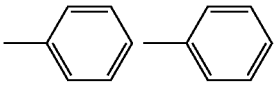 |  | H | 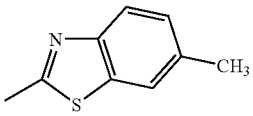 | 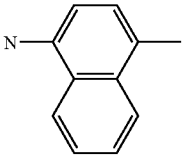 |
| 184 | 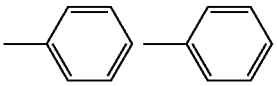 |  | H | 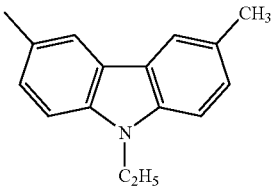 | 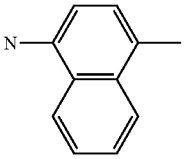 |

TABLE 27-continued
| | | | | |
|---|---|---|---|---|
| 185 | 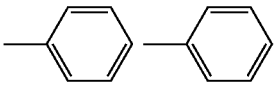 | H | 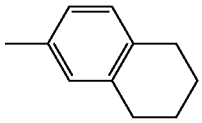 | 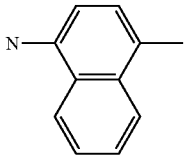 |
| 186 | 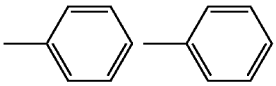 | H | 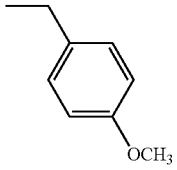 | 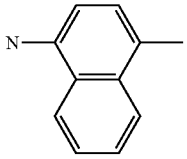 |
| 187 | 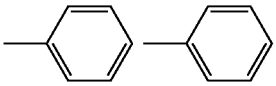 | H | 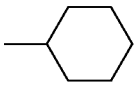 | 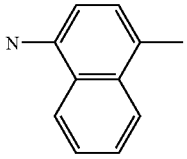 |
| 188 | 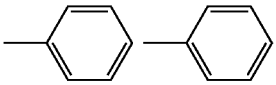 | H | 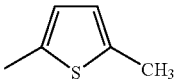 | 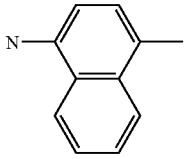 |
| 189 | 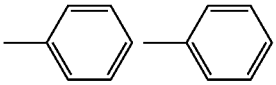 | H | 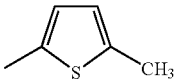 | 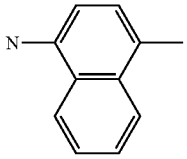 |
| Compound No. | n | $-(CR^2=CR^3)_n-$ | $R^4$ | $Ar^4$ | $Ar^5$ |
|---|---|---|---|---|---|
| 183 | 1 | CH=CH | H | $-CH_3$ | 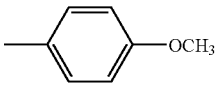 |
| 184 | 1 | CH=CH | H | 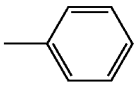 | 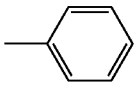 |
| 185 | 1 | CH=CH | H | H | 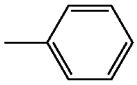 |
| 186 | 1 | CH=CH | H | H | 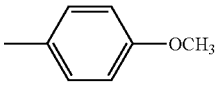 |
| 187 | 1 | CH=CH | H | 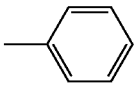 | 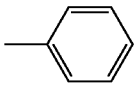 |

TABLE 27-continued
| | | | | | |
|---|---|---|---|---|---|
| 188 | 0 | — | H | H | 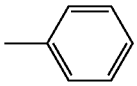 |
| 189 | 0 | — | H | H | 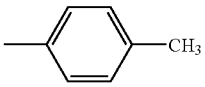 |
TABLE 28
| Compound No. | $Ar^1$ | $Ar^2$ | $R^1$ | $Ar^3$ | 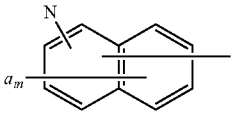 |
|---|---|---|---|---|---|
| 190 | 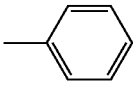 | 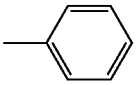 | H | 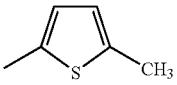 | 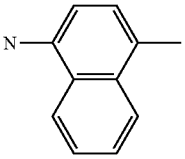 |
| 191 | 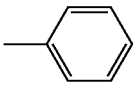 | 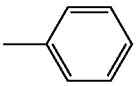 | H | 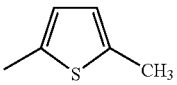 | 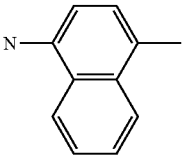 |
| 192 | 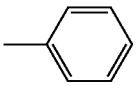 | 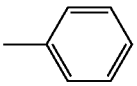 | H | 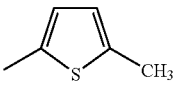 | 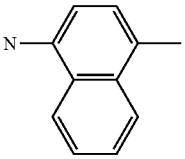 |
| 193 | 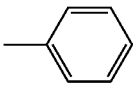 | 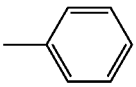 | H | 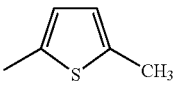 | 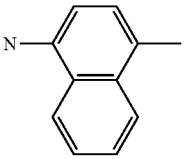 |
| 194 | 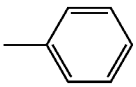 | 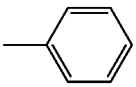 | H | 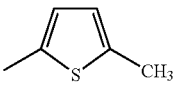 | 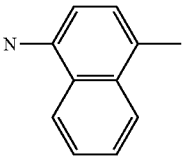 |
| 195 | 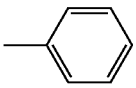 | 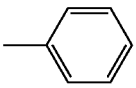 | H | 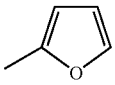 | 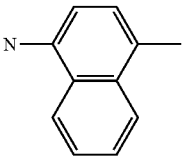 |

TABLE 28-continued
| | | | | | |
|---|---|---|---|---|---|
| 196 | 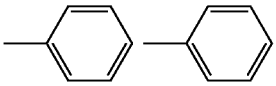 | | H | 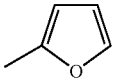 | 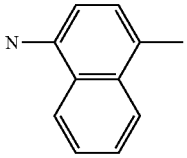 |
| Compound No. | n | $-(CR^2=CR^3)_n-$ | $R^4$ | $Ar^4$ | $Ar^5$ |
|---|---|---|---|---|---|
| 190 | 0 | — | H | H | 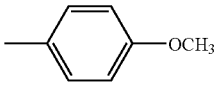 |
| 191 | 0 | — | H | H | 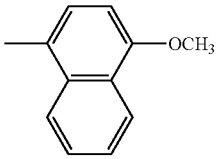 |
| 192 | 0 | — | H | H | 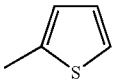 |
| 193 | 0 | — | H | H | 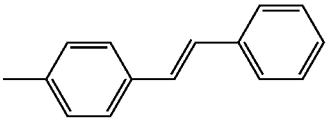 |
| 194 | 0 | — | H | 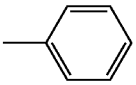 | 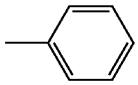 |
| 195 | 0 | — | H | H | 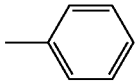 |
| 196 | 0 | — | H | H | 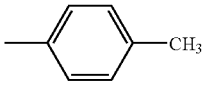 |
TABLE 46
| Compound No. | $Ar^1$ | $Ar^2$ | $R^1$ | $Ar^3$ | 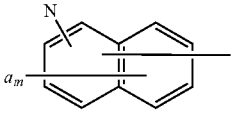 |
|---|---|---|---|---|---|
| 197 | 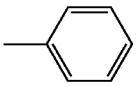 | 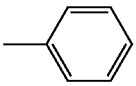 | H | 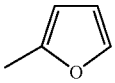 | 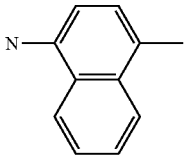 |
| 198 | 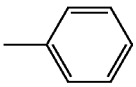 | 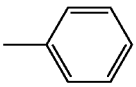 | H | 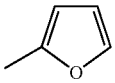 | 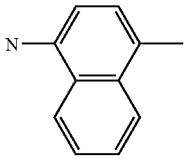 |

TABLE 46-continued
| | | | | |
|---|---|---|---|---|
| 199 | 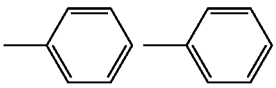 | H | 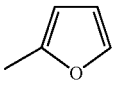 | 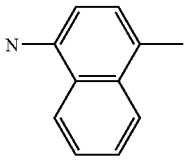 |
| 200 | 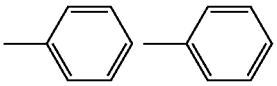 | H | 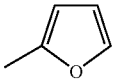 | 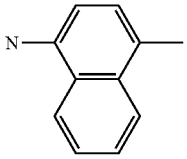 |
| 201 | 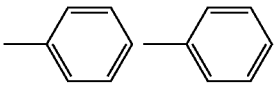 | H | 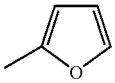 | 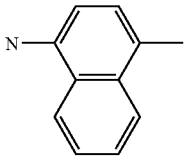 |
| 202 | 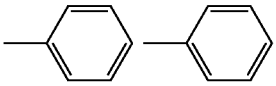 | H | 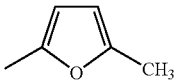 | 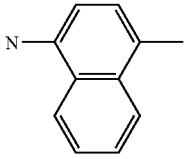 |
| 203 | 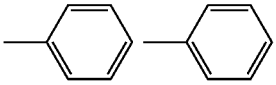 | H | 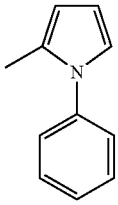 | 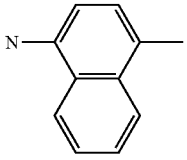 |
| Compound No. | n | $-(CR^2=CR^3)_n-$ | $R^4$ | $Ar^4$ | $Ar^5$ |
|---|---|---|---|---|---|
| 197 | 0 | — | H | H | 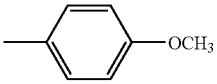 |
| 198 | 0 | — | H | H | 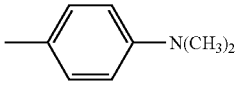 |
| 199 | 0 | — | H | H | 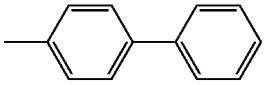 |
| 200 | 0 | — | H | H | 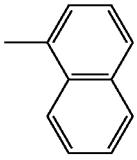 |
| 201 | 0 | — | H | 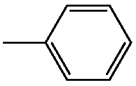 | 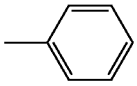 |

TABLE 46-continued
| | | | | | |
|---|---|---|---|---|---|
| 202 | 0 | — | H | H | 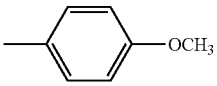 |
| 203 | 0 | — | H | H | 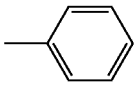 |
TABLE 30
| Compound No. | $Ar^1$ | $Ar^2$ | $R^1$ | $Ar^3$ | 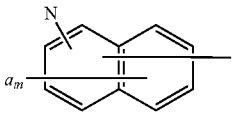 |
|---|---|---|---|---|---|
| 204 | 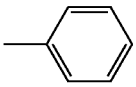 | 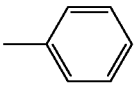 | H | 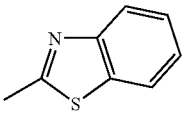 | 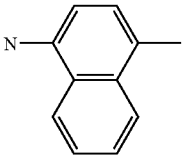 |
| 205 | 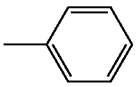 | 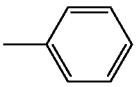 | H | 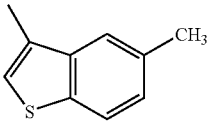 | 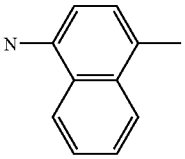 |
| 206 | 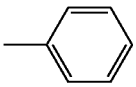 | 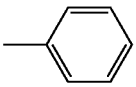 | H | 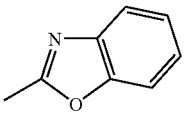 | 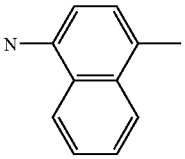 |
| 207 | 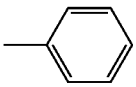 | 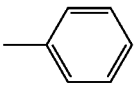 | H | 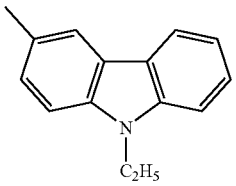 | 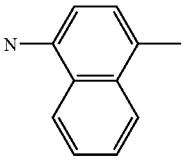 |
| 208 | 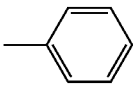 | 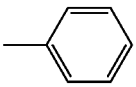 | H | 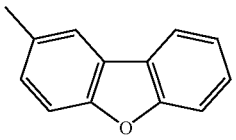 | 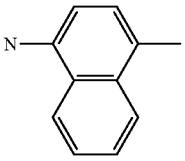 |
| 209 | 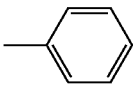 | 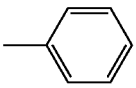 | $CH_3$ | 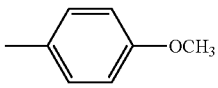 | 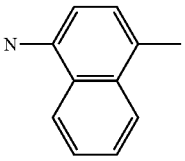 |

TABLE 30-continued
| | | | | | |
|---|---|---|---|---|---|
| 210 | 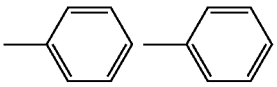 | $CH_2CF_3$ | 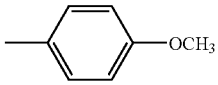 | $OCH_3$ | 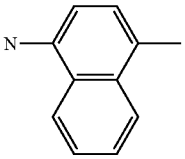 |
| Compound No. | n | $-(CR^2=CR^3)_m-$ | $R^4$ | $Ar^4$ | $Ar^5$ |
|---|---|---|---|---|---|
| 204 | 0 | — | H | H | 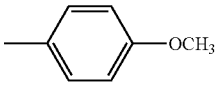 |
| 205 | 0 | — | H | 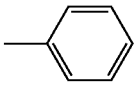 | 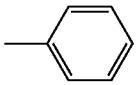 |
| 206 | 0 | — | H | H | 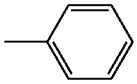 |
| 207 | 0 | — | H | H | 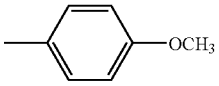 |
| 208 | 0 | — | H | 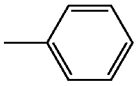 | 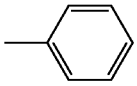 |
| 209 | 1 | CH=CH | H | H | 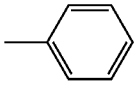 |
| 210 | 1 | CH=CH | H | H | 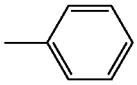 |
TABLE 31
| Compound No. | $Ar^1$ | $Ar^2$ | $R^1$ | $Ar^3$ | 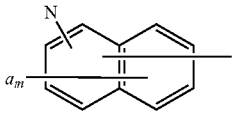 |
|---|---|---|---|---|---|
| 211 | 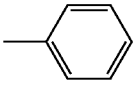 | 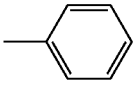 | $CH(CH_3)_2$ | 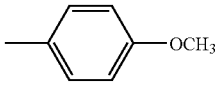 | 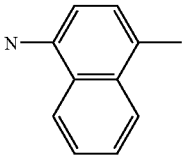 |
| 212 | 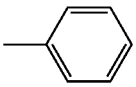 | 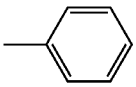 | F | 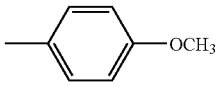 | 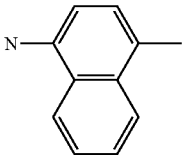 |

TABLE 31-continued
| | | | | | |
|---|---|---|---|---|---|
| 213 | 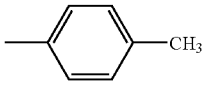 | 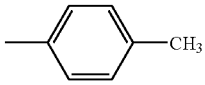 | H | 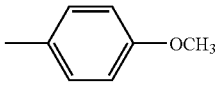 | 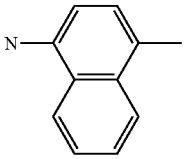 |
| 214 | 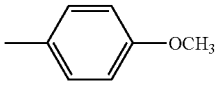 | 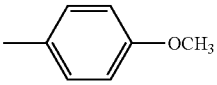 | H | 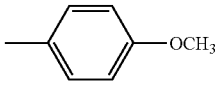 | 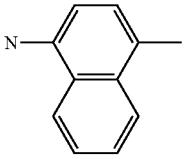 |
| 215 | 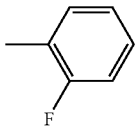 | 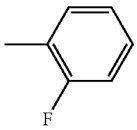 | H | 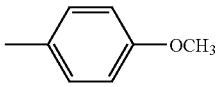 | 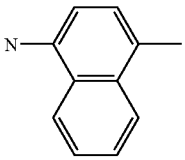 |
| 216 | 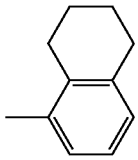 | 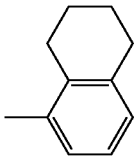 | H | 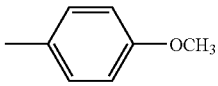 | 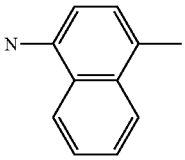 |
| 217 | 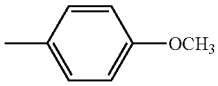 | 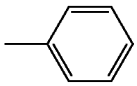 | H | 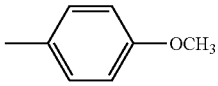 | 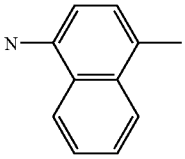 |
| Compound No. | n | $-(CR^2=CR^3)_n-$ | $R^4$ | $Ar^4$ | $Ar^5$ |
|---|---|---|---|---|---|
| 211 | 1 | CH=CH | H | H | 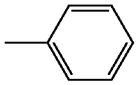 |
| 212 | 1 | CH=CH | H | H | 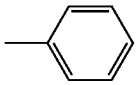 |
| 213 | 1 | CH=CH | H | H | 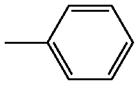 |
| 214 | 1 | CH=CH | H | H | 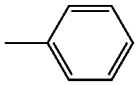 |
| 215 | 1 | CH=CH | H | H | 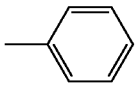 |

TABLE 31-continued
| | | | | | |
|---|---|---|---|---|---|
| 216 | 1 | CH=CH | H | H | 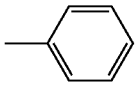 |
| 217 | 1 | CH=CH | H | H | 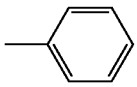 |
TABLE 32
| Compound No. | $Ar^1$ | $Ar^2$ | $R^1$ | $Ar^3$ | 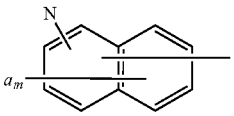 |
|---|---|---|---|---|---|
| 218 | 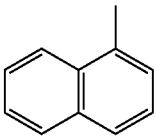 | 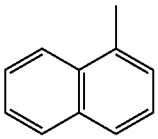 | H | 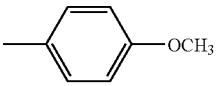 | 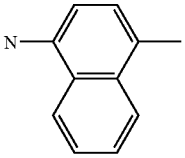 |
| 219 | 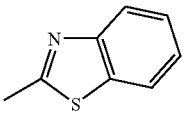 | 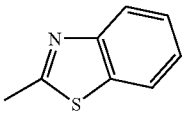 | H | 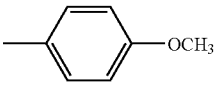 | 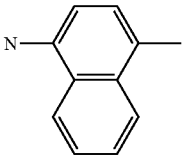 |
| 220 | 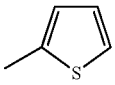 | 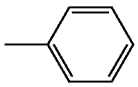 | H | 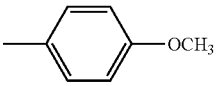 | 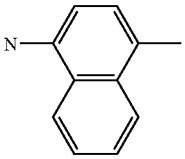 |
| Compound No. | n | $-(CR^2=CR^3)_n-$ | $R^4$ | $Ar^4$ | $Ar^5$ |
|---|---|---|---|---|---|
| 218 | 1 | CH=CH | H | H | 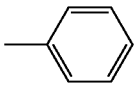 |
| 219 | 1 | CH=CH | H | H | 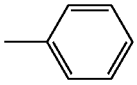 |
| 220 | 1 | CH=CH | H | H | 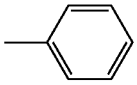 |

The enamine compound represented by the general formula (1) can be produced, for example, as described below.

At first, an aldehyde compound or a ketone compound represented by the general formula (3) and a secondary amine compound represented by the following general formula (4) are put to dehydration condensing reaction thereby producing an enamine intermediate product represented by the following general formula (5).

(3)

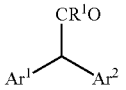

wherein $Ar^1$, $Ar^2$ and $R^1$ are the same as defined in formula (1).

(4)

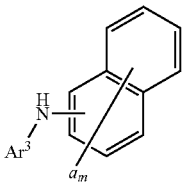

wherein $Ar^3$, a and m are the same as defined in formula (1).

(5)

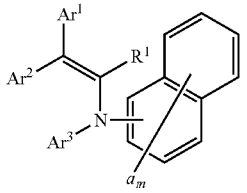

wherein $Ar^1$, $Ar^2$, $Ar^3$, $R^1$, a and m are the same as defined in formula (1).

The dehydrating condensation reaction is conducted, for example, as described below. An aldehyde compound or ketone compound represented by the general formula (3) and a substantially equi-molar amount of a secondary amine compound represented by the general formula (4) are dissolved in a solvent such as an aromatic solvent, alcohols, or ethers to prepare a solution. Specific examples of the solvent to be used can include, for example, toluene, xylene, chlorobenzene, butanol and diethylene glycol dimethyl ether. A catalyst, for example, an acid catalyst such as p-toluene sulfonic acid, camphor sulfuric acid, or pyridinium-p-toluene sulfonic acid is added to the prepared solution and reaction is conducted under heating. The addition amount of the catalyst is, preferably, from 1/10 to 1/1000 molar equivalent, more preferably, 1/25 to 1/500 molar equivalent and, most suitably, from 1/50 to 1/200 molar equivalent based on the aldehyde compound or the ketone compound represented by the general formula (3). Since water is by-produced during reaction to hinder the reaction, the formed water is azeotropically boiled together with the solvent and removed to the outside of the system. This can produce the enamine intermediate product shown by the general formula (5) at a high yield.

The enamine intermediate of formula represented by formula (5) is formylated through Vilsmeier reaction or is acylated through Friedel-Crafts reaction to give an enamine-carbonyl intermediate of the following general formula (6). The formylation through Vilsmeier reaction gives an enamine-aldehyde intermediate, a type of enamine-carbonyl intermediate of formula represented by formula (6) where $R^5$ is a hydrogen atom; and the acylation through Friedel-Crafts reaction gives an enamine-keto intermediate, a type of enamine-carbonyl intermediate of formula represented by formula (6) where $R^5$ is a group except hydrogen atom.

(6)

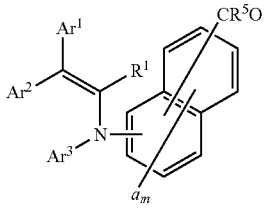

wherein $R^5$ is $R^4$ when n in formula (1) is 0, but is $R^2$ when n is 1, 2 or 3; and $Ar^1$, $Ar^2$, $Ar^3$, $R^1$, $R^2$, $R^4$ a, m and n are the same as defined in formula (1).

The Vilsmeiyer reaction is conducted, for example, as described below. Phosphorus oxychloride and N,N-dimethylformamide, phosphorus oxychloride and N-methyl-N-phenyl formamide, or phosphorus oxychloride and N,N-diphenyl formamide were added in a solvent such as N,N-dimethylformamide (simply referred to as: DMF) or 1,2-dichloroethane to prepare a Vilsmeiyer reagent. 1.0 equivalent of the enamine intermediate product represented by the general formula (5) was added to 1.0 equivalent to 1.3 equivalents of the prepared Vilsmeiyer reagent and stirred under heating at 60 to 110° C. for 2 to 8 hours. Then, hydrolysis is conducted by an aqueous alkali solution such as a 1 to 8N aqueous solution of sodium hydroxide or aqueous solution of potassium hydroxide. An enamine-aldehyde intermediate product in which $R^5$ is a hydrogen atom in the enamine-carbonyl intermediate products represented by the general formula (6) can be prepared at a high yield.

Further, the Friedel-Crafts reaction is conducted, for example, as described below. 1.0 equivalent to 1.3 equivalents of the reagent prepared from aluminum chloride and an acid chloride and 1.0 equivalent of the enamine intermediate product represented by the general formula (5) are added in a solvent such as 1,2-dichloroethane and stirred at −40 to 80° C. for 2 to 8 hours. In this case heating is applied optionally. Then, hydrolysis is conducted by an aqueous solution of alkali such as 1 to 8N aqueous solution of sodium hydroxide or aqueous solution of potassium hydroxide. An enamine-keto intermediate product in which $R^5$ is other than the hydrogen atom in the enamine-carbonyl intermediate products represented by the general formula (6) can be prepared at a high yield.

Finally, an enamine compound represented by the general formula (1) is produced by conducting a Wittig-Horner reaction of reacting the enamine-carbonyl intermediate product represented by the general formula (6) and a Wittig reagent represented by the following general formula (7-1) or a Wittig reagent represented by the general formula (7-2) under a basic condition. In this case, when the Wittig reagent used by the general formula (7-1) is used, the enamine compound represented by the general formula (1) in which n=0 can be obtained. When the Wittig reagent represented by the general formula (7-2) is used, the enamine compound represented by general formula (1) in which n is 1, 2, or 3 can be obtained.

(7-1)

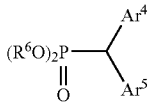

wherein $R^6$ represents an alkyl group which may have a substituent or an aryl group which may have a substituent; and $Ar^4$ and $Ar^5$ have the same meanings as those defined in formula (1).

(7-2)

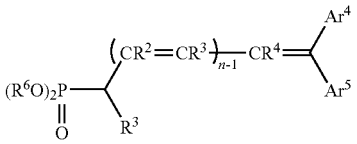

wherein $R^6$ represents an alkyl group which may have a substituent or an aryl group which may have a substituent; and $Ar^4$, $Ar^5$, $R^2$, $R^3$ and $R^4$ have the same meanings as those defined in formula (1).

The Wittig-Horner reaction is conducted, for example, as described below. 1.0 equivalent of the enamine carboxyl intermediate product represented by the general formula (6), 1.0 to 1.20 equivalents of the Wittig reagent represented by the general formula (7-1) or (7-2), and 1.0 to 1.5 equivalents of metal alkoxide base such as potassium t-butoxide, sodium ethoxide or sodium methoxide were added to a solvent such as toluene, xylene, diethylether, teterahydrofuran (abbreviated as THF), ethylene glycol dimethyl ether, N,N-dimethylformamide, or dimethylsulfoxide and stirred at a room temperature or under heating at 30 to 60° C. for 2 to 8 hours. The enamine compound represented by the general formula (1) can be prepared at a high yield.

As the enamine compound represented by the general formula (1), for example, one or more of materials selected from the group consisting of the exemplified compounds shown in Table 1 to Table 32 is used with the charge transporting substance alone or as a mixture.

The enamine compound represented by the general formula (1) may also be used in admixture with other charge transporting substance. Other charge transporting substance to be used in admixture with the enamine compound shown by the general formula (1) can include, electron donating materials, for example, enamine compound analogous with the enamine compounds represented by the general formula (1), other enamine compounds, heterocyclic compounds such as carbazole, indole, imidazole, oxazole, pyrazole, oxodiazole, pyrazoline, and thiadiazole, aniline compounds, hydrazone compounds, aromatic amine compounds, styryl compounds, triphenylamine compounds, triphenylmethane compounds, and stylbene compounds, as well as polymers having the group derived from the compounds in the main chain or on the side chains. In a case of using the enamine compound represented by the general formula (1) in admixture with other charge transporting substance, the mixture containing the enamine compound represented by the general formula (1) as the main ingredient is preferably used as the charge transporting substance 13.

The charge transporting layer 16 is formed in the form in which the charge transporting substance 13 is bonded to the binder resin 17. The charge transporting layer 16 is formed, for example, by dissolving a charge transporting substance 13 in a solution of a binder resin obtained by dissolving or dispersing the binder resin 17 in a solvent identical with the solvent used for the coating solution for charge generating layer described above to prepare a coating solution for charge transporting layer, and coating the outer circumferential surface of the charge generating layer 15 with the coating solution by using the same method as the coating method of the coating solution for charge generating layer.

For the binder resin 17 of the charge transporting layer 16, resins identical with the binder resins used for the charge generating layer 15 described above can be used. Among them, those excellent in compatibility with the charge transporting substance 13 are used preferably. For example, polymethyl methacrylate resin, polystyrene resin, vinyl polymer resin such as polyvinyl chloride resin or copolymer resin containing two or more of repetitive units constituting them, polycarbonate resin, polyester resin, polyester carbonate resin, polysulfone resin, phenoxyresin, epoxyresin, siliconeresin, polyallylate resin, polyamide resin, polyether resin, polyurethane resin, polyacrylamide resin, or phenol resin can be used. Thermosetting resins formed by partially crosslinking the resins described above may also be used. The resins may be used each alone or two or more of them may be used in admixture. Among the resins described above, polystyrene resin, polycarbonate resin, polyallylate resin, or polyphenyl oxide can be used suitably since such resins have a volumic resistivity of $10^{13}\Omega\cdot$cm or more, and are excellent in electric insulation property, as well as in film forming property and potential characteristics.

The ratio A/B for the weight A of the charge transporting substance 13 and the weight B for the binder resin 17 in the charge transporting layer 16 is preferably 2/3 or less with a view point of the printing resistance of the photosensitive layer 14. In a case where the ratio A/B exceeds 2/3, that is, the ratio of the binder resin 17 is lowered, the printing resistance of the photosensitive layer 14 is lowered compared with a case in which the ratio of the binder resin 17 is higher.

Further, in a case of forming the charge transporting layer 16 by a dip coating method, the ratio A/B is preferably 1/3 or more. In a case where the A/B is less than 1/3 and the ratio of the binder resin 17 is higher, since the viscosity of the coating solution increases, this lowers the coating speed to worsen the productivity remarkably. Further, in a case of increasing the amount of the solvent in the coating solution in order to suppress increase of the viscosity of the coating solution, a brushing phenomenon occurs to result in clouding in the formed charge transporting layer 16.

The film thickness of the charge transporting layer 16 is, preferably, from 5 μm or more and 50 μm or less and, more preferably, from 10 μm or more and 40 μm or less. In a case where the film thickness of the charge transporting layer 16 is less than 5 μm, the charge retainability on the surface of the photoreceptor is lowered. In a case where the film thickness of the charge transporting layer 16 exceeds 50 μm, the resolution of the photoreceptor is lowered. Accordingly, a preferred range for the film thickness of the charge transporting layer 16 is defined as 5 μm or more and 50 μm or less.

As described above, the photosensitive layer 14 is a layered type photosensitive layer formed by stacking the charge generating layer 15 and the charge transporting layer 16 formed as described above. By shearing the charge generation function and the charge transport function to separate layers as described above, since optimal materials can be selected respectively for the charge generation function and the charge transport function for the materials constituting each of the layers, an electrophotographic photoreceptor 1 particularly excellent in the characteristic stability in the repetitive use can be obtained.

As the conductive material constituting the conductive substrate 11, metal materials, for example, metals such as aluminum, copper, zinc, nickel, or titanium, or alloys such as aluminum alloys or stainless steels can be used. Further, with no restriction to the metal materials described above, those formed by applying an electrifying treatment to the surface, for example, of polymeric materials such as polyethylene terephthalate, phenol resin, nylon or polystyrene, glass or hard paper, for example, those laminated with metal foils, vapor deposited with metal materials, or those coated with a conductive material such as titanium oxide, tin oxide, indium oxide, or carbon black together with an appropriate binder resin can also be used. The conductive materials are used being fabricated into a predetermined shape. While the shape of the conductive substrate 11 is cylindrical in this embodiment, this is not limitative but it may be a circular columnar shape, sheet-like shape or an endless belt shape.

As has been described above, in this embodiment, the photosensitive layer 14 has a constitution in which the charge generating layer 15 and the charge transporting layer 16 are stacked in this order on the outer circumferential surface of the conductive substrate 11 but this is not limitative, the photosensitive layer 14 may also have a constitution in which the charge transporting layer 16 and the charge generating layer 15 are stacked in this order on the outer surface of the conductive substrate 11.

Figure 5:
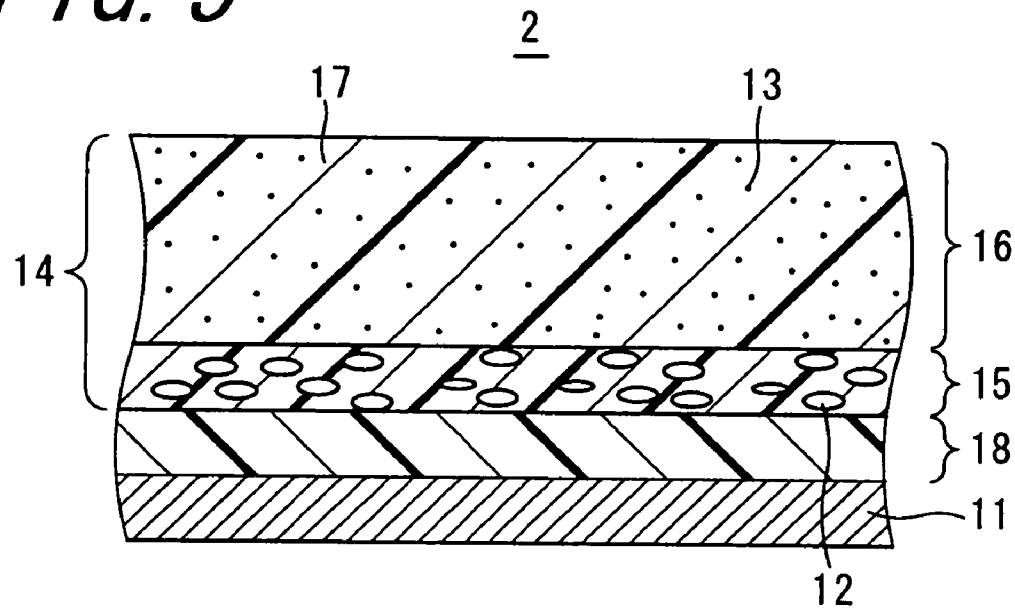
FIG. 5 is a schematic cross sectional view schematically showing the constitution of an electrophotographic photoreceptor 2 according to a second embodiment of the invention.

FIG. 5 is a schematic cross sectional view schematically showing the constitution of an electrophotographic photoreceptor 2 according to a second embodiment of the invention. The electrophotographic photoreceptor 2 in this embodiment is similar with the electrophotographic photoreceptor 1 of the first embodiment, so that corresponding components will be denoted by the same reference numerals, and description thereof will be omitted.

What is to be noted in the electrophotographic photoreceptor 2 is that an undercoat layer 18 is disposed between a conductive substrate 11 and a photosensitive layer 14.

This can prevent injection of charges from the conductive substrate 11 to the photosensitive layer 14 and can improve the charge blocking property. Accordingly, this can prevent lowering of the chargeability of the photosensitive layer 14, suppress the decrease of the surface charges in the portions other than the portion to be erased by exposure and prevent occurrence of defects such as fogging in the images to be formed. Further, this can suppress peeling of the photosensitive layer 14 from the conductive substrate 11 and improve the adhesion between the conductive substrate 11 and the photosensitive layer 14.

For the undercoat layer 18, a layer containing a resin as a main ingredient is often used. Since the photosensitive layer 14 disposed to the outer circumferential surface of the undercoat layer 18 is formed by using the solvent as described above, it is preferred that the resin constituting the undercoat layer 18 is a resin less soluble to an organic solvent used generally upon forming the photosensitive layer 14. Such a resin can include, for example, water soluble resins such as polyvinyl alcohol, casein and sodium polyacrylate, alcohol soluble resins such as copolymerized nylon and methoxymethylated nylon, as well as curable resins forming three-dimensional network structures such as acryl resin, polyurethane, melamine resin, phenol resin, and epoxy resin.

For the undercoat layer 18, a fine pigment powder of metal oxides such as titanium oxide, silica, alumina, zirconium oxide, tin oxide or indium oxide may be added. Addition of the metal oxide can prevent accumulation of charges to the undercoat layer 18 and decrease the increase of the residual potential on the photoreceptor by repetitive use. Further, this can prevent occurrence of interference fringe referred to as moire to the images.

The undercoat layer 18 is formed, for example, by dissolving or dispersing the resin described above into an appropriate solvent to prepare a coating solution for undercoat layer and coating the outer circumferential surface of the conductive substrate 11 with the coating solution. In a case of adding the fine pigment powder of the metal oxide described above to the undercoat layer 18, the undercoat layer 18 can be formed by dissolving or dispersing the resin and the fine pigment powder of the metal oxide described above into an appropriate solvent to prepare a coating solution for undercoat layer and coating the outer circumferential surface of the conductive substrate 11 with the coating solution.

As the solvent of the coating solution for undercoat layer, a same solvent as that used in the coating solution for charge generating layer described above can be used.

As the method of dissolving or dispersing the resin and the fine pigment powder of the metal oxide into the solvent, a general method of using a ball mill, sand mill, attritor, vibration mill, colloid mill or supersonic wave dispersing machine can be applied. As the coating method of the coating solution for undercoat layer, a general method such as a dip coating method, spray method, bead method or nozzle method can be applied.

The thickness of the undercoat layer 18 is, preferably, 0.1 μm or more and 20 μm or less and, more preferably, 1 μm or more and 5 μm or less. In a case where the thickness of the undercoat layer 18 is less than 0.1 μm, it no more functions substantially as the undercoat layer 18, can not obtain uniform surface property and cover the defects on the conductive substrate 11, so that injection of charges from the conductive substrate 11 to the photosensitive layer 14 can no more be prevented to lower the chargeability of the photosensitive layer 14. Increase of the thickness of the undercoat layer 18 to more than 20 μm is not preferred since this makes it difficult to uniformly form the undercoat layer 18 to lower the mechanical strength of the formed undercoat layer 18 and lower the sensitivity in a case of forming the undercoat layer 18 by the dip coating method.

Figure 6:
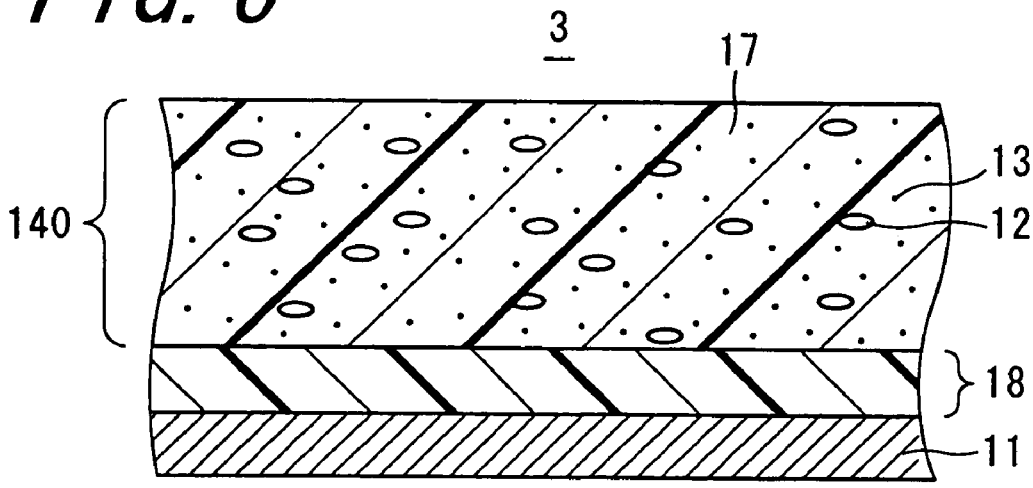
FIG. 6 is a partial cross sectional view schematically showing the constitution of an electrophotographic photoreceptor 3 according to a third embodiment of the invention.

FIG. 6 is a fragmentary cross sectional view schematically showing the constitution of an electrophotographic photoreceptor 3 according to a third embodiment of the invention. The electrophotographic photoreceptor 3 in this embodiment is similar to the electrophotographic photoreceptor 1 of the first embodiment, so that corresponding components will be denoted by the same reference numerals, and description thereof will be omitted.

What is to be noted in the electrophotographic photoreceptor 3 is that the photoreceptor has a single layer type photosensitive layer 140 constituted by a single layer containing a charge generating substance 12 containing oxotitanium phthalocyanine having the specified crystal form described above, two or more kinds of metal phthalocyanine containing oxotitanium phthalocyanine, or non-metal phthalocyanine, and a charge transporting substance 13 containing the enamine compound represented by the general formula (1). That is, the electrophotographic photoreceptor 3 is a single layer type photoreceptor.

Like the electrophotographic photoreceptor 1 of the first embodiment described above, the photosensitive layer 140 of the electrophotographic photoreceptor 3 of this embodiment contains oxotitanium phthalocyanine having a specified crystal form showing, in the X-ray diffraction spectrum, a diffraction peak at the Bragg angle 2θ (error: 2θ±0.2°) of 27.2°, two or more kinds of metal phthalocyanine containing oxotitanium phthalocyanine, or non-metal phthalocyanine as the charge generating substance 12 and the enamine compound represented by the general formula (1) as the charge transporting substance 13. Accordingly, like the first embodiment, an electrophotographic photoreceptor 3 showing high responsivity even under the low temperature low humidity circumstance can be obtained. Further, the decrease of the size and increase of the image forming speed of the electrophotographic apparatus can be compatibilized by the use of the electrophotographic photoreceptor 3 and it is possible to attain a highly reliable electrophotographic apparatus decreased in the size, having a high image forming speed, and capable of providing images at high quality under various circumstances such as the low temperature and low humidity circumstance.

The photosensitive layer 140 is formed in a state where the charge generating substance 12 and the charge transporting substance 13 are bonded to the binder resin 17. The photosensitive layer 140 is formed, for example, by dissolving or dispersing the charge generating substance 12 containing oxotitanium phthalocyanine having the specified crystal form, two or more kinds of metal phthalocyanine containing oxotitanium phthalocyanine, or non-metal phthalocyanine, the charge transporting substance 13 containing the enamine compound represented by the general formula (1), and the binder resin 17 into an appropriate solvent identical with the solvent used in the coating solution for charge generating layer described above to prepare a coating solution for photosensitive layer, and coating the outer circumferential surface of the conductive substrate 11 with the coating solution by using the same method as the coating method of the coating solution for charge generating layer described above.

The ratio A'/B' between the weight A' of the charge transporting substance 13 and the weight B' for the binder resin 17 in the photosensitive layer 140 is preferably 2/3 or less in the same manner as the ratio A/B between the weight A for the charge transporting substance 13 and the weight B for the binder resin 17 in the charge transporting layer 16 of the photoreceptor 1 of the first embodiment. Further, in a case of forming the photosensitive layer 140 by the dip coating method, the ratio A/B is preferably 1/3 or more.

The thickness of the photosensitive layer 140 is, preferably, 5 μm or more and 50 μm or less, more preferably, 5 μm or more and 40 μm or less and, further preferably, 10 μm or more and 40 μm or less. In a case where the thickness of the photosensitive layer 140 is less than 5 μm, the chargeability on the surface of the photoreceptor is lowered. In a case where the thickness of the photosensitive layer 140 exceeds 50 μm, the productivity is lowered. Accordingly, this is defined as 5 μm or more and 50 μm or less.

On the outer circumferential surface of the photosensitive layer 14 or 140 disposed to the electrophotographic photoreceptor 1, 2, or 3 of the first to third embodiments described above, a protective layer may also be provided for protecting the surface of the photosensitive layer 14 or 140. For the protective layer, a layer comprising, for example, a thermoplastic resin, photocurable resin, or thermosetting resin is used. The protective layer may also contain a UV-ray inhibitor, an antioxidant, an inorganic materials such as a metal oxide, and an organic metal compound or an electron accepting material.

For the photosensitive layer 14 or 140 and the surface protective layer, a plasticizer such as dibasic acid ester, for example, phthalate ester, fatty acid ester, phosphate ester or chlorinated paraffin may also be added. This can improve the fabricability. Further, the photosensitive layer 14 or 140 or the surface protective layer may be provided with flexibility to improve the mechanical characteristics.

Further, for the photosensitive layer 14 or 140 and the surface protective layer, a leveling agent such as silicone resin may also be added. This can improve the surface smoothness.

Figure 7:
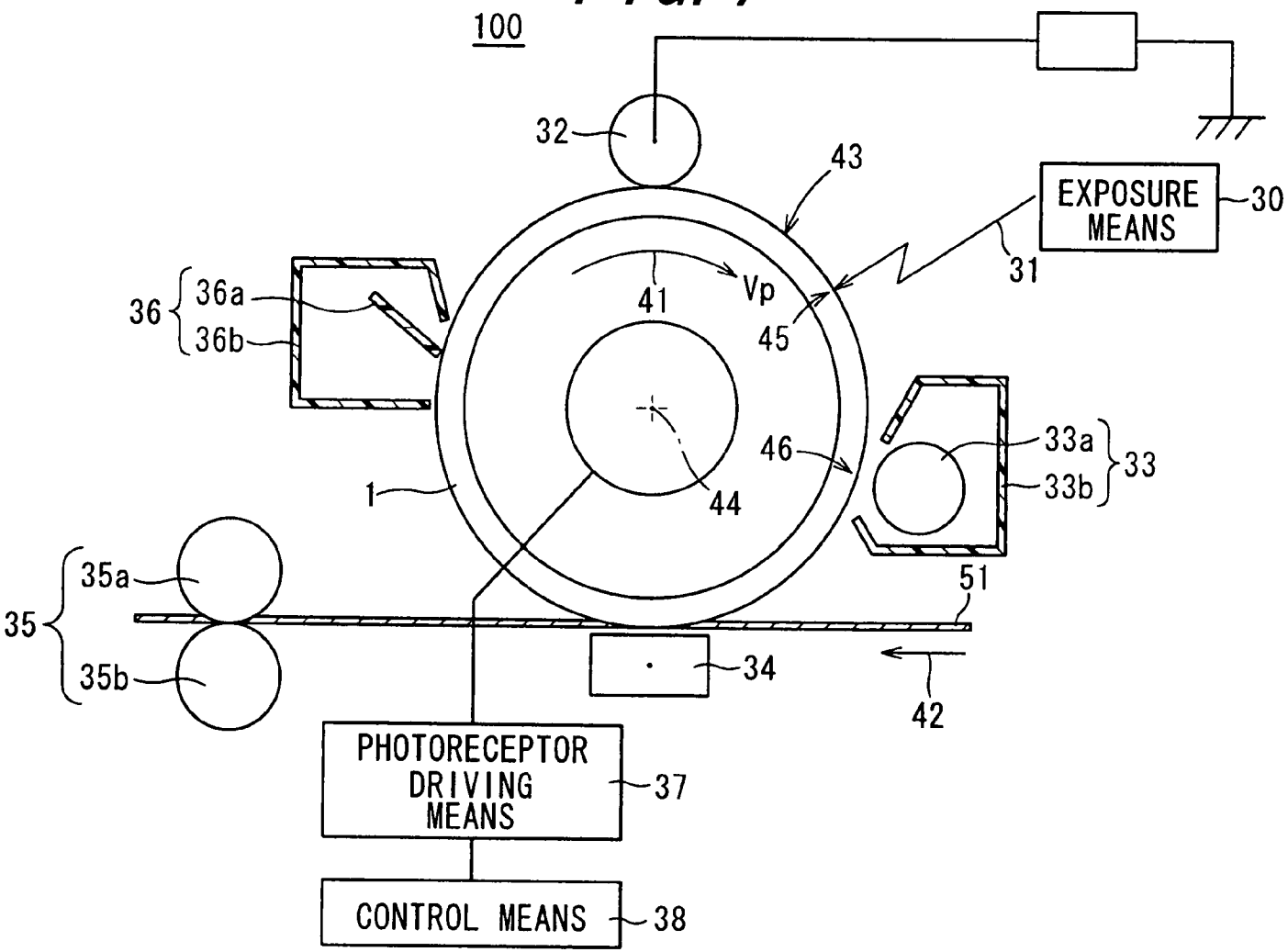
FIG. 7 is a view for the arrangement on a lateral side schematically showing the constitution of an electrophotographic apparatus 100 according to a fourth embodiment of the invention.

As an electrophotographic apparatus according to a fourth embodiment of the invention, an electrophotographic apparatus 100 having the electrophotographic photoreceptor 1 (photoreceptor 1) of the first embodiment described previously is shown. FIG. 7 is a side elevational view for the arrangement schematically showing the constitution of the electrophotographic apparatus 100.

The electrophotographic apparatus 100 includes a photoreceptor 1 rotatably supported to an apparatus main body (not shown), photoreceptor driving means 37 for rotational driving the photoreceptor 1 around a rotational axis 44 in the direction of an arrow 41, and control means 38 for controlling the operation of the photoreceptor driving means 37. The photoreceptor driving means 37 has, for example, a motor as a power source and rotationally drives the photoreceptor 1 at a rotational circumferential speed of Vb by transmitting the power from the motor by way of gears (not shown) to a support constituting the core of the photoreceptor 1.

Around the periphery of the photoreceptor 1, a charger 32, exposure means 30, a developing device 33, a transfer device 34, and a cleaner 36 are arranged in this order from the upstream to the downstream in the rotational direction of the photoreceptor 1 shown by an arrow 41. The cleaner 36 is disposed together with a charge eliminator (not shown).

The charger 32 is charging means for charging the outer circumferential surface 43 of the photoreceptor 1 to a predetermined potential. The charger 32 is, for example, contact type charging means such as a roller charging system.

The exposure means 30 has, for example, a semiconductor laser as a light source and applies exposure in accordance with image information to the charged outer circumferential surface 43 of the photoreceptor 1 by irradiating the outer circumferential surface 43 of the photoreceptor 1 situated between the charger 32 and the developing device 33 with light 31 such as a laser beam outputted from a light source.

The developing device 33 is developing means for developing electrostatic latent images formed by exposure at the outer circumferential surface 43 of the photoreceptor 1 by a developer, and includes a developing roller 33*a* for supplying a toner to the outer circumferential surface 43 of the photoreceptor 1 disposed being opposed to the photoreceptor 1, and a casing 33*b* for rotatably supporting the developing roller 33*a* around a rotational axis in parallel with the rotational axis 44 of the photoreceptor 1 and housing the developer containing the toner in the inner space thereof.

The transfer device 34 is transfer means of transferring toner images as visible images formed by developing at the outer circumferential surface 43 of the photoreceptor 1 by conveying means (not shown) onto a transfer paper 51 as a recording medium supplied by conveying means (not shown) in a direction of an arrow 42 to a position between the photoreceptor 1 and the transfer device 34 and the transfer device 34 has, for example, charging means, which is non-contact type transfer means for giving electric charges at a polarity opposite to that of the toner to the transfer paper 51 and thereby transferring the toner images to the transfer paper 51.

The cleaner 36 is cleaning means for removing and recovering a toner remained on the outer circumferential surface 43 of the photoreceptor 1 after transfer operation by the transfer device 34, and includes a cleaning blade 36*a* for peeling the toner remaining on the outer circumferential surface 43 of the photoreceptor 1 from the outer circumferential surface 43 and a recovery casing 36*b* for containing the toner peeled by the cleaning blade 36*a*.

Further, a fixing device 35 as fixing means for fixing transferred images is provided in the direction along which the transfer paper 51 is conveyed after passage between the photoreceptor 1 and the transfer device 34. The fixing device 35 has a heating roller 35*a* having heating means (not shown), and a press roller 35*b* opposed to the heating roller 35*a* and pressed to the heating roller 35*a* to form an abutment portion.

The diameter of the photoreceptor 1 is preferably 24 mm or more and 40 mm or less. This can decrease the size of the electrophotographic apparatus 100.

A method of forming electrophotographic images according to an embodiment of the invention includes a step of charging the surface of an electrophotographic photoreceptor, a step of applying exposure to the charged surface of the electrophotographic photoreceptor to form electrostatic latent images, and a step of developing the formed electrostatic latent images, in which an electrophotographic photoreceptor according to the invention is used as the electrophotographic photoreceptor. The electrophotographic image forming method is practiced by the electrophotographic apparatus 100 of this embodiment.

The operation of the electrophotographic apparatus 100 is to be described. At first, when the photoreceptor 1 is driven rotationally by the photoreceptor driving means 37 in the direction of an arrow 41, the outer circumferential surface 43 of the photoreceptor 1 is uniformly charged to a predetermined positive or negative potential by the charger 32 disposed to the upstream in the rotational direction of the photoreceptor 1 with respect to the focusing point of a light 31 from the exposure means 30.

Then, the outer circumferential surface 43 of the photoreceptor 1 is irradiated with the light 31 from the exposure means 30. The light from the light source is scanned repetitively in the longitudinal direction of the photoreceptor 1 as the main scanning direction. Exposure is applied in accordance with the image information to the outer circumferential surface 43 of the photoreceptor 1 by rotationally driving the photoreceptor 1 and scanning the light 31 from the light source repetitively. By exposure, a difference is caused between the surface potential at a portion irradiated with the light 31 and the surface potential at a portion not irradiated with the light 31, to form electrostatic latent images to the outer circumferential surface 43 of the photoreceptor 1.

Then, electrostatic latent images are developed by supplying a toner from the developing roller 33*a* of the developing device 33 disposed to the downstream in the rotational direction of the photoreceptor 1 with respect to the focusing point of the light 31 form the light source to the outer circumferential surface 43 of the photoreceptor 1 formed with the electrostatic latent images and toner images are formed on the outer circumferential surface 43 of the photoreceptor 1.

Further, in synchronization with the exposure to the photoreceptor 1, the transfer paper 51 is supplied by the conveying means to a position between the photoreceptor 1 and the transfer device 34 in the direction of the arrow 42. When the transfer paper 51 is supplied between the photoreceptor 1 and the transfer device 34, the transfer device 34 gives electric charges at a polarity opposite to the polarity of the toner to the transfer paper 51. Thus, toner images formed on the outer circumferential surface 43 of the photoreceptor 1 are transferred onto the transfer paper 51.

The transfer paper 51 transferred with the toner images is conveyed by the conveying means to the fixing device 35 and heated and pressurized upon passage through an abutment portion between the heating roller 35*a* and the pressure roller 35*b* of the fixing device 35. Thus, the toner images on the transfer paper 51 is fixed to form firm images on the transfer paper 51. The transfer paper 51 thus formed with the images is discharged by the conveying means to the outside of the electrophotographic apparatus 100.

On the other hand, the toner remaining on the outer circumferential surface 43 of the photoreceptor 1 after the transferring operation by the transfer device 34 is separated by the cleaning blade 36*a* of the cleaner 36 from the outer circumferential surface 43 of the photoreceptor 1 and recovered in the recovery casing 36*b*. The charges on the outer circumferential surface 43 of the photoreceptor 1 removed with the toner is thus eliminated by the charge eliminator by which the electrostatic latent images on the outer circumferential surface 43 of the photoreceptor 1 disappear. Then the photoreceptor 1 is further driven rotationally and a series of operations starting from the charging of the photoreceptor 1 are repeated. As described above, images are formed continuously.

In this case, the operation of the photoreceptor driving means 37 is controlled by the control means 38 such that the value d obtained by dividing the distance L from an exposure position 45 by the exposure means 30 corresponding to the focusing point of the light 31 to a developing position 46 by the developing device 33 along the outer circumferential surface 43 of the photoreceptor 1 with the rotational circumferential speed Vp (=L/Vp) is 90 msec or less. For example, in a case of using a photoreceptor 1 having a small size for the distance L with the diameter of 24 mm or more and 40 mm or less, it is controlled such that the rotational circumferential speed Vp increases.

The value d is substantially equal with the time from the start of the exposure by the exposure means 30 to the outer circumferential surface 43 of the photoreceptor 1 to the completion of the development for the electrostatic latent images by the developing device 33. Accordingly, the time from the start of the exposure by the exposure means 30 to the outer circumferential surface 43 of the photoreceptor 1 to the completion of the development for the electrostatic latent images by the developing device 33 is as short as 90 msec or less. That is, since the electrophotographic process is conducted at a high speed in this embodiment, an electrophotographic apparatus 100 having high image forming speed can be obtained.

As in a case where the time from the start of exposure to the outer circumferential surface 43 of the photoreceptor 1 by the exposure means 30 to the completion of the development for the electrostatic latent images by the developing device 33 is short, the responsivity of the photoreceptor is lowered under low temperature and low humidity circumstance to sometimes deteriorate image quality.

However, since the electrophotographic apparatus 100 of this embodiment has a photoreceptor 1 having a photosensitive layer 14 containing oxotitanium phthalocyanine having the specified crystal form as described above, two or more kinds of metal phthalocyanine containing oxotitanium phthalocyanine, or non-metal phthalocyanine and showing high responsivity even under the low temperature and low humidity condition, images at high quality can be provided under various circumstances such as under the low temperature and low humidity circumstance even in a case where the time from the start of the exposure to the outer circumferential surface 43 of the photoreceptor 1 by the exposure means 30 to the completion for the development of electrostatic latent images by the developing device 33 is short. Accordingly, it is possible to obtain an electrophotographic apparatus 100 of high reliability, having high image forming speed, and capable of providing images at high quality under various circumstances such as the low temperature and low humidity circumstance.

As has been described above, while the electrophotographic apparatus 100 according to this embodiment has an electrophotographic photoreceptor 1 according to a first embodiment, this is not restrictive and a electrophotographic photoreceptor 2 of the second embodiment and an electrophotographic photoreceptor 3 of the third embodiment can also be provided.

Further, while the charger 32 is contact type charging means, it is not restrictive and non-contact type charging means such as a corona charging system may also be used.

Further, while the transfer device 34 is non-contact type transfer means having charging means and for transferring toner images onto the transfer paper 51 by applying charges at a polarity opposite to that of the toner to the transfer paper 51, this is not limitative and may also be contact type transfer means having a roller and for transferring toner images to the transfer paper 51 by bringing the transfer paper 51 and the electrophotographic photoreceptor 1 in press contact with each other by using rollers.

Further, while the charger 32, the exposure means 30 and the developing device 33 are provided each by one on the periphery of the photoreceptor 1, they are not limitative and second charging means, second exposure means and second developing means may further provided to the portion between the developing device 33 and the transfer device 34. Since this enables to form a toner images of a first color by the charger 32, the exposure means 30 and the developing device 33, and form toner images of a color different from the first color by the second charging means, the second exposure means and the second developing means between the developing device 33 and the transfer device 34, it is possible to attain an electrophotographic apparatus capable of forming multicolor images on the transfer paper 51.

EXAMPLES

The invention is to be described more specifically by using examples but the invention is not restricted to the description.

Preparation Example

Production Example 1

Production of Compound No. 1

Production Example 1-1

Production of Enamine Intermediate 23.3 g (1.0 equivalent) of N-(p-tolyl)-α-naphthylamine of the following structural formula (8), 20.6 g (1.05 equivalents) of diphenylacetaldehyde of the following structural formula (9), and 0.23 g (0.01 equivalent) of DL-10-camphorsulfonic acid were added to 100 ml of toluene and heated, and these were reacted for 6 hours while the side-product, water was removed out of the system through azeotropic distillation with toluene. After thus reacted, the reaction solution was concentrated to about 1/10, and gradually and dropwise added to 100 ml of hexane that was vigorously stirred, and this gave a crystal. The crystal was taken out through filtration, and washed with cold ethanol to obtain 36.2 g of a pale yellow powdery compound.

(8)

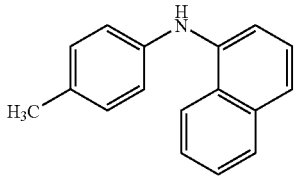

(9)

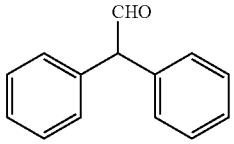

Thus obtained, the compound was analyzed through liquid chromatography-mass spectrometry (LC-MS), which gave a peak at 412.5 corresponding to the molecular ion $[M+H]^+$ of an enamine intermediate (calculated molecular weight: 411.20) of the following structural formula (10) with a proton added thereto. This confirms that the compound obtained herein is the enamine intermediate represented by the structural formula (10) (yield: 88%). In addition, the data of LC-MS further confirm that the purity of the enamine intermediate obtained herein is 99.5%.

(10)

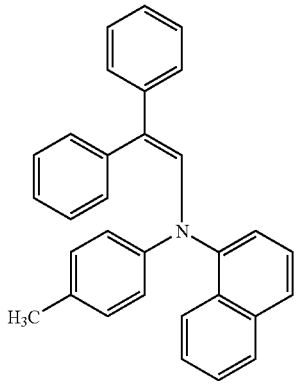

As in the above, the dehydrating condensation of N-(p-tolyl)-α-naphthylamine, a secondary amine represented by the structural formula (8), and diphenylacetaldehyde, an aldehyde compound represented by the structural formula (9) gives the enamine intermediate the structural represented by formula (10).

Production Example 1-2

Production of Enamine-Aldehyde Intermediate 9.2 g (1.2 equivalents) of phosphorus oxychloride was gradually added to 100 ml of anhydrous N,N-dimethylformamide (DMF) and stirred for about 30 minutes to prepare a Vilsmeier reagent. 20.6 g (1.0 equivalent) of the enamine intermediate represented by the structural formula (10) obtained in Production Example 1-1 was gradually added to the solution with cooling with ice. Next, this was gradually heated up to 80° C., and stirred for 3 hours while kept heated at 80° C. After thus reacted, the reaction solution was left cooled, and then this was gradually added to 800 ml of cold 4 N aqueous sodium hydroxide solution to form a precipitate. Thus formed, the precipitate was collected through filtration, well washed with water, and then recrystallized from a mixed solvent of ethanol and ethyl acetate to obtain 20.4 g of an yellow powdery compound.

Thus obtained, the compound was analyzed through LC-MS, which gave a peak at 440.5 corresponding to the molecular ion $[M+H]^+$ of an enamine-aldehyde intermediate (calculated molecular weight: 439.19) of the following structural formula (11) with a proton added thereto. This confirms that the compound obtained herein is the enamine-aldehyde intermediate represented by the structural formula (11) (yield: 93%). In addition, the data of LC-MS further confirm that the purity of the enamine-aldehyde intermediate obtained herein is 99.7%.

(11)

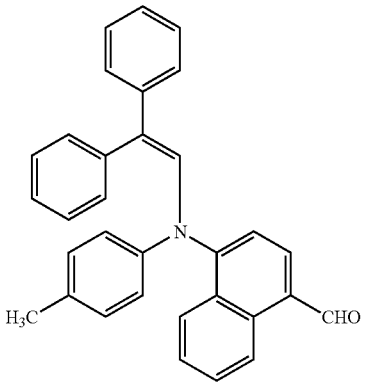

As in the above, the formylation of the enamine intermediate represented by the structural formula (10) through Vilsmeier reaction gives the enamine-aldehyde intermediate represented by the structural formula (11).

Production Example 1-3

Production of Compound No. 1

8.8 g (1.0 equivalent) of the enamine-aldehyde intermediate represented by the structural formula (11) obtained in Production Example 1-2, and 6.1 g (1.2 equivalents) of diethyl cinnamylphosphonate of the following structural formula (12) were dissolved in 80 ml of anhydrous DMF, and 2.8 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 10.1 g of an yellow crystal.

(12)

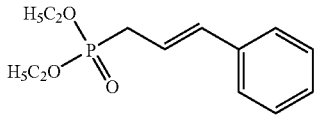

Thus obtained, the crystal was analyzed through LC-MS, which gave a peak at 540.5 corresponding to the molecular ion $[M+H]^+$ of the intended enamine compound, Compound No. 1 in Table 1 (calculated molecular weight: 539.26) with a proton added thereto.

Figure 8:
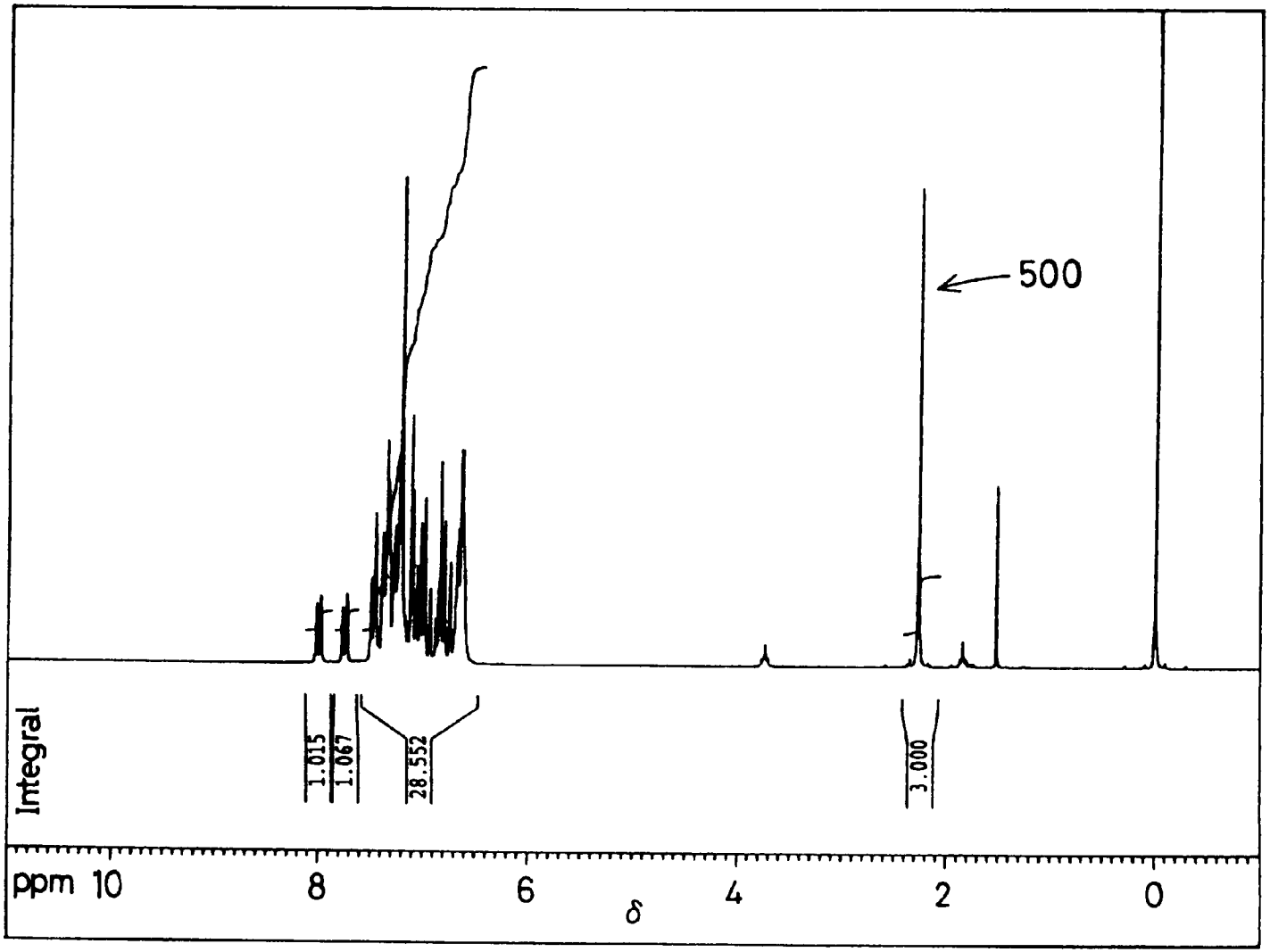
FIG. 8 is the $^{1}$H-NMR spectrum of the product in this Production Example 1-3.
Figure 9:
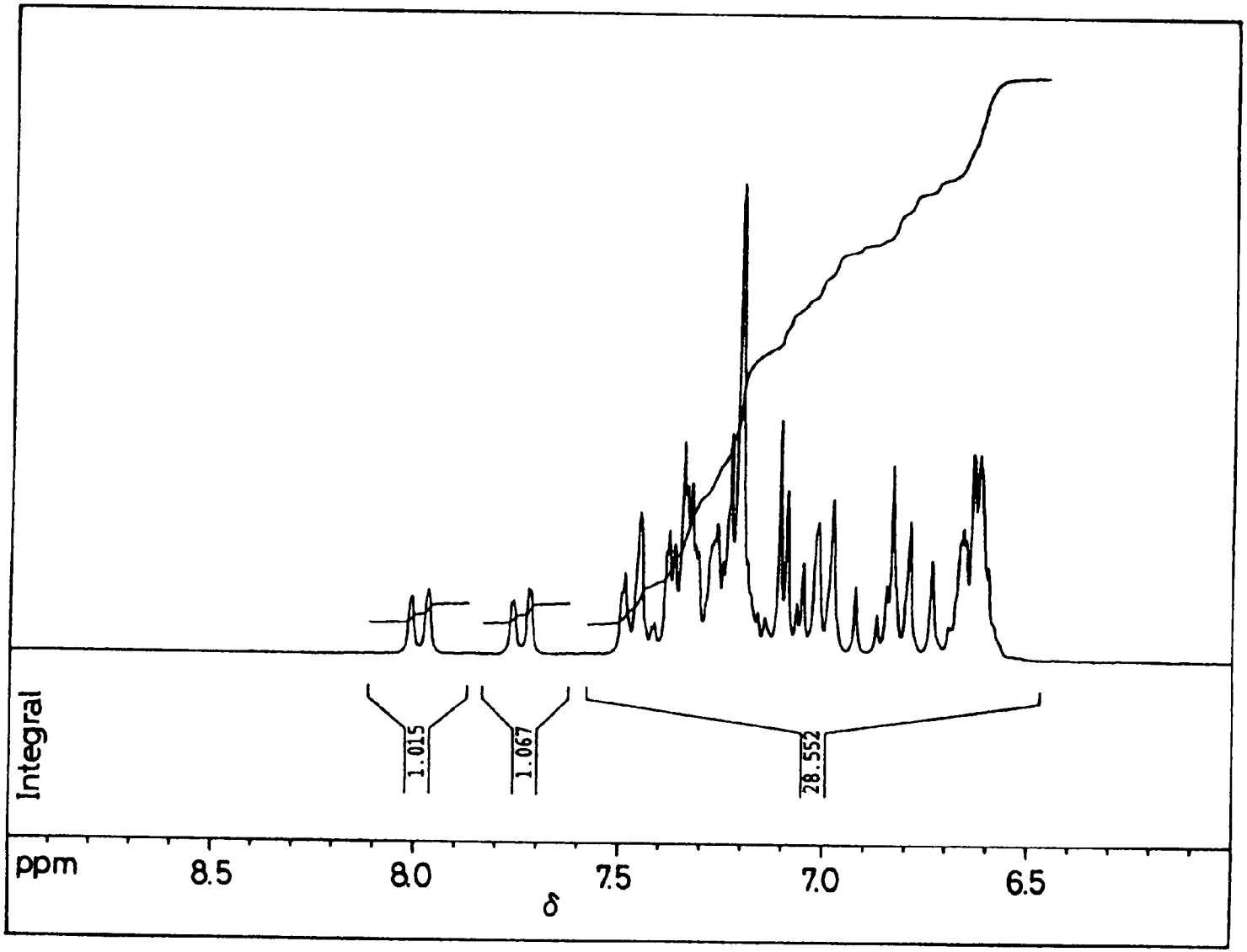
FIG. 9 is an enlarged view of the spectrum of FIG. 8 in the range of from 6 ppm to 9 ppm.
Figure 10:
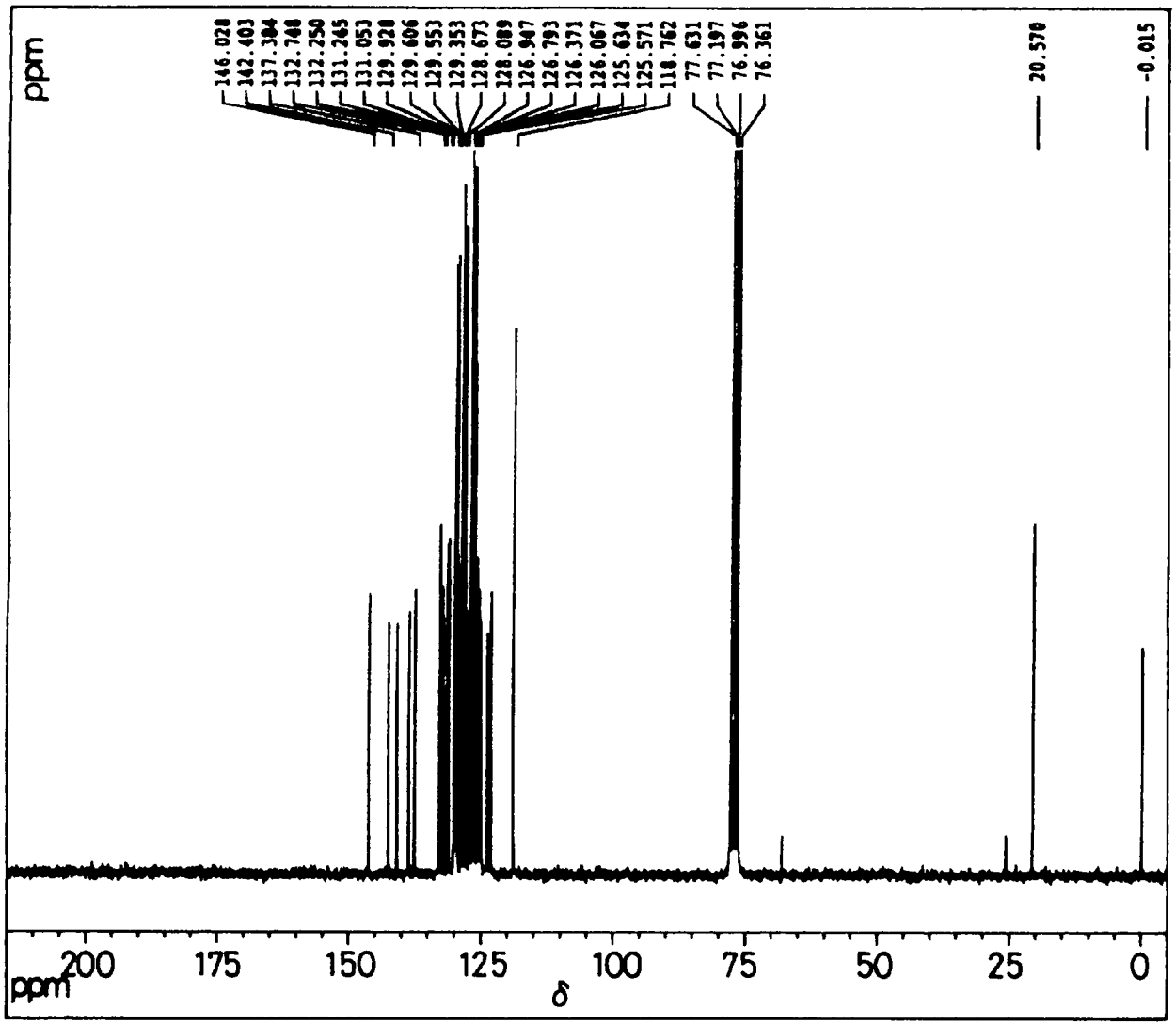
FIG. 10 is the $^{13}$C-NMR spectrum in ordinary measurement of the product in Production Example 1-3.
Figure 11:
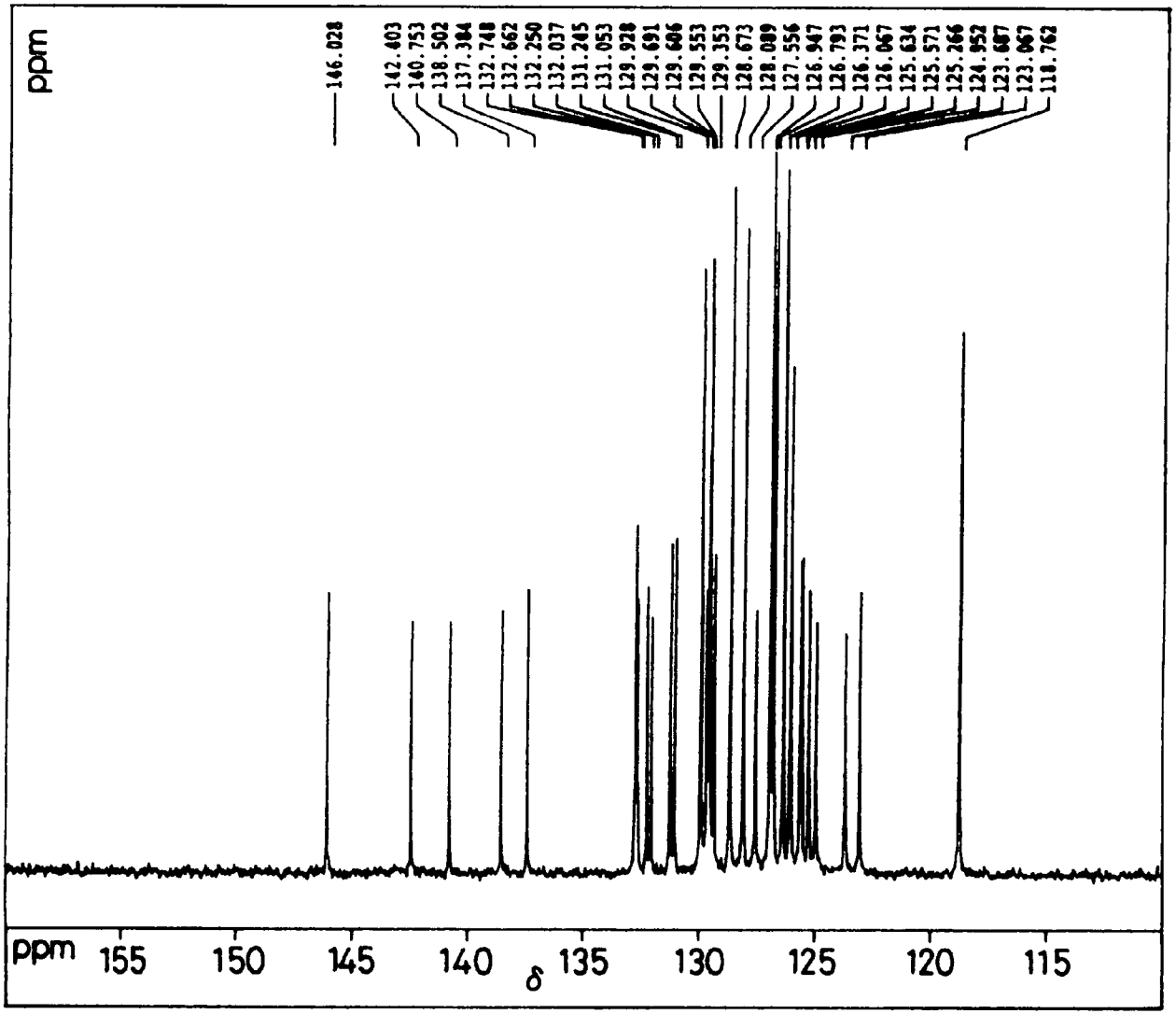
FIG. 11 is an enlarged view of the spectrum of FIG. 10 in the range of from 110 ppm to 160 ppm.
Figure 12:
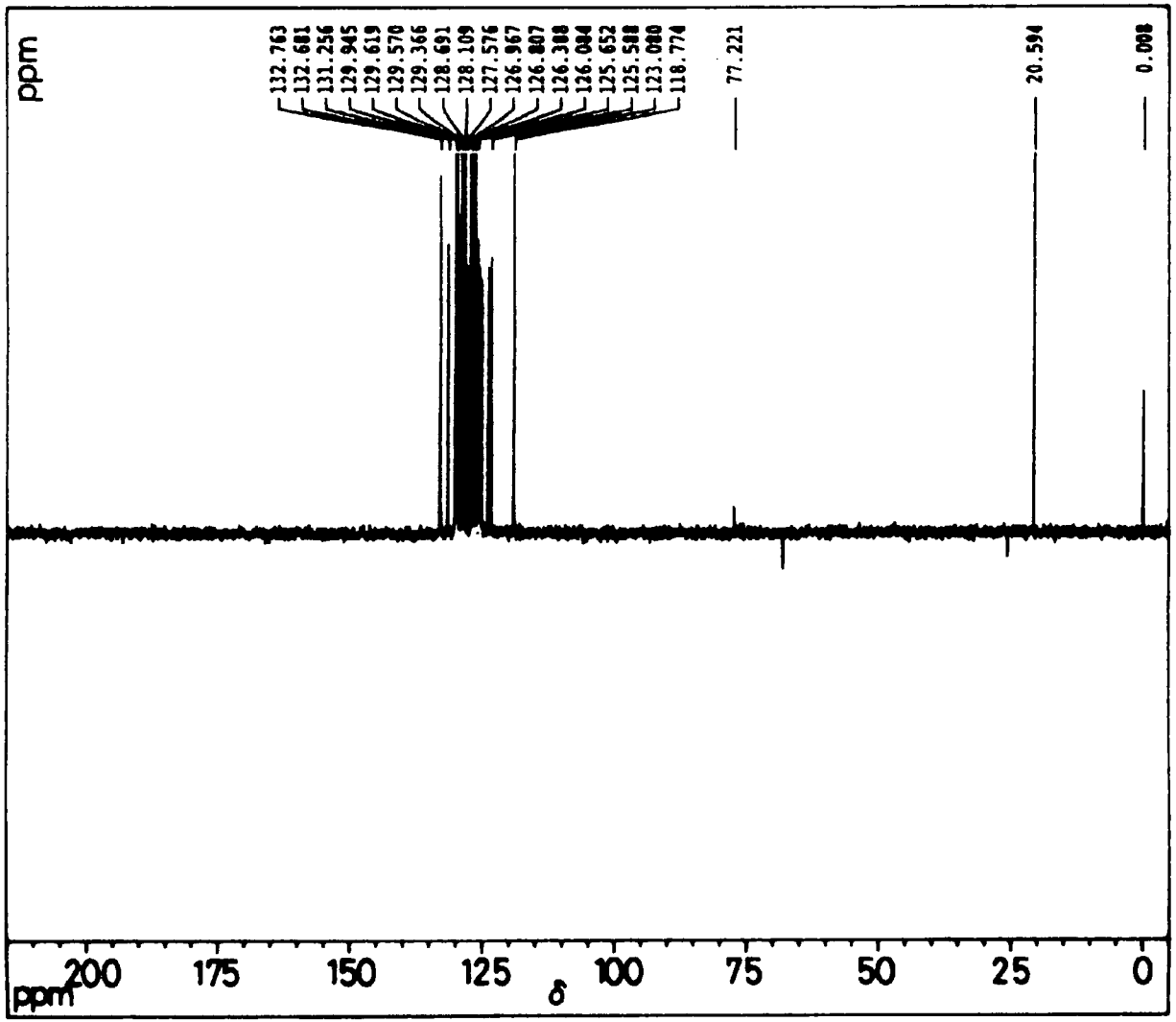
FIG. 12 is the $^{13}$C-NMR spectrum in DEPT135 measurement of the product in Production Example 1-3.
Figure 13:
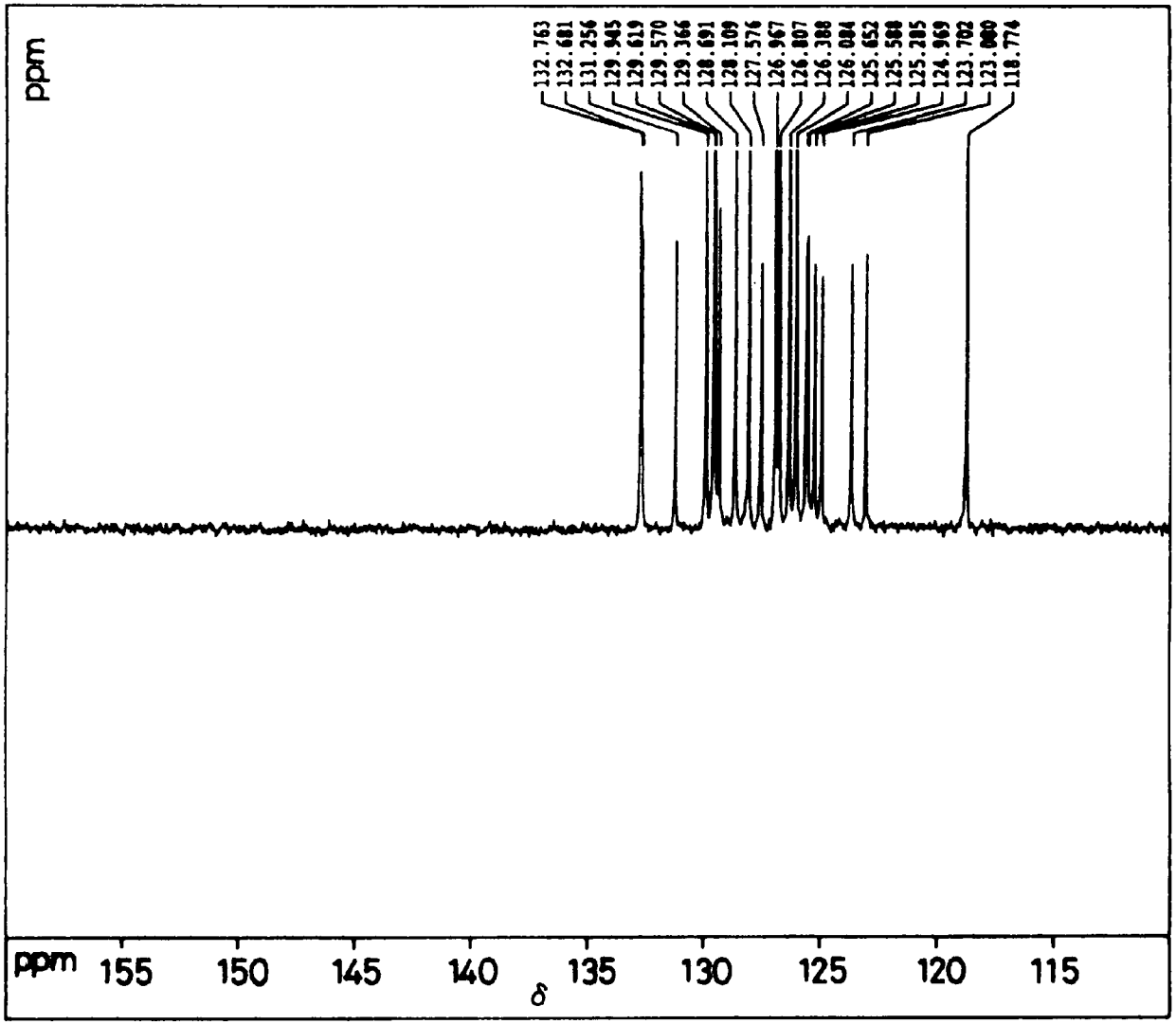
FIG. 13 is an enlarged view of the spectrum of FIG. 12 in the range of from 110 ppm to 160 ppm.

The nuclear magnetic resonance (NMR) spectrum of the crystal in heavy chloroform (chemical formula: $CDCl_3$) was measured, and this spectrum supports the structure of the enamine compound, Compound No. 1. FIG. 8 is the $^1$H-NMR spectrum of the product in this Production Example 1-3, and FIG. 9 is an enlarged view of the spectrum of FIG. 8 in the range of from 6 ppm to 9 ppm. FIG. 10 is the $^{13}$C-NMR spectrum in ordinary measurement of the product in Production Example 1-3, and FIG. 11 is an enlarged view of the spectrum of FIG. 10 in the range of from 110 ppm to 160 ppm. FIG. 12 is the $^{13}$C-NMR spectrum in DEPT135 measurement of the product in Production Example 1-3, and FIG. 13 is an enlarged view of the spectrum of FIG. 12 in the range of from 110 ppm to 160 ppm. In FIG. 8 to FIG. 13, the horizontal axis indicates the chemical shift δ (ppm) of the compound analyzed. In FIG. 8 and FIG. 9, the data written between the signals and the horizontal axis are relative integral values of the signals based on the integral value, 3, of the signal indicated by the reference numeral 500 in FIG. 8.

The data of LC-MS and the NMR spectrometry confirm that the crystal obtained herein is the enamine compound, Compound No. 1 (yield: 94%). In addition, the data of LC-MS further confirm that the purity of the enamine compound, Compound No. 1 obtained herein is 99.8%.

As in the above, the Wittig-Horner reaction of the enamine-aldehyde intermediate represented by the structural formula (11) and the Wittig reagent, diethyl cinnamylphosphonate represented by the structural formula (12) gives the enamine compound, Compound No. 1 shown in Table 1.

Production Example 2

Production of Compound No. 61

In the same manner as in Production Example 1 except that 4.9 g (1.0 equivalent) of N-(p-methoxyphenyl)-α-naphthylamine was used in place of 23.3 g (1.0 equivalent) of N-(p-tolyl)-α-naphthylamine represented by the structural formula (8), an enamine intermediate was produced (yield: 94%) through dehydrating condensation and an enamine-aldehyde intermediate was produced (yield: 85%) through Vilsmeier reaction, and this was further subjected to Wittig-Horner reaction to obtain 7.9 g of an yellow powdery compound. The equivalent relationship between the reagent and the substrate used in each reaction was the same as that in Production Example 1.

Thus obtained, the compound was analyzed through LC-MS, which gave a peak at 556.7 corresponding to the molecular ion $[M+H]^+$ of the intended enamine compound, Compound No. 61 in Table 9 (calculated molecular weight: 555.26) with a proton added thereto.

Figure 14:
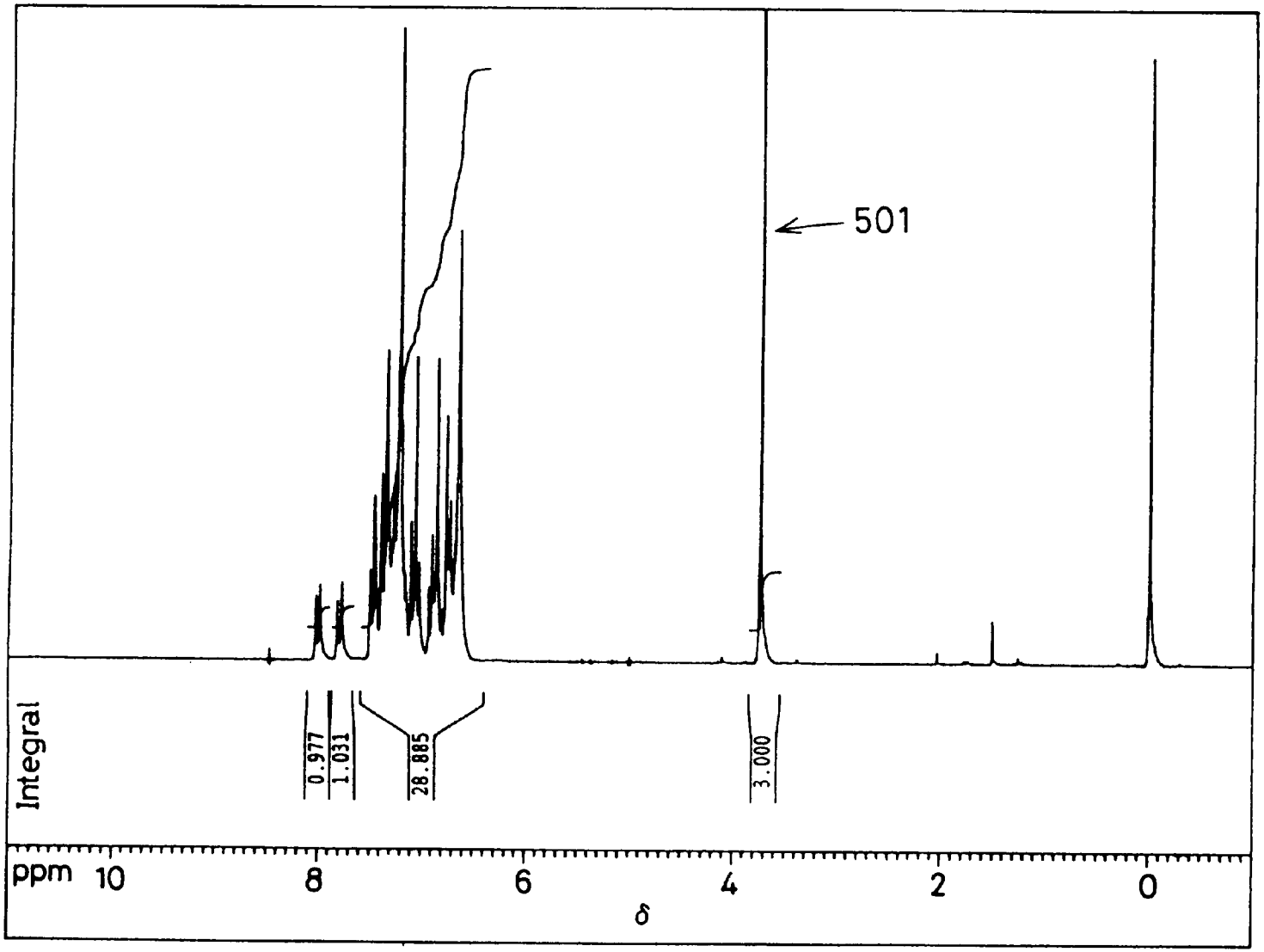
FIG. 14 is the $^{1}$H-NMR spectrum of the product in this Production Example 2.
Figure 15:
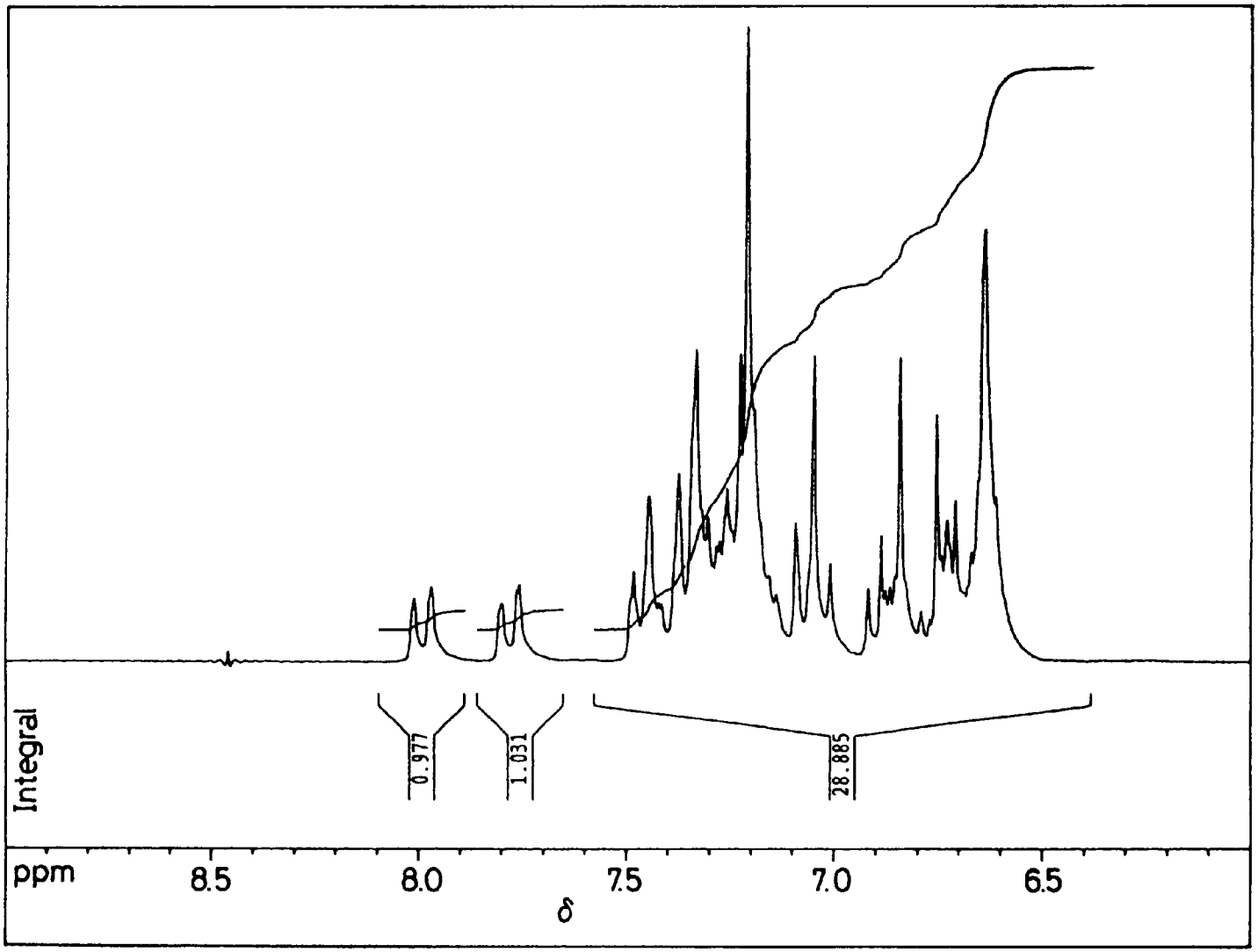
FIG. 15 is an enlarged view of the spectrum of FIG. 14 in the range of from 6 ppm to 9 ppm.
Figure 16:
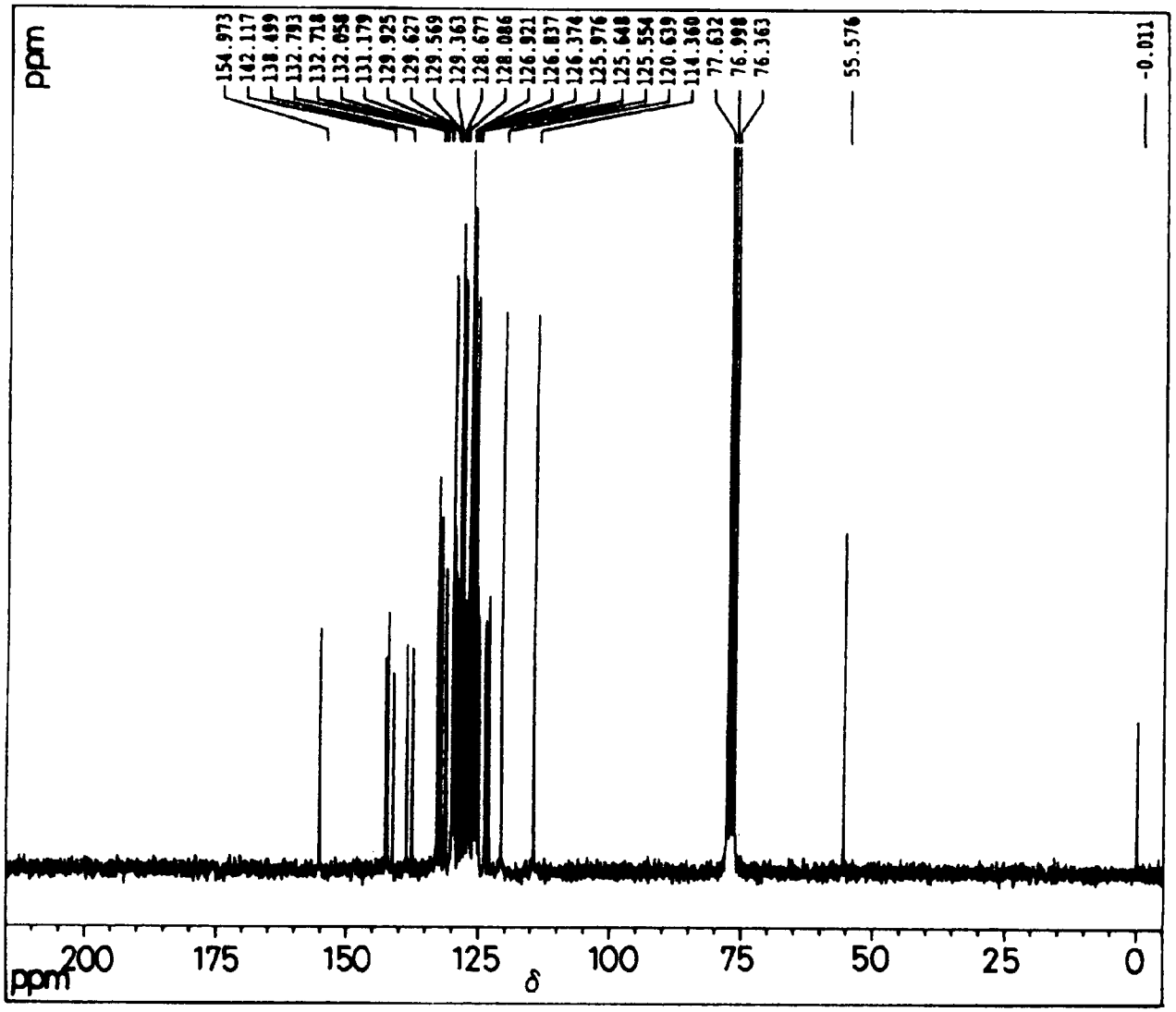
FIG. 16 is the $^{13}$C-NMR spectrum in ordinary measurement of the product in Production Example 2.
Figure 17:
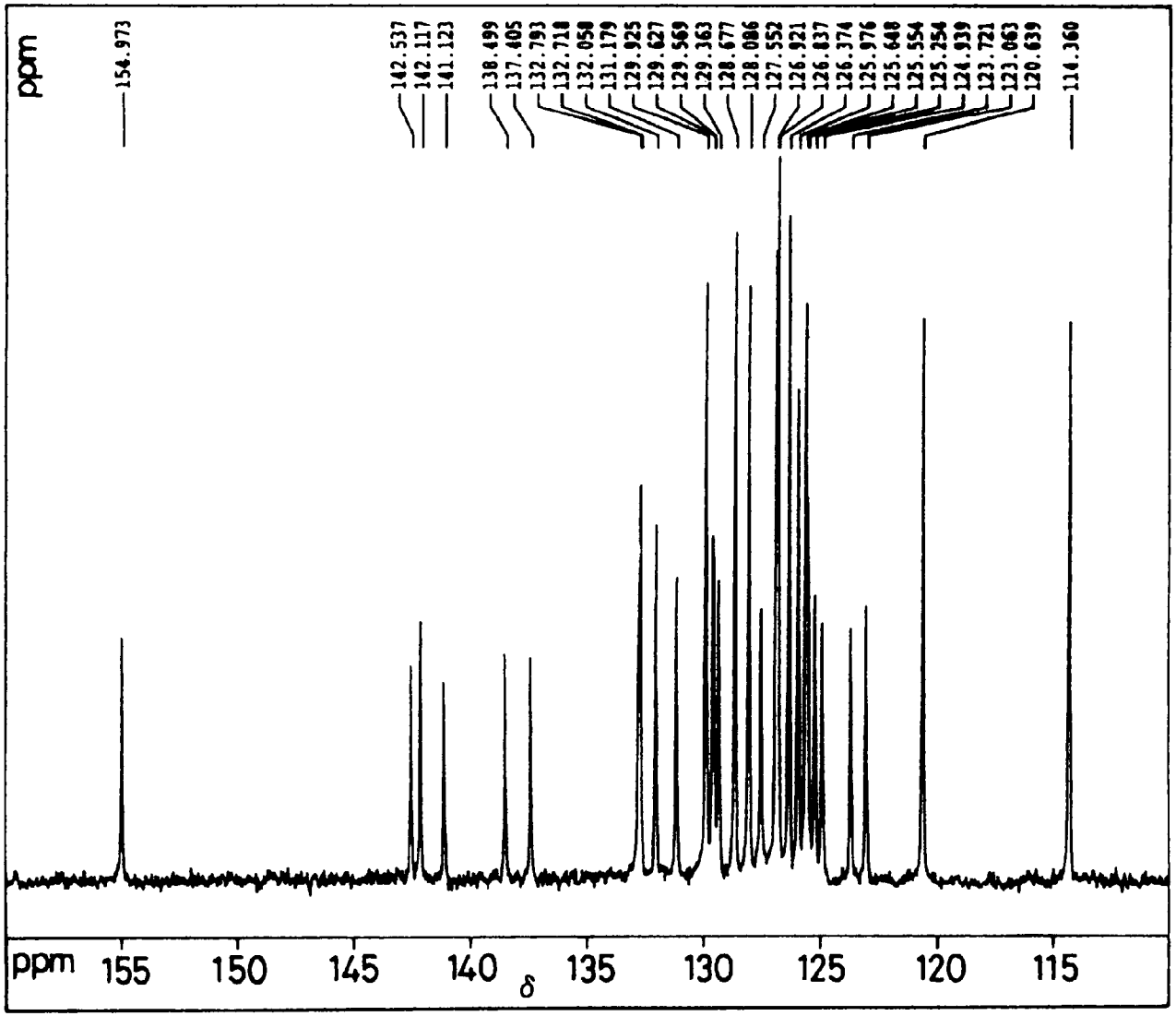
FIG. 17 is an enlarged view of the spectrum of FIG. 16 in the range of from 110 ppm to 160 ppm.
Figure 18:
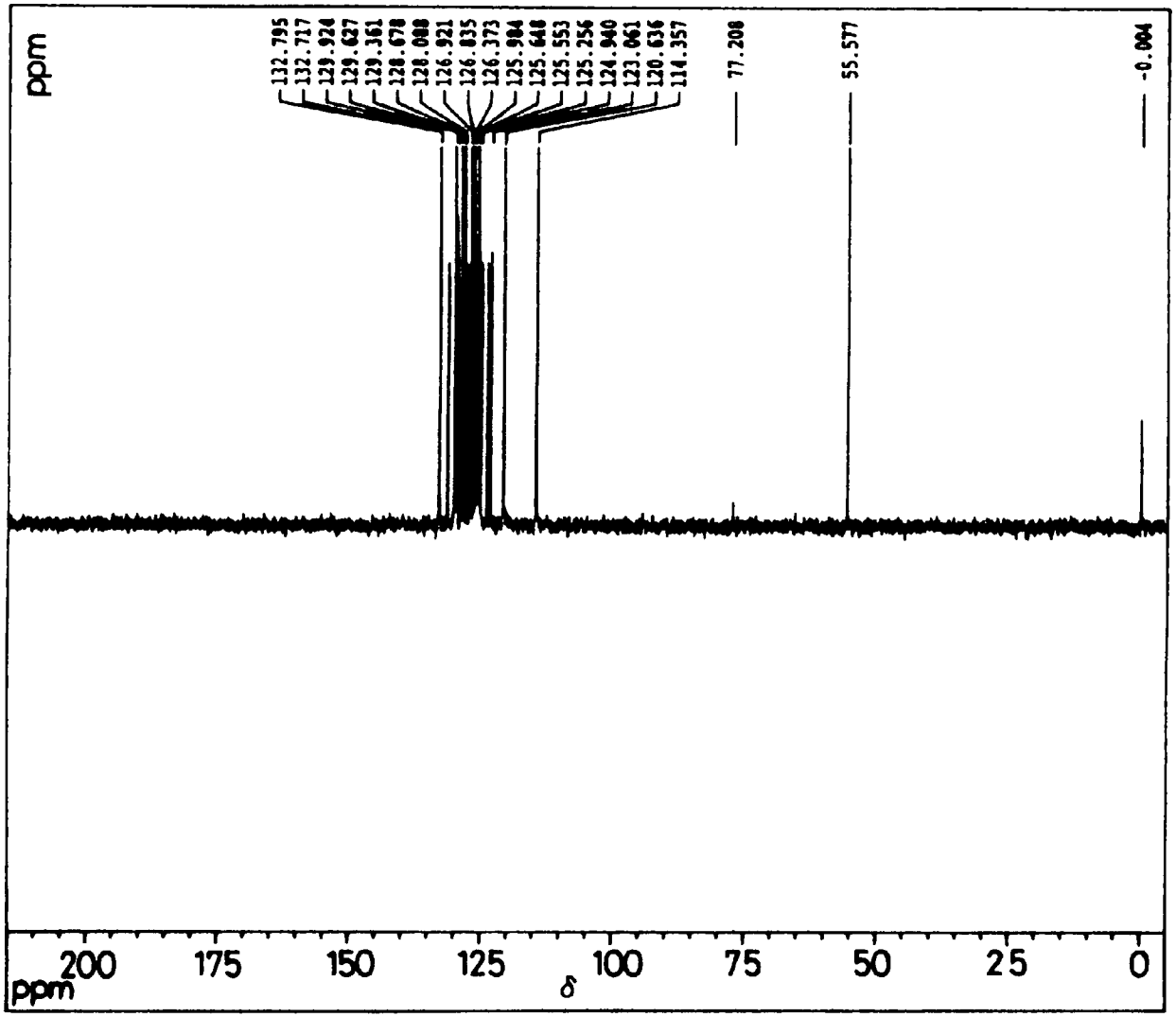
FIG. 18 is the $^{13}$C-NMR spectrum in DEPT135 measurement of the product in Production Example 2.
Figure 19:
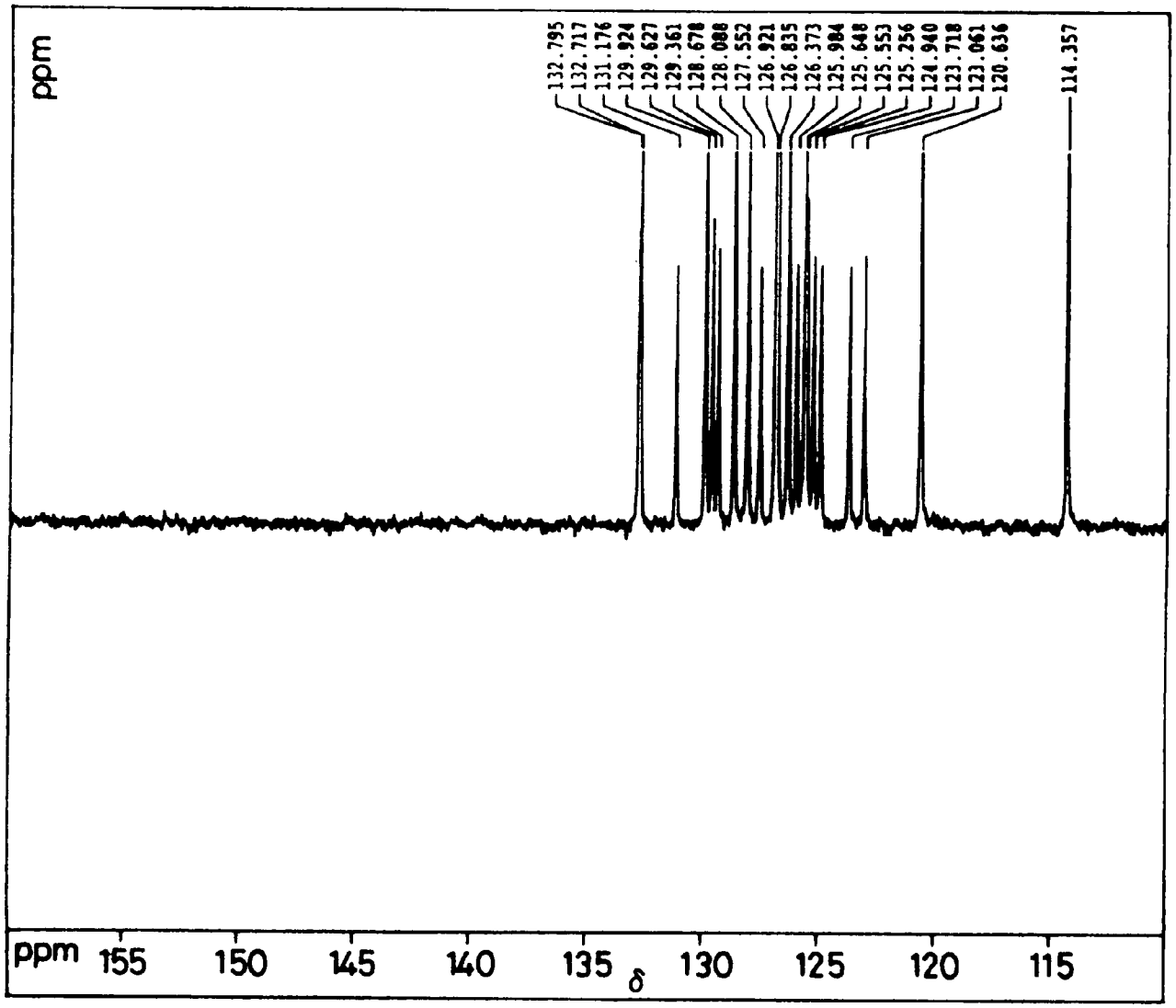
FIG. 19 is an enlarged view of the spectrum of FIG. 18 in the range of from 110 ppm to 160 ppm.

The NMR spectrum of the compound in heavy chloroform ($CDCl_3$) was measured, and this spectrum supports the structure of the enamine compound, Compound No. 61. FIG. 14 is the $^{1}$H-NMR spectrum of the product in this Production Example 2, and FIG. 15 is an enlarged view of the spectrum of FIG. 14 in the range of from 6 ppm to 9 ppm. FIG. 16 is the $^{13}$C-NMR spectrum in ordinary measurement of the product in Production Example 2, and FIG. 17 is an enlarged view of the spectrum of FIG. 16 in the range of from 110 ppm to 160 ppm. FIG. 18 is the $^{13}$C-NMR spectrum in DEPT135 measurement of the product in Production Example 2, and FIG. 19 is an enlarged view of the spectrum of FIG. 18 in the range of from 110 ppm to 160 ppm. In FIG. 14 to FIG. 19, the horizontal axis indicates the chemical shift 8 (ppm) of the compound analyzed. In FIG. 14 and FIG. 15, the data written between the signals and the horizontal axis are relative integral values of the signals based on the integral value, 3, of the signal indicated by the reference numeral 501 in FIG. 14.

The data of LC-MS and the NMR spectrometry confirm that the compound obtained herein is the enamine compound, Compound No. 61 (yield: 92%). In addition, the data of LC-MS further confirm that the purity of the enamine compound, Compound No. 61 obtained herein is 99.0%.

As in the above, the three-stage reaction process that comprises dehydrating condensation, Vilsmeier reaction and Wittig-Horner reaction gives the enamine compound, Compound No. 61 shown in Table 9, and the overall three-stage yield of the product was 73.5%.

Production Example 3

Production of Compound No. 46

2.0 g (1.0 equivalent) of the enamine-aldehyde intermediate represented by the structural formula (11) obtained in Production Example 1-2, and 1.53 g (1.2 equivalents) of a Wittig reagent of the following structural formula (13) were dissolved in 15 ml of anhydrous DMF, and 0.71 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 2.37 g of an yellow crystal.

(13)

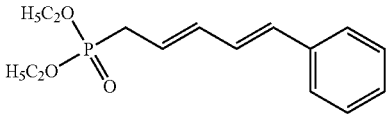

Thus obtained, the crystal was analyzed through LC-MS, which gave a peak at 566.4 corresponding to the molecular ion $[M+H]^{+}$ of the intended enamine compound, Compound No. 46 in Table 7 (calculated molecular weight: 565.28) with a proton added thereto. This confirms that the crystal obtained herein is the enamine compound, Compound No. 46 (yield: 92%). In addition, the data of LC-MS further confirm that the purity of the enamine compound, Compound No. 46 is 99.8%.

As in the above, the Wittig-Horner reaction of the enamine-aldehyde intermediate represented by the structural formula (11) and the Wittig reagent represented by the structural formula (13) gives the enamine compound, Compound No. 46 shown in Table 7.

Comparative Production Example 1

Production of Compound of Structural Formula (14)

2.0 g (1.0 equivalent) of the enamine-aldehyde intermediate represented by the structural formula (11) obtained in Production Example 1-2 was dissolved in 15 ml of anhydrous THF, and 5.23 ml (1.15 equivalents) of a THF solution of a Grignard reagent, allylmagnesium bromide prepared from allyl bromide and metal magnesium (molar concentration: 1.0 mol/liter) was gradually added to the solution at 0° C. This was stirred at 0° C. for 0.5 hours, and then checked for the reaction progress through thin-layer chromatography, in which no definite reaction product was confirmed but some different products were found. This was post-processed, extracted and concentrated in an ordinary manner. Then, the reaction mixture was isolated and purified through silica gel column chromatography.

However, the aimed compound represented by the following structural formula (14) could not be obtained.

(14)

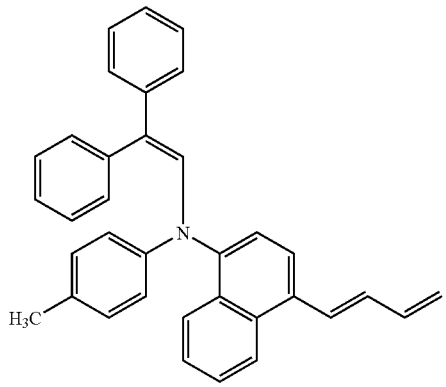

Example

X-ray diffraction spectrum for oxotitanium phthalocyanine used in the following examples and comparative examples was measured by a θ/2θ scanning method using CuKα characteristic X-rays (wavelength: 1.54050 Å) as an X-ray source.

Example 1

Materials shown in Table 33 were dispersed by a paint shaker for 10 hours to prepare a coating solution for undercoat layer. The outer circumferential surface of a cylindrical conductive substrate 11 was dip-coated with the obtained coating solution for undercoat layer, which cylindrical conductive substrate was made of aluminum having 30 mm diameter and 335 mm length while controlling the film thickness, to form an undercoat layerundercoat layer 18 of 1 μm thickness. Heat treatment was not applied after coating of the coating solution for undercoat layer.

TABLE 33

| Coating solution for undercoat layer | |
|---|---|
| Material | Amount of use |
| Titanium oxide (TTO-55A, manufactured by Ishihara Industry Co.) | 6 parts by weight |
| Copolymerized nylon (AMILAN CM8000, manufactured by Toray Industries, Inc. | 4 parts by weight |
| Methanol | 130 parts by weight |
| n-butanol | 60 parts by weight |

Then, materials shown in Table 34 were dispersed by a paint shaker for 2 hours to prepare a coating solution for charge generating layer. As the charge generating substance 12, oxotitanium phthalocyanine having a crystal form giving the X-ray diffraction spectrum shown in FIG. 2 was used. In view of FIG. 2, it can be seen that said oxotitanium phthalocyanine used in this example has a crystal form showing, in view of the X-ray diffraction spectrum, main diffraction peaks at the Bragg angle of 2θ (error: 2θ±0.2°) of 7.3°, 9.4°, 9.6°, 11.6°, 13.3°, 17.9°, 24.1°, and 27.2° and, among the diffraction peaks described above, a diffraction peak bundle formed by overlap of a diffraction peak at 9.4° and a diffraction peak at 9.6° shows maximum intensity, and a diffraction peak has the intensity next to the highest at 27.2°.

After dip-coating an outer circumferential surface of the previously formed undercoat layer 18 with the obtained coating solution for charge generating layer, it was dried at 120° C. for 10 min to form a charge generating layer 15 of 0.2 μm thickness.

TABLE 34

| Coating solution for charge generating layer | |
|---|---|
| Material | Amount of use |
| Oxotitanium phthalocyanine (FIG. 2) | 2 parts by weight |
| Polyvinyl butyral resin (ESLEC BL-1, manufactured by Sekisui Kagaku Kogyo Co. Ltd.) | 2 parts by weight |
| Cyclohexanone | 100 parts by weight |

Then, materials shown in Table 35 were stirred and dissolved to prepare a coating solution for charge transporting layer. For the charge transporting substance 13, the enamine compound of the exemplified compound No. 61 shown in Table 9 was used. After dip-coating the outer circumferential surface of the previously formed charge generating layer 15 with the obtained coating solution for charge transporting layer, it was dried at 110° C. for 60 min to form a charge transporting layer 16 of 25 μm thickness.

TABLE 35

| Coating solution for charge transporting layer | |
|---|---|
| Material | Amount of use |
| Exemplified compound No. 61 (Table 9) | 5 parts by weight |
| Polycarbonate resin (manufactured by Mitsubishi Gas Chemical Co. Inc.) | 10 parts by weight |
| Silicone oil (KF50, manufactured by Shin-Etsu Chemical Co. Ltd.) | 0.002 part by weight |
| Tetrahydrofuran | 60 parts by weight |

As described above, an electrophotographic photoreceptor of a constitution shown in FIG. 5 satisfying the conditions of the invention was manufactured.

Example 2

An electrophotographic photoreceptor satisfying the conditions of the invention was manufactured in the same manner as in Example 1 except for using oxotitanium phthalocyanine having a crystal form giving an X-ray diffraction spectrum shown in FIG. 3 instead of said oxotitanium phthalocyanine having the crystal form giving the X-ray diffraction spectrum shown in FIG. 2 as the charge generating substance 12 in Example 1.

From FIG. 3, it can be seen that said oxotitanium phthalocyanine used in this example has a crystal form showing, in view of X-ray diffraction spectrum, main diffraction peaks at Bragg angles 2θ (error: 2θ±0.2°) of 9.5°, 9.7°, 11.7°, 15.0°, 23.5°, 24.1°, and 27.3°.

Example 3

An electrophotographic photoreceptor satisfying the conditions of the invention was manufactured in the same manner as in Example 1 except for using oxotitanium phthalocyanine having a crystal form giving an X-ray diffraction spectrum shown in FIG. 4 instead of said oxotitanium phthalocyanine having the crystal form giving the X-ray diffraction spectrum shown in FIG. 2 as the charge generating substance 12 in Example 1.

From FIG. 4, it can be seen that said oxotitanium phthalocyanine used in this example has a crystal form showing, in view of X-ray diffraction spectrum, main diffraction peaks at Bragg angles 2θ (error: 2θ±0.2°) of 9.0°, 14.2°, 23.9°, and 27.1°.

Example 4

An electrophotographic photoreceptor satisfying the conditions of the invention was manufactured in the same manner as in Example 1 except for using the exemplified compound No. 1 shown in Table 1 instead of the exemplified compound No. 61 for the charge transporting substance 13 in Example 1.

Example 5

An electrophotographic photoreceptor satisfying the conditions of the invention was manufactured in the same manner as in Example 1 except for using oxotitanium phthalocyanine having a crystal form giving an X-ray diffraction spectrum shown in FIG. 3 instead of said oxotitanium phthalocyanine having the crystal form giving the X-ray diffraction spectrum shown in FIG. 2 as the charge generating substance 12, and using the exemplified compound No. 1 instead of the exemplified compound No. 61 as the charge transporting substance 13 in Example 1.

Example 6

An electrophotographic photoreceptor satisfying the conditions of the invention was manufactured in the same manner as in Example 1 except for using oxotitanium phthalocyanine having a crystal form giving an X-ray diffraction spectrum shown in FIG. 4 instead of said oxotitanium phthalocyanine having the crystal form giving the X-ray diffraction spectrum shown in FIG. 2 as the charge generating substance 12, and using the exemplified compound No. 1 instead of the exemplified compound No. 61 as the charge transporting substance 13 in Example 1.

Comparative Example 1

An electrophotographic photoreceptor not satisfying the conditions of the invention was manufactured in the same manner as in Example 1 except for using an enamine compound represented by the following structural formula (15) instead of the exemplified compound No. 61 as the charge transporting substance 13 in Example 1.

(15)

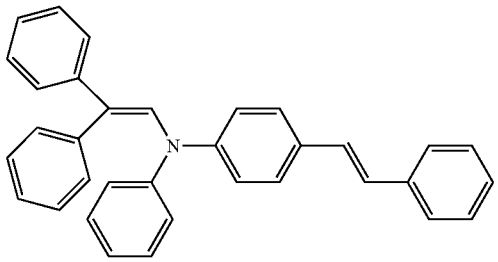

Comparative Example 2

An electrophotographic photoreceptor not satisfying the conditions of the invention was manufactured in the same manner as in Example 1 except for using oxotitanium phthalocyanine having a crystal form giving the X-ray diffraction spectrum shown in FIG. 3 instead of said oxotitanium phthalocyanine having the crystal form giving the X-ray diffraction spectrum shown in FIG. 2 as the charge generating substance 12 and using the enamine compound represented by the structural formula (15) instead of the exemplified compound No. 61 as the charge transporting substance 13 in Example 1.

Comparative Example 3

An electrophotographic photoreceptor not satisfying the conditions of the invention was manufactured in the same manner as in Example 1 except for using oxotitanium phthalocyanine having a crystal form giving the X-ray diffraction spectrum shown in FIG. 4 instead of said oxotitanium phthalocyanine having the crystal form giving the X-ray diffraction spectrum shown in FIG. 2 as the charge generating substance 12 and using the enamine compound represented by the structural formula (15) instead of the exemplified compound No. 61 as the charge transporting substance 13 in Example 1.

Comparative Example 4

An electrophotographic photoreceptor not satisfying the conditions of the invention was manufactured in the same manner as in Example 1 except for using so-called α-type oxotitanium phthalocyanine having a crystal form showing, in view of the X-ray diffraction spectrum, diffraction peaks at the Bragg angles 2θ (error: 2θ±0.2°) of 7.5°, 12.3°, 16.3°, 25.3°, and 28.7° instead of said oxotitanium phthalocyanine having the crystal form giving the X-diffraction spectrum in FIG. 2 as the charge generating substance 12 in Example 1.

Comparative Example 5

An electrophotographic photoreceptor not satisfying the conditions of the invention was manufactured in the same manner as in Example 1 except for using said α-type oxotitanium phthalocyanine described above instead of said oxotitanium phthalocyanine having the crystal form giving the X-ray diffraction spectrum shown in FIG. 2 as the charge generating substance 12 and using the exemplified compound No. 1 instead of the exemplified compound No. 61 as the charge transporting substance 13 in Example 1.

Comparative Example 6

An electrophotographic photoreceptor not satisfying the conditions of the invention was manufactured in the same manner as in Example 1 except for using a tris azo pigment represented by the following structural formula (16) instead of said oxotitanium phthalocyanine having the crystal form giving the X-ray diffraction spectrum shown in FIG. 2 as the charge generating substance 12 in Example 1.

(16)

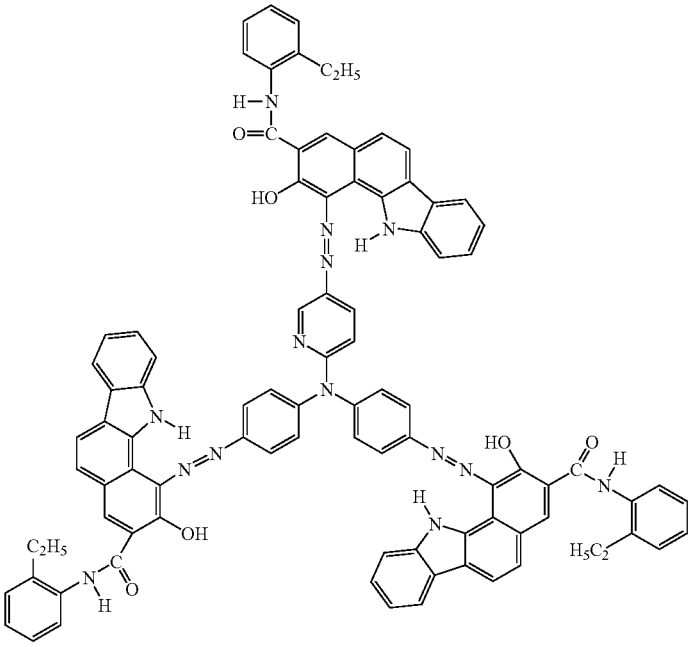

Comparative Example 7

An electrophotographic photoreceptor not satisfying the conditions of the invention was manufactured in the same manner as in Example 1 except for using a tris azo pigment represented by the structural formula (16) instead of said oxotitanium phthalocyanine having the crystal form giving the X-ray diffraction spectrum shown in FIG. 2 as the charge generating substance 12 and using the exemplified compound No. 1 instead of the exemplified compound No. 61 as the charge transporting substance 13 in Example 1.

Evaluation 1

Each of the electrophotographic photoreceptor manufactured in Examples 1 to 6 and Comparative Examples 1 to 7 were mounted to a digital copying machine (AR-M450, manufactured by Sharp Corp.) from which developing means was detached and, instead, a surface potential meter (CATE 751, manufactured by GEN-TECH, INC.) was provided to the developing portion respectively. Data in which exposure was applied to a portion and exposure was not applied to other portions of the surface of the photoreceptor were inputted to the copying machine, the surface potential of the photoreceptor at the not-exposed portion as a dark portion potential $V_0$ (−V) and the surface potential of the photoreceptor at the exposed portion was measured as the light portion potential VL (−V), which were defined as a result of measurement in the initial stage. In the digital copying machine used for evaluation, a laser at an oscillation wavelength of 780 nm was used as an exposure light source.

Then, the surface potential meter was taken out and, instead, the developing means was mounted to the digital copying machine and test images of a predetermined pattern were copied by 30000 sheets. Then, the developing means was again taken out and the surface potential meter described above was disposed to the developing portion, and the dark portion potential $V_0$ and the light portion potential VL were measured in the same manner as in the initial stage. They were repeated and used as the result for evaluation after use.

Evaluation 2

The electrophotographic photoreceptors manufactured in Examples 1 to 6 and Comparative Examples 1 to 7 were mounted respectively to an apparatus obtained by modifying a commercial laser beam printer (DM 4501, manufactured by Sharp Corp.) such that normal development could be conducted and such that the optical amount of the exposure light source and the rotational circumferential speed of the photoreceptor could be changed. In the laser beam printer, a laser having an oscillation wavelength of 780 nm was used as the exposure light source.

By changing the rotational circumferential speed of the photoreceptor, the time from the start of exposure to the surface of the photoreceptor to the completion of the development for electrostatic latent images was set to 50 msec, 90 msec or 130 msec, and images were formed on recording paper at each setting time. The obtained images were observed visually to evaluate the quality of images. However, in a case where occurrence of background contamination was observed to the images, the optical amount of the exposure light source was increased and images were formed repetitively till the background contamination no more occurred or the extent of the background contamination could no more be improved and the finally obtained images were used for the evaluation. The evaluation described above was conducted under a normal temperature and normal humidity circumstance at a temperature of 25° C. and a relative humidity of 55% (55% RH) and under a low temperature and low humidity circumstance at a temperature of 5° C. and a relative humidity of 20% (20% RH).

Table 36 shows the result for evaluation 1 and evaluation 2.

TABLE 36

| | | | Surface potential | | | |
|---|---|---|---|---|---|---|
| | Charge generating | Charge transporting | Initial stage | | After repetitive use | |
| Photoreceptor | substance | substance | $V_0$(−V) | VL(−V) | $V_0$(−V) | VL(−V) |
| Example 1 | Oxotitanium phthalocyanine (FIG. 2) | Exemplified Compound No. 61 | 620 | 80 | 600 | 90 |
| Example 2 | Oxotitanium phthalocyanine (FIG. 3) | Exemplified Compound No. 61 | 630 | 70 | 610 | 90 |
| Example 3 | Oxotitanium phthalocyanine (FIG. 4) | Exemplified Compound No. 61 | 610 | 90 | 600 | 100 |
| Example 4 | Oxotitanium phthalocyanine (FIG. 2) | Exemplified Compound No. 1 | 600 | 70 | 590 | 90 |
| Example 5 | Oxotitanium phthalocyanine (FIG. 3) | Exemplified Compound No. 1 | 610 | 70 | 600 | 80 |
| Example 6 | Oxotitanium phthalocyanine (FIG. 4) | Exemplified Compound No. 1 | 610 | 80 | 600 | 100 |
| Comparative Example 1 | Oxotitanium phthalocyanine (FIG. 2) | Enamine compound (15) | 580 | 90 | 580 | 100 |
| Comparative Example 2 | Oxotitanium phthalocyanine (FIG. 3) | Enamine compound (15) | 590 | 100 | 560 | 100 |
| Comparative Example 3 | Oxotitanium phthalocyanine (FIG. 4) | Enamine compound (15) | 590 | 90 | 570 | 110 |
| Comparative Example 4 | α-type oxotitanium phthalocyanine | Enamine compound No. 61 | 620 | 180 | 610 | 310 |
| Comparative Example 5 | α-type oxotitanium phthalocyanine | Exemplified compound No. 1 | 610 | 200 | 600 | 320 |
| Comparative | Tri azo pigment (18) | Enamine | 620 | 230 | 600 | 320 |

TABLE 36-continued

| | | | | | | |
|---|---|---|---|---|---|---|
| Example 6 | | compound No. 61 | | | | |
| Comparative Example 7 | Tri azo pigment (16) | Exemplified compound No. 1 | 630 | 240 | 610 | 350 |

| | Image quality | | | | | |
|---|---|---|---|---|---|---|
| | 25° C., 55% RH | | | 5° C., 20% RH | | |
| Photoreceptor | 50 msec | 90 msec | 130 msec | 50 msec | 90 msec | 130 msec |
| Example 1 | Good | Good | Good | Good | Good | Good |
| Example 2 | Good | Good | Good | Good | Good | Good |
| Example 3 | Good | Good | Good | Good | Good | Good |
| Example 4 | Good | Good | Good | Good | Good | Good |
| Example 5 | Good | Good | Good | Good | Good | Good |
| Example 6 | Good | Good | Good | Good | Good | Good |
| Comparative Example 1 | Good | Good | Good | Background contamination | Background contamination | Good |
| Comparative Example 2 | Good | Good | Good | Background contamination | Background contamination | Good |
| Comparative Example 3 | Good | Good | Good | Background contamination | Background contamination | Good |
| Comparative Example 4 | Background contamination | Background contamination | Good | Background contamination | Background contamination | Background contamination |
| Comparative Example 5 | Background contamination | Background contamination | Good | Background contamination | Background contamination | Background contamination |
| Comparative Example 6 | Good | Good | Good | Background contamination | Good | Good |
| Comparative Example 7 | Good | Good | Good | Background contamination | Good | Good |

In view of comparison for Examples 1 to 6, and Comparative Examples 1 to 3 and Comparative Examples 4 to 7, it was found that photoreceptors of Examples 1 to 6 and Comparative Examples 1 to 3 using oxotitanium phthalocyanine having a specified crystal form showing, in view of X-ray diffraction spectrum, diffraction peaks at Bragg angles 2θ (error: 2θ±0.2°) of 27.2° and the charge generating substance showed smaller absolute values for the light portion potential VL and were excellent in responsivity compared with the photoreceptors of Comparative Examples 4 to 7 using said α-type oxotitanium phthalocyanine having the crystal form other than the specified crystal form or a tris azo pigment shown by the structural formula (16). Further, it was found that the photoreceptors of Examples 1 to 6 and Comparative Examples 1 to 3 showed smaller absolute values for the potential difference between the light portion potential VL in the initial stage and the light portion potential VL after repetitive use and showed less lowering of responsivity due to repetitive use.

Further, in view of Table 36, it was found that in the apparatus which was mounted with photoreceptors of examples 1 to 6 using the enamine compound represented by the general formula (1) as the charge transporting substance among the photoreceptors of Examples 1 to 6 and Comparative Examples 1 to 3, images at high quality could be obtained even in a case of conducting an electrophotographic process at a high speed while setting the time from the start of the exposure to the surface of the photoreceptor to the completion of the development for electrostatic latent images to 50 msec or 90 msec under the low temperature and low humidity circumstance.

On the other hand, it was found that the photoreceptors of Comparative Examples 1 to 3 using the enamine compound represented by the structural formula (15) not included in the general formula (1) as the charge transporting substance were excellent in responsivity and showed less lowering of responsivity due to repetitive use like the photoreceptors of Examples 1 to 6 but background contamination occurred in the images in a case of conducting the electrophotographic process at a high speed under the low temperature and low humidity circumstance in the apparatus which was mounted with the photoreceptors of Comparative Examples 1 to 3.

As described above, by incorporation of said oxotitanium phthalocyanine having the crystal form showing, in view of the X-ray diffraction spectrum, diffraction peaks at the Bragg angle 2θ (error: 2θ±0.2°) of 27.2° and the enamine compound represented by the general formula (1) in combination in the photosensitive layer, it was possible to obtain an electrophotographic photoreceptor showing high responsivity even under the low temperature and low humidity circumstance and capable of providing images at high quality under various conditions, for example, under the low temperature and low humidity circumstance even in a case where it was decreased in the size and used in the electrophotographic process at high speed.

Example 7

Materials shown in Table 37 were dispersed in a paint shaker for 10 hours to prepare a coating solution for undercoat layer. The outer circumferential surface of a cylindrical conductive substrate 11 was dip-coated with the obtained coating solution for undercoat layer, which cylindrical conductive substrate was made of aluminum having 30 mm diameter and 335 mm length while controlling the film thickness, to form an undercoat layer 18 of 0.2 μm thickness. Heat treatment was not applied after coating.

Then, the materials shown in Table 37 were dispersed for 2 hours by a paint shaker and a coating solution for charge generating layer was prepared. After dip-coating the outer circumferential surface of the previously formed undercoat layer 18 with the obtained coating solution for charge generating layer, it was dried at 120° C. for 10 min to form a charge generating layer 15 of 0.2 μm thickness.

TABLE 37

| Coating solution for charge generating layer | |
|---|---|
| Material | Amount of use |
| Mixed crystal of oxotitanium phthalocyanine and chlorogallium phthalocyanine | 2 parts by weight |
| Polyvinyl butyral resin (Eslec BL-1, manufactured by Sekisui Kagaku Kogyo Co. Ltd.) | 2 parts by weight |
| Cyclohexanone | 100 parts by weight |

The mixed crystals of oxotitanium phthalocyanine and chlorogallium phthalocyanine used as the charge generating substance 12 shown in Table 37 were prepared in accordance with Example 3 described in JP-A 4-372663 by mixing 1 part by weight of chlorogallium phthalocyanine to 9 parts by weight of oxotitanium phthalocyanine, pulverizing them till distinct X-ray diffraction peaks were no more shown and then applying a milling treatment together with glass beads of 1 mm diameter in dichloromethane. The obtained mixed crystals of oxotitanium phthalocyanine and chlorogallium phthalocyanine showed, in view of the X-ray diffraction spectrum, intense diffraction peaks at the Bragg angles 2θ (error: 2θ±0.2°) of 9.3°, 10.6°, 13.3°, 15.1°, and 26.3°.

Then, materials shown in Table 35 were stirred and dissolved to prepare a coating solution for charge transporting layer. For the charge transporting substance 13, the enamine compound of the exemplified compound No. 61 shown in Table 9 was used. After dip-coating the outer circumferential surface of the previously formed charge generating layer 15 with the obtained coating solution for charge transporting layer, it was dried at 110° C. for 60 min to form a charge transporting layer 16 of 25 μm thickness.

As described above, an electrophotographic photoreceptor of a constitution shown in FIG. 5 satisfying the conditions of the invention was manufactured.

Example 8

An electrophotographic photoreceptor satisfying the conditions of the invention was manufactured in the same manner as in Example 7 except for using mixed crystals of oxotitanium phthalocyanine and chloroindium phthalocyanine instead of the mixed crystals of oxotitanium phthalocyanine and chlorogallium phthalocyanine as the charge generating substance 12 in Example 7.

The mixed crystals of oxotitanium phthalocyanine and chloroindium phthalocyanine in this example were prepared in accordance with Example 19 described in JP-A 4-372663 by mixing 1 part by weight of chloroindium phthalocyanine to 9 parts by weight of oxotitanium phthalocyanine, pulverizing them till distinct X-ray diffraction peaks were no more shown and then applying a milling treatment together with glass beads of 1 mm diameter in dichloromethane. The obtained mixed crystals of oxotitanium phthalocyanine and chloroindium phthalocyanine showed, in view of the X-ray diffraction spectrum, intense diffraction peaks at the Bragg angles 2θ (error: 2θ±0.2°) of 7.6°, 16.4°, 22.4°, 25.5°, and 28.6°.

Example 9

An electrophotographic photoreceptor satisfying the conditions of the invention was manufactured in the same manner as in Example 7 except for using mixed crystals of oxotitanium phthalocyanine and non-metal phthalocyanine instead of the mixed crystals of oxotitanium phthalocyanine and chlorogallium phthalocyanine as the charge generating substance 12 in Example 7.

The mixed crystals of oxotitanium phthalocyanine and non-metal phthalocyanine used in this example were prepared in accordance with Synthesis Example 5 described in JP-A 2000-313819 by mixing 3 parts by weight of non-metal phthalocyanine to 7 parts by weight of oxotitanium phthalocyanine, forming them into an amorphous state by an acid pasting method and then heating and stirring them together with naphthalene in water. The obtained mixed crystals of oxotitanium phthalocyanine and non-metal phthalocyanine showed, in view of the X-ray diffraction spectrum, diffraction peaks at the Bragg angles 2θ (error: 2θ±0.2°) of 7.0°, 9.0°, 14.1°, 18.0°, 23.7°, and 27.3°.

Example 10

An electrophotographic photoreceptor satisfying the conditions of the invention was manufactured in the same manner as in Example 7 except for using 1 part by weight of oxotitanium phthalocyanine and 1 part by weight of X-type non-metal phthalocyanine (FASTOGEN BLUE8120BS, manufactured by DAINIPPON INK AND CHEMICALS, INC.) instead of the mixed crystals of oxotitanium phthalocyanine and chlorogallium phthalocyanine as the charge generating substance 12 in Example 7.

Said oxotitanium phthalocyanine used in this example was prepared in accordance with Preparation Example 1 described in JP-A 2000-129155 by applying a milling treatment to a Y-type oxotitanium phthalocyanine coarse crystals obtained by hydrolysis of dichlorotitanium phthalocyanine, together with glass beads of 2 mm diameter in methyl ethyl ketone, and cleaning them with methanol, followed by drying. The obtained oxotitanium phthalocyanine showed, in view of the X-ray diffraction spectrum, main diffraction peaks at the Bragg angles 2θ (error: 2θ±0.2°) of 7.3°, 9.4°, 9.6°, 11.6°, 13.3°, 17.9°, 24.1°, and 27.2°, in which a diffraction peak bundle formed by overlap of a diffraction peak at 9.4° and a diffraction peak at 9.6° showed the highest intensity and a diffraction peak at 27.2° showed an intensity next to the highest.

Example 11

An electrophotographic photoreceptor satisfying the conditions of the invention was manufactured in the same manner as in Example 7 except for using X-type non-metal phthalocyanine (FASTOGEN BLUE 8120BS, manufactured by DAINIPPON INK AND CHEMICALS, INC.) instead of the mixed crystals of oxotitanium phthalocyanine and chlorogallium phthalocyanine as the charge generating substance 12 in Example 7.

Example 12

An electrophotographic photoreceptor satisfying the conditions of the invention was manufactured in the same manner as in Example 7 except for using the exemplified compound No. 1 shown in Table 1 described above instead of the exemplified compound No. 61 as the charge transporting substance 13 in Example 7.

Example 13

An electrophotographic photoreceptor satisfying the conditions of the invention was manufactured in the same manner as in Example 7 except for using mixed crystals of oxotitanium phthalocyanine and chloroindium phthalocyanine used in Example 8 instead of the mixed crystals of oxotitanium phthalocyanine and chlorogallium phthalocyanine as the charge generating substance 12, and using the exemplified compound No. 1 instead of the exemplified compound No. 61 as the charge transporting substance 13 in Example 7.

Example 14

An electrophotographic photoreceptor satisfying the conditions of the invention was manufactured in the same manner as in Example 7 except for using the mixed crystals of oxotitanium phthalocyanine and non-metal phthalocyanine used in Example 9 instead of the mixed crystals of oxotitanium phthalocyanine and chlorogallium phthalocyanine as the charge generating substance 12, and using the exemplified compound No. 1 instead of the exemplified compound No. 61 as the charge transporting substance 13 in Example 7.

Example 15

An electrophotographic photoreceptor satisfying the conditions of the invention was manufactured in the same manner as in Example 7 except for using 1 part by weight of oxotitanium phthalocyanine and 1 part by weight of X-type non-metal phthalocyanine (FASTOGEN BLUE8120BS, manufactured by DAINIPPON INK AND CHEMICALS, INC.) used in Example 10 instead of the mixed crystals of oxotitanium phthalocyanine and chlorogallium phthalocyanine as the charge generating substance 12 and using the exemplified compound No. 1 instead of the exemplified compound No. 61 as the charge transporting substance 13 in Example 7.

Example 16

An electrophotographic photoreceptor satisfying the conditions of the invention was manufactured in the same manner as in Example 7 except for using X-type non-metal phthalocyanine (FASTOGEN BLUE 8120BS, manufactured by DAINIPPON INK AND CHEMICALS, INC.) instead of the mixed crystals of oxotitanium phthalocyanine and chlorogallium phthalocyanine as the charge generating substance 12, and using the exemplified compound No. 1 instead of the exemplified compound No. 61 as the charge transporting substance 13 in Example 7.

Comparative Example 8

An electrophotographic photoreceptor not satisfying the conditions of the invention was manufactured in the same manner as in Example 7 except for using the enamine compound represented by the structural formula (15) instead of the exemplified compound No. 61 as the charge transporting substance 13 in Example 7.

Comparative Example 9

An electrophotographic photoreceptor not satisfying the conditions of the invention was manufactured in the same manner as in Example 7 except for using the mixed crystals of oxotitanium phthalocyanine and chloroindium phthalocyanine used in Example 8 instead of the mixed crystals of oxotitanium phthalocyanine and chlorogallium phthalocyanine as the charge generating substance 12, and using the enamine compound represented by the structural formula (15) instead of the exemplified compound No. 61 as the charge transporting substance 13 in Example 7.

Comparative Example 10

An electrophotographic photoreceptor not satisfying the conditions of the invention was manufactured in the same manner as in Example 7 except for using the mixed crystals of oxotitanium phthalocyanine and non-metal phthalocyanine used in Example 9 instead of the mixed crystals of oxotitanium phthalocyanine and chlorogallium phthalocyanine as the charge generating substance 12, and using the enamine compound represented by the structural formula (15) instead of the exemplified compound No. 61 as the charge transporting substance 13 in Example 7.

Comparative Example 11

An electrophotographic photoreceptor not satisfying the conditions of the invention was manufactured in the same manner as in Example 7 except for using 1 part by weight of oxotitanium phthalocyanine and X-type non-metal phthalocyanine (FASTOGEN BLUE8120BS, manufactured by DAINIPPON INK AND CHEMICALS, INC.) used in Example 10 instead of the mixed crystals of oxotitanium phthalocyanine and chlorogallium phthalocyanine as the charge generating substance 12 and using the enamine compound represented by the structural formula (15) instead of the exemplified compound No. 61 as the charge transporting substance 13 in Example 7.

Comparative Example 12

An electrophotographic photoreceptor not satisfying the conditions of the invention was manufactured in the same manner as in Example 7 except for using X-type non-metal phthalocyanine (FASTOGEN BLUE8120BS, manufactured by DAINIPPON INK AND CHEMICALS, INC.) instead of the mixed crystals of oxotitanium phthalocyanine and chlorogallium phthalocyanine as the charge generating substance 12, and using the enamine compound represented by the general formula (15) instead of the exemplified compound No. 61 as the charge transporting substance 13 in Example 7.

Comparative Example 13

An electrophotographic photoreceptor not satisfying the conditions of the invention was manufactured in the same manner as in Example 7 except for using so-called α-type oxotitanium phthalocyanine showing, in view of the X-ray diffraction spectrum, diffraction peaks at the Bragg angles 2θ (error: 2θ±0.2°) of 7.5°, 12.3°, 16.3°, 25.3° and 28.7° instead of the mixed crystals of oxotitanium phthalocyanine and chlorogallium phthalocyanine as the charge generating substance 12 in Example 7.

Comparative Example 14

An electrophotographic photoreceptor not satisfying the conditions of the invention was manufactured in the same manner as in Example 7 except for using said x-type oxotitanium phthalocyanine used in Comparative Example 13 instead of the mixed crystals of oxotitanium phthalocyanine and chlorogallium phthalocyanine as the charge generating substance 12, and using the exemplified compound No. 1 instead of the exemplified compound No. 61 as the charge transporting substance 13 in Example 7.

Comparative Example 15

An electrophotographic photoreceptor not satisfying the conditions of the invention was manufactured in the same manner as in Example 7 except for using the tris azo pigment represented by the general formula (16) instead of the mixed crystals of oxotitanium phthalocyanine and chlorogallium phthalocyanine as the charge generating substance 12 in Example 7.

Comparative Example 16

An electrophotographic photoreceptor not satisfying the conditions of the invention was manufactured in the same manner as in Example 7 except for using the tris azo pigment represented by the structural formula (16) instead of the mixed crystals of oxotitanium phthalocyanine and chlorogallium phthalocyanine as the charge generating substance 12, and using the exemplified compound No. 1 instead of the exemplified compound No. 61 as the charge transporting substance 13 in Example 7.

Evaluation 3

Each of the electrophotographic photoreceptors manufactured in Examples 7 to 16 and Comparative Examples 8 to 16 was evaluated in the same manner as in Evaluation 1 described above.

Evaluation 4

Each of the electrophotographic photoreceptors manufactured in Examples 7 to 16 and Comparative Examples 8 to 16 was evaluated in the same manner as in Evaluation 2 described above.

The results of the evaluation for Evaluation 3 and Evaluation 4 are shown in Table 38.

TABLE 38

| Photoreceptor | Charge generating substance | Charge transporting substance | Surface potential: Initial stage $V_0$(−V) | Initial stage VL(−V) | After repetitive use $V_0$(−V) | After repetitive use VL(−V) |
|---|---|---|---|---|---|---|
| Example 7 | Mixed crystal of oxotitanium phthalocyanine and chlorogallium phthalocyanine | Exemplified Compound No. 61 | 610 | 70 | 610 | 90 |
| Example 8 | Mixed crystal of oxotitanium phthalocyanine and chlorogallium phthalocyanine | Exemplified Compound No. 61 | 620 | 60 | 600 | 80 |
| Example 9 | Mixed crystal of oxotitanium phthalocyanine and non-metal phthalocyanine | Exemplified Compound No. 61 | 600 | 150 | 590 | 160 |
| Example 10 | Oxotitanium phthalocyanine and x-type non-metal phthalocyanine | Exemplified Compound No. 61 | 610 | 120 | 600 | 130 |
| Example 11 | X-type non-metal phthalocyanine | Exemplified Compound No. 61 | 600 | 210 | 590 | 230 |
| Example 12 | Mixed crystal of oxotitanium phthalocyanine and chlorogallium phthalocyanine | Exemplified Compound No. 1 | 610 | 80 | 600 | 90 |
| Example 13 | Mixed crystal of oxotitanium phthalocyanine and chlorogallium phthalocyanine | Exemplified Compound No. 1 | 610 | 80 | 590 | 100 |
| Example 14 | Mixed crystal of oxotitanium phthalocyanine and non-metal phthalocyanine | Exemplified Compound No. 1 | 620 | 160 | 600 | 180 |
| Example 15 | Oxotitanium phthalocyanine and x-type non-metal phthalocyanine | Exemplified Compound No. 1 | 610 | 130 | 610 | 140 |
| Example 16 | X-type non-metal phthalocyanine | Exemplified Compound No. 1 | 610 | 220 | 600 | 240 |
| Comparative Example 8 | Mixed crystal of oxotitanium phthalocyanine and chlorogallium phthalocyanine | Enamine compound (15) | 600 | 110 | 580 | 130 |
| Comparative Example 9 | Mixed crystal of oxotitanium phthalocyanine and chlorogallium phthalocyanine | Enamine compound (15) | 610 | 100 | 580 | 110 |
| Comparative Example 10 | Mixed crystal of oxotitanium phthalocyanine and non-metal phthalocyanine | Enamine compound (15) | 600 | 170 | 580 | 190 |
| Comparative Example 11 | Oxotitanium phthalocyanine, x-type non-metal phthalocyanine | Enamine compound (15) | 610 | 150 | 600 | 170 |
| Comparative Example 12 | X-type non-metal phthalocyanine | Enamine compound (15) | 600 | 250 | 570 | 270 |
| Comparative Example 13 | α-type oxotitanium phthalocyanine | Exemplified compound No. 61 | 620 | 180 | 610 | 310 |
| Comparative Example 14 | α-type oxotitanium phthalocyanine | Exemplified compound No. 1 | 610 | 200 | 600 | 320 |
| Comparative Example 15 | Tris azo pigment (16) | Exemplified compound No. 61 | 620 | 230 | 600 | 320 |
| Comparative Example 16 | Tris azo pigment (16) | Exemplified compound No. 1 | 630 | 240 | 610 | 350 |

| Photoreceptor | Image quality: 25° C., 55% RH 50 msec | 90 msec | 130 msec | 5° C., 20% RH 50 msec | 90 msec | 130 msec |
|---|---|---|---|---|---|---|
| Example 7 | Good | Good | Good | Good | Good | Good |
| Example 8 | Good | Good | Good | Good | Good | Good |
| Example 9 | Good | Good | Good | Good | Good | Good |
| Example 10 | Good | Good | Good | Good | Good | Good |

TABLE 38-continued

| | | | | | | |
|---|---|---|---|---|---|---|
| Example 11 | Good | Good | Good | Good | Good | Good |
| Example 12 | Good | Good | Good | Good | Good | Good |
| Example 13 | Good | Good | Good | Good | Good | Good |
| Example 14 | Good | Good | Good | Good | Good | Good |
| Example 15 | Good | Good | Good | Good | Good | Good |
| Example 16 | Good | Good | Good | Good | Good | Good |
| Comparative Example 8 | Good | Good | Good | Background contamination | Background contamination | Good |
| Comparative Example 9 | Good | Good | Good | Background contamination | Background contamination | Good |
| Comparative Example 10 | Good | Good | Good | Background contamination | Background contamination | Good |
| Comparative Example 11 | Good | Good | Good | Background contamination | Background contamination | Good |
| Comparative Example 12 | Good | Good | Good | Background contamination | Background contamination | Good |
| Comparative Example 13 | Background contamination | Background contamination | Good | Background contamination | Background contamination | Background contamination |
| Comparative Example 14 | Background contamination | Background contamination | Good | Background contamination | Background contamination | Background contamination |
| Comparative Example 15 | Good | Good | Good | Background contamination | Good | Good |
| Comparative Example 16 | Good | Good | Good | Background contamination | Good | Good |

From Table 38, it has been found that images at high quality could be obtained in the apparatus mounted with the photoreceptors of Examples 7 to 16 using two or more kinds of metal phthalocyanine containing oxotitanium phthalocyanine or non-metal phthalocyanine as the charge generating substance and the enamine compound represented by the general formula (1) as the charge transporting substance also in a case of conducting an electrophotographic process at high speed while setting the time from the start of exposure to the surface of the photoreceptor to the completion of development for electrostatic latent images to 90 msec or less under a low temperature and low humidity circumstance. Further it was found that the photoreceptors of Examples 7 to 16 showed less difference between the light portion potential VL at the initial stage and the light portion potential VL after repetitive use and the responsivity was less lowered due to the repetitive use.

On the other hand, it was found that background contamination occurred in the images in the apparatus mounted with the photoreceptors of Comparative Examples 8 to 12 using the enamine compound shown by the structural formula (15) not included in the general formula (1) as the charge transporting substance, when images were formed under the low temperature and low humidity circumstance while setting the time from the start of the exposure to the surface of the photoreceptor till the completion of the development for electrostatic latent images to 90 msec or less.

Further, it was found that the background contamination occurred to the images in the apparatus mounted with the photoreceptors of Comparative Examples 13 and 14 using only said α-type oxotitanium phthalocyanine as the charge generating substance, both under the normal temperature and normal humidity circumstance and under the low temperature and low humidity circumstance when the images were formed while setting the time from the start of the exposure to the surface of the photoreceptor till the completion of the development for electrostatic latent images to 90 msec or less. Particularly, under the low temperature and low humidity circumstance, background contamination occurred to the images even in a case of setting the time from the start of exposure to the surface of the photoreceptor till the completion of the development for electrostatic latent images to 130 msec. For the surface potential, it was found that the photoreceptors of Comparative Examples 13 and 14 showed large difference between the light portion potential VL at the initial stage and the light portion potential VL after repetitive use and the responsivity was less lowered due to the repetitive use.

Further, it was found that background contamination occurred in the images in the apparatus mounted with the photoreceptors of Comparative Examples 15 and 16 using the tri azo pigment shown by the structural formula (16) as the charge generating substance, when images were formed under the low temperature and low humidity circumstance while setting the time from the start of the exposure to the surface of the photoreceptor to the completion of the development for electrostatic latent images to 50 msec. For the surface potential, it was found that the photoreceptors of Comparative Examples 15 and 16 showed large difference between the light portion potential VL in the initial stage and the light portion potential VL after repetitive use and the responsivity lowered greatly by repetitive use, as with the photoreceptors of Comparative Examples 13 and 14.

As described above, it was possible to obtain an electrophotographic photoreceptor showing high responsivity even under the low temperature and low humidity circumstance and capable of providing images at high quality under various circumstances such as low temperature and low humidity circumstance even when it is reduced in the size and used at a high speed electrophotographic process.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

Further, all modifications and changes belonging to the equivalent range for the scope of claims are within the range of the invention.

INDUSTRIAL APPLICABILITY

As described above, according to the invention, since the photosensitive layer contains oxotitanium phthalocyanine having a specified crystal form of high charge generation performance and charge injection efficiency and an enamine compound having a specified structure of high charge transportability, it is possible to obtain an electrophotographic photoreceptor showing high responsivity even a under low temperature and low humidity circumstance, capable of providing images at high quality under various circumstances such as the low temperature and low humidity circumstance and capable of compatibilizing decrease of the size and increase in the image forming speed of an electrophotographic apparatus.

Further, according to the invention, since the photosensitive layer contains an enamine compound of a specified structure having a particularly high charge transportability, synthesized relatively easily at a high yield, and capable of being manufactured at a reduced cost, an electrophotographic photoreceptor having further higher responsivity can be manufactured at a reduced manufacturing cost.

Further, according to the invention, since the photosensitive layer contains oxotitanium phthalocyanine having a specified crystal form showing particularly high sensitivity to a light in a long wavelength region such as a near infrared light or red light and causing less transition to other crystal forms, it is possible to obtain an electrophotographic photoreceptor having an optimal light sensitive wavelength region to a digital electrophotographic apparatus, and excellent in the characteristic stability during repetitive use.

Further, according to the invention, since the photosensitive layer contains two or more kinds of metal phthalocyanine containing oxotitanium phthalocyanine and an enamine compound having a specified structure of high charge transportability, it is possible to obtain an electrophotographic photoreceptor showing high responsivity even under a low temperature and low humidity circumstance, and capable of providing images at high quality under various circumstances such as under a low temperature and low humidity circumstance even when it is decreased in the size and used in an electrophotographic process at high speed, and capable of compatibilizing decrease of the size and increase in the image forming speed of the electrophotographic apparatus. Further, an electrophotographic photoreceptor having a desired light sensitive wavelength region can be obtained easily by changing the ratio between said oxotitanium phthalocyanine and said metal phthalocyanine other then said oxotitanium phthalocyanine.

Further, according to the invention, since the photosensitive layer contains mixed crystals of oxotitanium phthalocyanine and metal phthalocyanine other than said oxotitanium phthalocyanine, it is possible to obtain an electrophotographic photoreceptor capable of suppressing lowering of responsivity in a case of repetitive use and excellent in characteristic stability during the repetitive use, and the aging stability of the coating solution can be improved upon forming the photosensitive layer by coating, and thereby improving the quality stability and the productivity of the electrophotographic photoreceptor.

Further, according to the invention, since the photosensitive layer contains mixed crystals of oxotitanium phthalocyanine and specified metal phthalocyanine, it is possible to obtain an electrophotographic photoreceptor having a light sensitive wavelength region suitable to a digital electrophotographic apparatus using a light in a long wavelength region emitted from a semiconductor laser or a light emission diode for exposure.

Further, according to the invention, since the photosensitive layer contains non-metal phthalocyanine and an enamine compound having a specified structure of high charge transportability, it is possible to obtain an electrophotographic photoreceptor showing high responsivity even under low temperature and low humidity circumstance, capable of providing images at high quality under various conditions such as under a low temperature and low humidity circumstance even in a case where it is decreased in the size and used at a high speed electrophotographic process, and capable of compatibilizing decrease of the size and increase in the image forming speed of the electrophotographic apparatus.

Further, according to the invention, since the photosensitive layer contains X-type non-metal phthalocyanine, it is possible to obtain an electrophotographic photoreceptor having a light sensitive wavelength region suitable to a digital electrophotographic apparatus using a light in a long wavelength region emitted from a semiconductor laser or a light emission diode for exposure.

Further, according to the invention, since the photosensitive layer contains non-metal phthalocyanine and metal phthalocyanine, an electrophotographic photoreceptor having a desired light sensitive wavelength region can be obtained easily by changing the ratio between said non-metal phthalocyanine and said metal phthalocyanine.

Further, according to the invention, since the photosensitive layer contains mixed crystals of non-metal phthalocyanine and metal phthalocyanine, it is possible to obtain an electrophotographic photoreceptor capable of suppressing the lowering of the responsivity in repetitive use and excellent in the characteristic stability in the repetitive use, as well as improve the aging stability of the coating solution, and thereby improving the quality stability and the productivity of the electrophotographic photoreceptor.

Further, according to the invention, since the photosensitive layer contains non-metal phthalocyanine and oxotitanium phthalocyanine, it is possible to obtain an electrophotographic photoreceptor having a light sensitive wavelength region suitable to a digital electrophotographic apparatus using a light in a long wavelength region emitted from a semiconductor laser or a light emission diode for exposure.

Further, according to the invention, since an electrophotographic photoreceptor showing high responsivity even under the low temperature and low humidity circumstance is used, images at high quality can be provided under various circumstances such as under the low temperature and low humidity circumstance even in a case where the time from the start of the exposure to the surface of the electrophotographic photoreceptor to the completion for the development of electrostatic latent images is short.

Further, according to the invention, since an electrophotographic photoreceptor showing high responsivity even under a low temperature and low humidity circumstance is provided, it is possible to obtain an electrophotographic apparatus of high reliability having high image forming speed and capable of providing images at high quality under various circumstances such as under a low temperature and low humidity circumstance.

Further, according to the invention, since the diameter of a cylindrical or circular columnar electrophotographic photoreceptor is selected within a preferred range, the size of the electrophotographic apparatus can be decreased.

The invention claimed is:

1. An electrophotographic photoreceptor comprising:

a conductive substrate formed of a conductive material; and a photosensitive layer disposed on the conductive substrate and containing oxotitanium phthalocyanine having a crystal form showing a diffraction peak at a Bragg angle 2θ (2θ±0.2°) of 27.2° in an X-ray diffraction spectrum and an enamine compound represented by the following general formula (1);

(1)

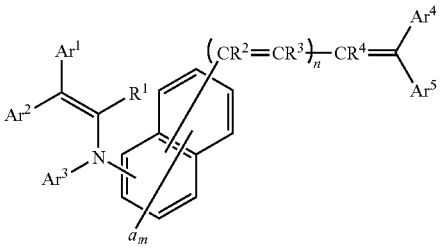

wherein $Ar^1$ and $Ar^2$ each represent an aryl group or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent, wherein the substituent group of $Ar^1$, $Ar^2$, $Ar^4$, $Ar^5$, a, $R^1$, $R^2$, $R^3$, and $R^4$ are independently selected from the group consisting of an alkyl group, an alkenyl group, an alkoxy group, an amino group, a halogeno group, an aryl group, an aryloxy group and an arylthio group, and wherein the substituent group of $Ar^3$ is selected from the group consisting of an alkyl group, an alkoxy group, an amino group, a halogeno group, an aryl group, an aryloxy group and an arylthio group.

2. An electrophotographic photoreceptor comprising:

a conductive substrate formed of a conductive material; and a photosensitive layer disposed on the conductive substrate and containing oxotitanium phthalocyanine having a crystal form showing a diffraction peak at a Bragg angle 2θ (2θ±0.2°) of 27.2° in an X-ray diffraction spectrum and an enamine compound represented by the following general formula (2)

(2)

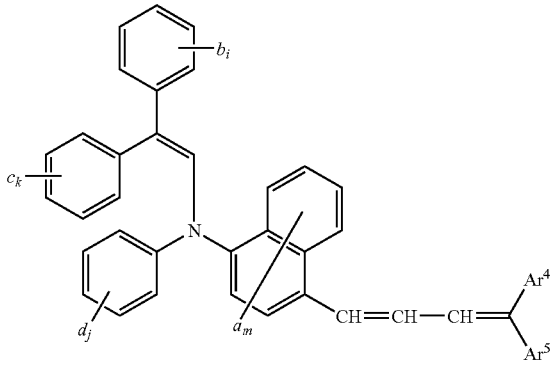

wherein "b", "c" and "d" each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure.

3. The electrophotographic photoreceptor of claim 1, wherein said oxotitanium phthalocyanine is oxotitanium phthalocyanine having a crystal form showing main diffraction peaks at the Bragg angles 2θ (2θ±0.2°) of 7.30°, 94°, 9.6°, 11.6°, 13.3°, 17.9°, 24.1°, and 27.2° in which a bundle of diffraction peaks formed by overlap of a diffraction peak at 9.4° and a diffraction peak at 9.6° shows a maximum intensity among the diffraction peaks described above, and the diffraction peak at 27.2° shows an intensity next to the maximum intensity in the X-ray diffraction spectrum.

4. The electrophotographic photoreceptor of claim 1, wherein said oxotitanium phthalocyanine is oxotitanium phthalocyanine having a crystal form showing main diffraction peaks at the Bragg angles 2θ (2θ±0.2°) of 9.5°, 9.7°, 11.7°, 15.0°, 23.5°, 24.1°, and 27.3° in the X-ray diffraction spectrum.

5. The electrophotographic photoreceptor of claim 1, wherein said oxotitanium phthalocyanine is oxotitanium phthalocyanine having a crystal form showing main diffraction peaks at the Bragg angles 2θ (2θ±0.2°) of 9.0°, 14.2°, 23.9°, and 27.1° in the X-ray diffraction spectrum.

6. An electrophotographic photoreceptor comprising:

a conductive substrate comprising a conductive material, and a photosensitive layer disposed on the conductive substrate and containing oxotitanium phthalocyanine and metal phthalocyanine other than said oxotitanium phthalocyanine and an enamine compound represented by the following general formula (1)

(1)

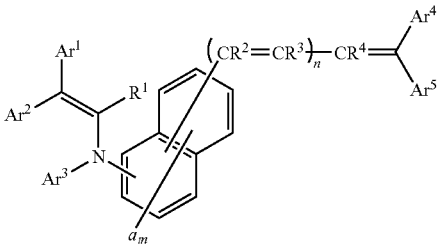

wherein $Ar^1$ and $Ar^2$ each represent an aryl group or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent, wherein the substituent group of $Ar^1$, $Ar^2$, $Ar^4$, $Ar^5$, a, $R^1$, $R^2$, $R^3$, and $R^4$ are independently selected from the group consisting of an alkyl group, an alkenyl group, an alkoxy group, an amino group, a halogeno group, an aryl group, an aryloxy group and an arylthio group, and wherein the substituent group of $Ar^3$ is selected from the group consisting of an alkyl group, an alkoxy group, an amino group, a halogeno group, an aryl group, an aryloxy group and an arylthio group.

7. The electrophotographic photoreceptor of claim 6, wherein said oxotitanium phthalocyanine and said metal phthalocyanine constitute mixed crystals of oxotitanium phthalocyanine and metal phthalocyanine other than said oxotitanium phthalocyanine.

8. The electrophotographic photoreceptor of claim 7, wherein the mixed crystals are mixed crystals of oxotitanium phthalocyanine and chlorogallium phthalocyanine.

9. The electrophotographic photoreceptor of claim 7, wherein the mixed crystals are mixed crystal of oxotitanium phthalocyanine and chloroindium phthalocyanine.

10. An electrophotographic photoreceptor comprising:

an conductive substrate formed of a conductive material, and a photosensitive layer disposed on the conductive substrate and containing non-metal phthalocyanine and an enamine compound represented by the general formula (1)

(1)

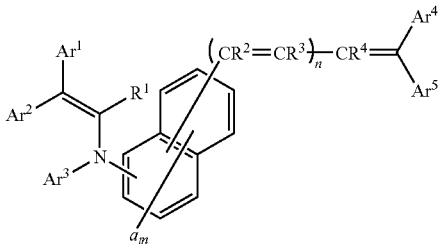

wherein $Ar^1$ and $Ar^2$ each represent an aryl group or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent, wherein the substituent group of $Ar^1$, $Ar^2$, $Ar^4$, $Ar^5$, a, $R^1$, $R^2$, $R^3$, and $R^4$ are independently selected from the group consisting of an alkyl group, an alkenyl group, an alkoxy group, an amino group, a halogeno group, an aryl group, an aryloxy group and an arylthio group, and wherein the substituent group of $Ar^3$ is selected from the group consisting of an alkyl group, an alkoxy group, an amino group, a halogeno group, an aryl group, an aryloxy group and an arylthio group.

11. The electrophotographic photoreceptor of claim 10, wherein said non-metal phthalocyanine is X-type non-metal phthalocyanine.

12. The electrophotographic photoreceptor of claim 10, wherein the photosensitive layer further contains metal phthalocyanine.

13. The electrophotographic photoreceptor of claim 12, wherein said non-metal phthalocyanine and said metal phthalocyanine constitute mixed crystals of non-metal phthalocyanine and metal phthalocyanine.

14. The electrophotographic photoreceptor of claim 12, wherein said metal phthalocyanine is oxotitanium phthalocyanine.

15. An electrophotographic photoreceptor comprising:

a conductive substrate comprising a conductive material, and a photosensitive layer disposed on the conductive substrate and containing two or more of metal phthalocyanines containing oxotitanium phthalocyanine and an enamine compound represented by the following general formula (2)

(2)

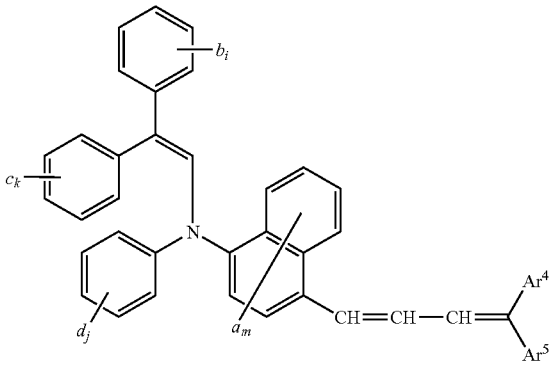

wherein "b", "c" and "d" each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure;

$Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure.

16. An electrophotographic image forming method comprising:

a step of charging the surface of an electrophotographic photoreceptor;

a step of applying exposure to the charged surface to form electrostatic latent images; and a step of developing the electrostatic latent images, wherein the electrophotographic photoreceptor of any one of claims 1, 2, 6, 10 and 15 is used as the electrophotographic photoreceptor.

17. The electrophotographic image forming method of claim 16, wherein a time from the start of exposure to the surface of the electrophotographic photoreceptor till the completion of the development for the electrostatic latent images is 90 msec or less.

18. An electrophotographic apparatus comprising:

the electrophotographic photoreceptor of any one of claims 1, 2, 6, 10 and 15;

charging means for charging a surface of the electrophotographic photoreceptor;

exposure means for applying exposure to the charged surface; and developing means for developing electrostatic latent images formed by exposure.

19. An electrophotographic apparatus comprising:

the electrophotographic photoreceptor of any one of claims 1, 2, 6, 10 and 15, which is supported rotatably to an apparatus main body;

photoreceptor driving means for rotationally driving the electrophotographic photoreceptor at a rotational circumferential speed of Vp;

charging means for charging an outer circumferential surface of the electrophotographic photoreceptor;

exposure means for applying exposure to the charged outer circumferential surface;

developing means for developing electrostatic latent images formed by exposure; and a controller of the photoreceptor driving means which provides a operation such that a value d (=L/Vp) is 90 msec or less, wherein L is a distance along the outer circumferential surface of the electrophotographic photoreceptor from an exposure position by the exposure means to a developing position by the developing means and Vp is the rotational circumferential speed of the photoreceptor.

20. The electrophotographic apparatus of claim 19, wherein the electrophotographic photoreceptor has a cylindrical or circular columnar shape, and a diameter of the electrophotographic photoreceptor is 24 mm or more and 40 mm or less.

21. The electrophotographic photoreceptor of claim 2, wherein said oxotitanium phthalocyanine is oxotitanium phthalocyanine having a crystal form showing main diffraction peaks at the Bragg angles 2θ (2θ±0.2°) of 7.3°, 9.4°, 9.6°, 11.6°, 13.3°, 17.9°, 24.1°, and 27.2° in which a bundle of diffraction peaks formed by overlap of a diffraction peak at 9.4° and a diffraction peak at 9.6° shows a maximum intensity among the diffraction peaks described above, and the diffraction peak at 27.2° shows an intensity next to the maximum intensity in the X-ray diffraction spectrum.

22. The electrophotographic photoreceptor of claim 2, wherein said oxotitanium phthalocyanine is oxotitanium phthalocyanine having a crystal form showing main diffraction peaks at the Bragg angles 2θ(2θ±0.2°) of 9.5°, 9.7°, 11.7°, 15.0°, 23.5°, 24.1°, and 27.3° in the X-ray diffraction spectrum.

23. The electrophotographic photoreceptor of claim 2, wherein said oxotitanium phthalocyanine is oxotitanium phthalocyanine having a crystal form showing main diffraction peaks at the Bragg angles 2θ (2θ±0.2°) of 9.0°, 14.2°, 23.9°, and 27.1° in the X-ray diffraction spectrum.

* * * * *